US011102561B2

(12) United States Patent
Kim

(10) Patent No.: US 11,102,561 B2
(45) Date of Patent: Aug. 24, 2021

(54) DISPLAY APPARATUS

(71) Applicant: LG Display Co., Ltd., Seoul (KR)

(72) Inventor: Kwangho Kim, Osan-si (KR)

(73) Assignee: LG Display Co., Ltd, Seoul (KR)

( * ) Notice: Subject to any disclaimer, the term of this patent is extended or adjusted under 35 U.S.C. 154(b) by 53 days.

(21) Appl. No.: 16/749,383

(22) Filed: Jan. 22, 2020

(65) Prior Publication Data

US 2020/0162802 A1 May 21, 2020

Related U.S. Application Data

(62) Division of application No. 16/179,142, filed on Nov. 2, 2018, now Pat. No. 10,582,282.

(30) Foreign Application Priority Data

Dec. 8, 2017 (KR) ..... 10-2017-0168632

(51) Int. Cl.
*H04R 1/02* (2006.01)
*H04R 7/04* (2006.01)
*H04R 17/00* (2006.01)

(52) U.S. Cl.
CPC ..... *H04R 1/025* (2013.01); *H04R 7/04* (2013.01); *H04R 17/00* (2013.01); *H04R 2499/15* (2013.01)

(58) Field of Classification Search
CPC .. H04R 2499/15; H04R 1/025; H04R 1/2834; G06F 3/147
USPC ..... 381/333
See application file for complete search history.

(56) References Cited

U.S. PATENT DOCUMENTS

| | | | | |
|---|---|---|---|---|
| 9,565,489 | B2 | 2/2017 | Lee et al. | |
| 2005/0025330 | A1 | 2/2005 | Saiki et al. | |
| 2006/0039575 | A1 | 2/2006 | Wada | |
| 2006/0152417 | A1 | 7/2006 | Ying et al. | |
| 2007/0206822 | A1 | 9/2007 | Whitwell et al. | |
| 2009/0097692 | A1* | 4/2009 | Sakamoto | H04R 7/045 381/388 |
| 2014/0334078 | A1 | 11/2014 | Lee et al. | |
| 2015/0078604 | A1 | 3/2015 | Seo et al. | |
| 2015/0138157 | A1 | 5/2015 | Harris et al. | |
| 2015/0341714 | A1 | 11/2015 | Ahn et al. | |
| 2016/0050472 | A1 | 2/2016 | Lee et al. | |
| 2017/0287990 | A1 | 10/2017 | Choi et al. | |

FOREIGN PATENT DOCUMENTS

| | | | |
|---|---|---|---|
| CN | 1581891 | A | 2/2005 |
| CN | 1780494 | A | 5/2006 |
| CN | 1810013 | A | 7/2006 |

(Continued)

OTHER PUBLICATIONS

First Notification of Office Action dated Nov. 27, 2019, issued in corresponding Chinese Patent Application No. 201811390716.1.

*Primary Examiner* — Paul Kim
(74) *Attorney, Agent, or Firm* — Morgan, Lewis & Bockius LLP

(57) ABSTRACT

A display apparatus may include: a display panel configured to display an image, a supporting member on a rear surface of the display panel, a sound generator between the display panel and the supporting member, and a vibration member between the sound generator and the supporting member, the vibration member having a diameter greater than or equal to that of the sound generator.

12 Claims, 30 Drawing Sheets

(56) References Cited

FOREIGN PATENT DOCUMENTS

| | | | |
|---|---|---|---|
| CN | 1930910 | A | 3/2007 |
| CN | 104461115 | A | 3/2015 |
| CN | 105096778 | A | 11/2015 |
| EP | 1 507 438 | A2 | 2/2005 |
| EP | 2 947 857 | A2 | 11/2015 |
| EP | 3 229 272 | A1 | 10/2017 |
| WO | 2004/114637 | A1 | 12/2004 |

* cited by examiner

DISPLAY APPARATUS

CROSS-REFERENCE TO RELATED APPLICATION(S)

This application is a divisional of U.S. patent application Ser. No. 16/179,142, filed on Nov. 2, 2018, which claims the benefit of and priority to Korean Patent Application No. 10-2017-0168632, filed on Dec. 8, 2017, the entirety of each of which is hereby incorporated by reference.

BACKGROUND

1. Technical Field

The present disclosure relates to a display apparatus, and more particularly, to a display apparatus including a sound-generating module.

2. Discussion of the Related Art

With the advancement of an information-oriented society, various requirements for the display field of expressing information in accordance with an electrical information signal are increasing. Thus, research is being conducted on various display apparatuses that are thin, light, and have low power consumption. For example, display apparatuses include a liquid crystal display (LCD) apparatus, a field emission display (FED) apparatus, an organic light-emitting display apparatus, etc.

Among the above display apparatus, the LCD apparatus may include an array substrate including a thin film transistor (TFT), an upper substrate including a color filter and/or a black matrix, and a liquid crystal layer between the array substrate and the upper substrate. An alignment state of the liquid crystal layer is controlled based on an electric field applied between two electrodes in a pixel region, whereby light transmittance is adjusted based on the alignment state of the liquid crystal layer, thereby displaying an image.

The organic light-emitting display apparatus, which is a self-light-emitting display apparatus, may have advantages, such as fast response speed, high light-emitting efficiency, high luminance, and a wide viewing angle in comparison with other display apparatuses. Thus, organic light-emitting display apparatuses are attracting much attention.

A display apparatus may display an image, and an additional speaker for supplying sound generally may have to be provided. If the speaker is provided in the display apparatus, the sound generated in the speaker advances toward a lower or rear portion of the display panel, instead of toward a front portion of the display panel. Thus, the sound does not advance toward the front portion of the display panel, e.g., toward a user who watches the image displayed on the display panel, which may be disruptive to a user's immersion experience.

If the speaker is included in a set apparatus, such as a television, the speaker occupies a space that may impose a restriction on design and a spatial disposition of the set apparatus. Also, the display apparatus may become thick if the speaker is applied to the display apparatus.

SUMMARY

Accordingly, embodiments of the present disclosure are directed to a display apparatus that substantially obviates one or more of the issues due to limitations and disadvantages of the related art.

The inventor has recognized the aforementioned problems, and has done several tests for developing a sound generator that may allow a progressing direction of a sound to be toward a front surface of the display panel when a user views an image on the front surface of the display panel, may allow the display apparatus to be made smaller than related art apparatuses, and may improve sound quality. The inventor has invented a new type of display apparatus including a sound generator that may generate a sound to allow sound to progress toward the front portion of the display panel, may improve sound quality, and may allow a decrease in size of the display apparatus, through several tests.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a display apparatus, including: a display panel configured to display an image, a supporting member on a rear surface of the display panel, a sound generator between the display panel and the supporting member, and a vibration member between the sound generator and the supporting member, the vibration member having a diameter greater than or equal to that of the sound generator.

In another aspect, there is provided a display apparatus, including: a display panel configured to display an image, a supporting member on a rear surface of the display panel, a sound generator between the display panel and the supporting member, a vibration member on a rear surface of the sound generator, and at least one vibration adjustment member between the vibration member and the supporting member.

In another aspect, there is provided a display apparatus, including: a display panel configured to display an image, and a sound-generating module including: a supporting member on a rear surface of the display panel, a sound generator, a vibration member between the sound generator and the supporting member, and at least one vibration adjustment member between the vibration member and the supporting member.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1:
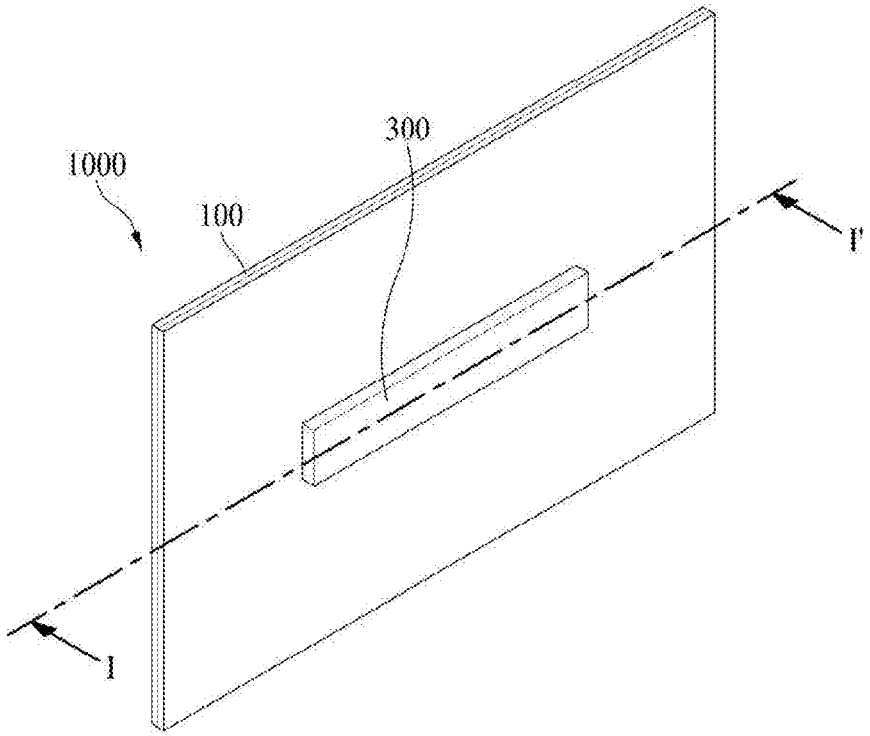
FIG. 1 illustrates a display apparatus according to an example embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist to those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. In the following description, when the detailed description of the relevant known function or configuration is determined to unnecessarily obscure the important point of the present disclosure, the detailed description of such known function or configuration may be omitted. When "comprise," "have," and "include" described in the present disclosure are used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, for example, when the position relationship is described as "on," "over," "under," or "next," one or more parts may be between the two parts unless a more limiting term, such as "just" or "direct(ly)," is used. In describing a time relationship, for example, when the temporal order is described as, for example, "after," "subsequent," "next," or "before," a case that is not continuous may be included unless a more limiting term, such as "just," "immediate(ly)," or "direct(ly)," is used.

It will be understood that, although the terms "first," "second," etc. may be used herein to describe various elements, these elements should not be limited by these terms they are not used to define a particular order. These terms are only used to distinguish one element from another. For example, a first element could be termed a second element, and, similarly, a second element could be termed a first element, without departing from the scope of the present disclosure.

In describing elements of the present disclosure, the terms "first," "second," "A," "B," "(a)," and "(b)" may be used. These terms are merely for differentiating one element from another element, and the essence, number, order or sequence of a corresponding component should not be limited by the terms. Also, when an element or layer is described as being "connected," "coupled," or "adhered" to another element or layer, the element or layer can be, not only directly connected or adhered to that other element or layer, but may also be indirectly connected or adhered to the other element or layer with one or more intervening elements or layers "disposed" or provided between elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item, as well as the first item, the second item, or the third item.

In the description of embodiments, when a structure is described as being positioned "on or above" or "under or below" another structure, this description should be construed as including a case in which the structures contact each other, as well as a case in which a third structure is disposed therebetween. The size and thickness of each element shown in the drawings are given merely for the convenience of description, and embodiments of the present disclosure are not limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

In the present disclosure, examples of a display apparatus is used to encompass a display apparatus such as an organic light-emitting display module (OLED module) or a liquid crystal module (LCM), that may include a display panel and a driving unit for driving the display panel. The display apparatus is used to further encompass a set device (or a set apparatus) or a set electronic apparatus, as a finished product, such as a notebook computer or a laptop computer, a television set, a computer monitor, an equipment apparatus (e.g., display equipment in an automotive apparatus or another type of vehicle apparatus) or a mobile electronic apparatus that is a complete product or a final product (for example, a smartphone or an electronic pad, etc.) that may include the LCM or the OLED module. Therefore, in the present disclosure, the display apparatus is used display apparatus itself, such as the LCM or the OLED module, and also a set apparatus which is a final consumer apparatus or an application product including the LCM or the OLED module.

In some example embodiments, the LCM or the OLED module including a display panel and a driving unit thereof may be referred to as a display apparatus, and the electronic apparatus as a final product including the LCM or the OLED module may be referred to as a set apparatus. For example, the display apparatus may include a display panel, such as an LCD or an OLED, and a source printed circuit board (PCB) as a controller for driving the same, the set apparatus may further include a set PCB that is a set controller set to be electrically connected to the source PCB and to control the overall operations of the set apparatus.

A display panel applied to an embodiment may use all types of display panels, such as a liquid crystal display panel, an organic light-emitting diode (OLED) display panel, and an electroluminescent display panel, but is not limited to these specific types. For example, the display panel of the present disclosure may be any panel capable of being vibrated by a sound generation device according to embodiments of the present disclosure to output a sound. A shape or a size of a display panel applied to a display apparatus according to embodiments of the present disclosure is not limited.

For example, if a display panel is a liquid crystal display panel, the display panel may include a plurality of gate lines, a plurality of data lines, and a plurality of pixels respectively provided in a plurality of pixel areas of the gate lines and the data lines. Also, the display panel may include an array substrate including a thin film transistor (TFT), which is a switching element for adjusting a light transmittance of each of the plurality of pixels, an upper substrate including a color filter and/or a black matrix, and a liquid crystal layer between the array substrate and the upper substrate.

In addition, if a display panel is an organic light-emitting display panel, the display panel may include a plurality of gate lines, a plurality of data lines, and a plurality of pixels respectively provided in a plurality of pixel areas of the gate lines and the data lines. The display panel may include an array substrate including a TFT, which is an element for selectively applying a voltage to each of the pixels, an organic light-emitting device layer on the array substrate, and an encapsulation substrate on the array substrate to cover the organic light-emitting device layer. The encapsulation substrate may protect the TFT and the organic light-emitting device layer from an external impact, and may prevent moisture or oxygen from permeating into the organic light-emitting device layer. A layer provided on the array substrate may include an inorganic light-emitting layer (for example, a nano-sized material layer or the like). The display panel may further include a backing such as a metal plate attached on the rear surface of the display panel, but the backing is not limited to the metal plate, and another structure may be included.

In the present disclosure, the display panel including a sound generator may be implemented at a user interface module in a vehicle, such as the central control panel area in an automobile. For example, such a display panel may be configured between two front seat occupants, such that sounds due to a vibration of the display panel propagate towards the interior of the vehicle. As such, the audio experience within a vehicle can be improved as compared to having speakers at the interior sides or edges of the vehicle.

Hereinafter, a display apparatus according to example embodiments of the present disclosure will be described in detail with reference to the accompanying drawings.

Figure 2:
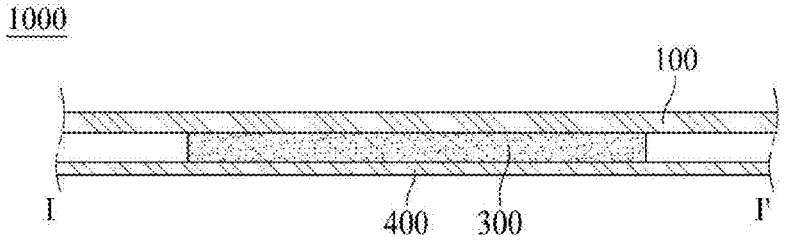
FIG. 2 is a cross-sectional view taken along line I-I' of FIG. 1, and illustrates a display apparatus according to a first example embodiment of the present disclosure.

FIG. 1 illustrates a display apparatus according to an example embodiment of the present disclosure. FIG. 2 is a cross-sectional view taken along line I-I' of FIG. 1, and illustrates a display apparatus according to a first example embodiment of the present disclosure.

With reference to the examples of FIGS. 1 and 2, a display apparatus 1000 may include a display panel 100, and a supporting member 400 on a rear surface of the display panel 100. A sound generator 300 may be on the rear surface of the display panel 100. The display panel 100 may be a light-emitting display panel or a flexible light-emitting display panel, and will be described as follows.

The display panel according to an example embodiment of the present disclosure may include a pixel array substrate including a pixel array with a plurality of pixels, an encapsulation layer for encapsulating the pixel array, and a polarization film attached to an upper portion of the encapsulation layer. Each of the plurality of pixels may be provided in a plurality of pixel areas, which may be defined by a plurality of pixel driving lines. Each of the plurality of pixels may include a pixel circuit, including at least two transistors (TFTs) and at least one capacitor, and a light-emitting device layer that may emit light with a current supplied from the pixel circuit. As an example, the light-emitting device layer may include an organic light-emitting layer, or a quantum dot light-emitting layer. As another example, the light-emitting device layer may include a micro light-emitting diode (micro-LED).

The encapsulation layer may protect a thin film transistor and light-emitting device layer from external impact, and may reduce or prevent moisture or oxygen from penetrating into the light-emitting device layer. The polarization film may be attached to an upper portion of the encapsulation layer using a film attachment member. The polarization film may circularly polarize external light reflected by the TFTs and/or the pixel driving lines provided on the pixel array substrate, thereby enhancing the visibility and contrast ratio of the display panel 100.

The display panel 100 may further include a barrier layer and a touch electrode layer interposed between the encapsulation layer and the polarization film. The display panel 100 may further include a color filter layer provided on the upper portion of the encapsulation layer. Alternatively, the encapsulation layer may be replaced or supplemented with an encapsulation substrate attached to the pixel array substrate by a filler surrounding the pixel array. When the filler is a transparent filler, the encapsulation substrate may be a transparent encapsulation substrate. A driving circuit may be connected to a pad portion provided on the pixel array substrate of the display panel 100, and may supply a driving signal and a data signal to the pixel driving lines to allow each of the pixels to display an image.

Alternatively, the display panel 100 may be a liquid crystal display panel. This will be described below as an example.

The display panel 100 may include a first substrate, a second substrate, and a liquid crystal layer. The first substrate may include a pixel electrode or a common electrode for controlling alignment of liquid crystals of the liquid crystal layer, and may include a TFT connected to the pixel electrode. The second substrate may include a color filter layer to provide for displaying display of a color image.

The display panel 100 may drive the liquid crystal layer with an electric field generated from data and common voltage applied to each of the pixels to control light transmittance of the liquid crystal layer to display an image. The liquid crystal layer may be driven in various driving modes, such as a twisted nematic (TN) mode, a vertical alignment (VA) mode, an in-plane switching mode (IPS), and a fringe field switching (FFS) mode.

For example, the first substrate may be a TFT substrate, and may include a plurality of pixels defined by a plurality of gate and data lines that intersect one another. Each of the pixels may include a TFT connected a corresponding gate line and a corresponding data line, a pixel electrode connected to the TFT, and a common electrode adjacent to the pixel electrode and is supplied with the common voltage. The common electrode may be provided on the second substrate, based on a driving mode of the liquid crystal layer. A driving circuit unit for driving the display panel and a pad portion connected to the driving circuit unit may be on one side of the first substrate. The second substrate may be a color filter array substrate, and may include a color filter layer. When the display panel 100 is driven in a color-filter-on-TFT (COT) mode, or a TFT-on-color-filter (TOC) mode, the color filter layer may be provided on the first substrate.

A backlight unit may be under the display panel 100, and may irradiate light onto the display panel 100. The display panel may control transmittance of light emitted from the backlight unit to display an image.

The display apparatus 1000 may be a display module that may include a display panel 100 and a driving circuit unit for driving the display panel 100. For example, the driving circuit unit may include an integrated circuit chip (IC chip) and/or a flexible printed circuit board (FPCB). The driving circuit unit, such as a driving integrated circuit (IC), for applying a voltage may be mounted on the FPCB. Alternatively, the driving circuit unit may be implemented in a different type, such as chip-on-film (COF) type.

The gate and data lines of the display panel 100 may be connected to the FPCB. When an electrical signal is applied from the FCB, the electrical signal may be applied to a source electrode and a drain electrode of the TFT. The FPCB may receive an image signal from the outside of the display panel 100 to apply driving signals to the gate and data lines of the display panel 100.

The FPCB may generate gate and data signals for driving the display panel 100, and a plurality of timing signals that allow the gate and data signals to be applied at an appropriate time. The FPCB may apply the gate and data signals to the gate and data lines of the display panel 100. Also, the FPCB may include an amplifier. A cover window may be provided on the display module. The cover window may be attached to an entire surface of the display module or an entire surface of the polarization film.

The supporting member 400 may be a plate member provided on the rear surface or the entire surface of the display panel 100. As an example, the supporting member 400 may be referred to as a "cover bottom," a "plate bottom," a "back cover," a "base frame," a "metal frame," a "metal chassis," a "chassis base," and "m-chassis." Thus, the supporting member 400 may include any type of frame or plate structure on the rear surface of the display apparatus 1000.

The sound generator 300 may include a piezoelectric sound generator. The sound generator may be referred to as an "actuator," an "exciter," or a "transducer," but embodiments are not limited to those terms.

When the sound generator 300 includes a piezoelectric sound generator, a display apparatus having a smaller thickness than a magnetic type speaker may be manufactured. For example, the magnetic type speaker may include a magnet and a center pole on a plate, a bobbin around the center pole, and a coil wound around the bobbin.

Figure 3A:
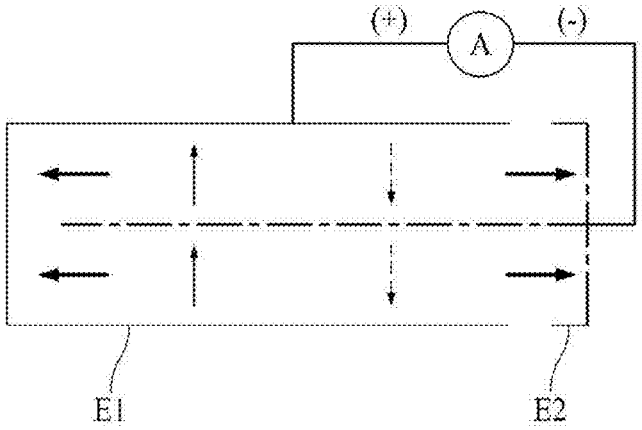
FIGS. 3A and 3B illustrate a sound generating method of a sound generator according to an example embodiment of the present disclosure.
Figure 3B:
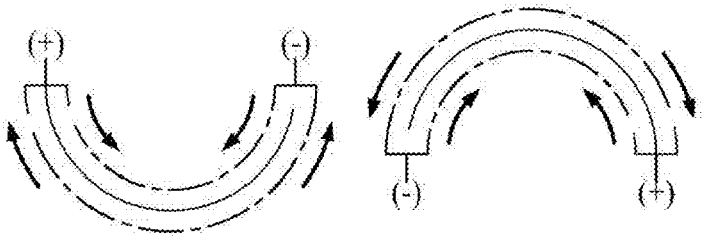

FIGS. 3A and 3B illustrate a sound generating method of a sound generator according to an example embodiment of the present disclosure.

A piezoelectric element may be an element having properties (e.g., a piezoelectric effect) in which electrical polarization occurs based on an external force to cause a potential difference. When a voltage is applied, deformation or stress may occur. According to one embodiment, the piezoelectric element may include, for example, as crystal, tourmaline, Rochelle salt (potassium sodium tartrate tetrahydrate), barium titanate ($BaTiO_3$), ammonium dihydrogen phosphate (or monoammonium phosphate) ($NH_4H_2PO_4$), piezoceramics, etc.

The sound generator may include a piezoelectric material layer having a piezoelectric effect, a first electrode on a front surface of the piezoelectric material layer, and a second electrode on a rear surface of the piezoelectric material layer. When the sound generator includes a piezoelectric material layer, the sound generator may be referred to as a "piezoelectric element." The piezoelectric material layer may include a piezoelectric material that generates vibration by means of an electric field. For example, the first electrode and the second electrode may overlap each other by interposing the piezoelectric material layer therebetween. The first electrode and the second electrode may include an opaque metal material having a relatively low resistance and excellent radiation property, and may be formed of a transparent conductive material or a conductive polymer material, without limitation to the opaque metal material. Embodiments are not limited to these examples.

The piezoelectric element may be formed by sintering a material having a piezoelectric effect. The piezoelectric material layer may be characterized in that a potential difference is generated by dielectric polarization based on a relative position change of positive (+) ions and negative (−) ions, while acting a pressure or twisting on a crystalline structure by an external force. Thus, vibration may be generated by an electric field according to a voltage that may be applied.

The piezoelectric material layer may include one or more of: a piezoelectric material of a polymer, a piezoelectric material of a thin film, a piezoelectric material of a complex material, and a piezoelectric material of single crystalline ceramic or polycrystalline ceramic. For example, the piezoelectric material layer may include an insulating elastic material such as silicon, acryl, and/or urethane. The piezoelectric material of a polymer may include one or more of: polyvinylidene difluoride (PVDF), polyvinylidene fluoride-co-trifluoroethylene (P(VDF-TrFe)), or P(VDFTeFE). The piezoelectric material of a polymer may be realized through a piezoelectric polymer material, such as PVDF or PZT (e.g., a generic term of solid solution of lead zirconate ($PbZrO_3$) and lead titanate ($PbTiO_3$)), and PVDF may include polyvinylidene fluoride trifluoroethylene (PVDF-TrFE), and may be characterized in that it may be easy to be manufactured in the form of a flexible film.

The piezoelectric material of a thin film may include one or more of: zinc oxide (ZnO), cadmium sulfide (CdS), and aluminum nitride (AlN), for example. The piezoelectric material of a complex material may include one or more of: lead zirconate titanate (PZT)-PVDF, PZT-Silicon Rubber, PZT-Epoxy, PZT-foam polymer, and PZT-foam urethane, for example. The piezoelectric material of single crystalline ceramic may include one or more of: alpha-aluminum phosphate ($\alpha$-$AlPO_4$), alpha-silicon dioxide ($\alpha$-$SiO_2$), lithium niobate ($LiNbO_3$), terbium molybdate ($Tb_2(MoO_4)_3$), lithium borate (or lithium tetraborate) ($Li_2B_4O_7$), and ZnO, for example. The piezoelectric material of polycrystalline ceramic material may include one or more of: a PZT based material, a PT based material, a PZT-Complex Perovskite based ceramic material, and a $BaTiO_3$ material.

Therefore, the piezoelectric element may have a structure in which a piezoelectric element including an electrode may be attached to both sides of a metal vibration plate or a polymer, e.g., using an adhesive. A shape of the piezoelectric element may be deformed by applying an alternating current (AC) voltage to both sides of the piezoelectric element, and sound may be generated by transferring the shape deformation of the piezoelectric element to a vibration plate.

A piezoelectric speaker using the piezoelectric element may be categorized into a film type piezoelectric speaker and a laminated (or stacked) type piezoelectric speaker. The film type piezoelectric speaker may use the principle in which an electrode may be formed of a piezoelectric film material in each of a lower portion and an upper portion, and sound may be generated by applying a voltage.

The laminated (or stacked) type piezoelectric speaker may incorporate a plurality of layers, including a piezoelectric element between the two electrodes. An AC voltage may be applied between the two electrodes, and the laminated type piezoelectric speaker may be bent upward and downward according to the AC voltage. The piezoelectric element may use the above-described materials, but embodiments are not limited thereto. Here, an example where a sound generator includes the laminated type piezoelectric speaker is described, but embodiments of the present disclosure are not limited thereto. For example, the film type piezoelectric speaker may be also incorporated. This will be described below with reference to the examples of FIGS. 3A and 3B.

FIGS. 3A and 3B illustrate a sound generating method of a sound generator according to an embodiment of the present disclosure.

FIG. 3A illustrates a side structure of a sound generator according to an example embodiment of the present disclosure. With reference to the example of FIG. 3A, a positive (+) voltage and a negative (−) voltage are respectively applied to a first electrode E1 and a second electrode E2. When a voltage having a direction opposite to a polarization direction (illustrated as a solid line) is applied (electric field direction is shown as a dotted line), a stress may be generated based on a piezoelectric effect, and deformation based on contraction or expansion in a displacement direction (illustrated as a thick solid line) may be generated. Therefore, as shown in the example of FIG. 3B, deformation caused by an alternating current voltage may occur in a piezoelectric type sound generator, and the piezoelectric type sound generator may be changed to a vertical motion mode or an up-and-down motion mode, or may be bent in a displacement direction ((illustrated as a thick solid line). Vibration may be generated based on the vertical motion mode or the up-and-down motion mode, and a sound may be generated based on the vibration.

The inventor of the present disclosure has recognized problems in that an overall area of the sound generator may be fixed to reduce vibration, and a frequency band may become narrow due to rigidity of the display panel when the piezoelectric sound generator is attached to the entire display panel. The inventor has recognized that it may be difficult to change a play band through design because the frequency band of a low sound band of a sound is determined in accordance with a material and a structure of the display panel. Also, the inventor of the present disclosure has recognized a problem in that a frequency band is upgraded to a high sound band because the entire area of the sound generator is fixed. Furthermore, the inventor of the present disclosure has recognized a problem that it may be difficult to bond the supporting member to the display panel when the piezoelectric sound generator has been previously attached to the display panel.

In this respect, the inventor of the present disclosure has performed several tests to output a sound of a low sound band, and has invented a display apparatus that includes a new type sound generator that may improve sound output property of a low-pitched sound band to a high-pitched sound band. This display apparatus will be described with reference to the examples of FIGS. 4 to 7.

Figure 4:
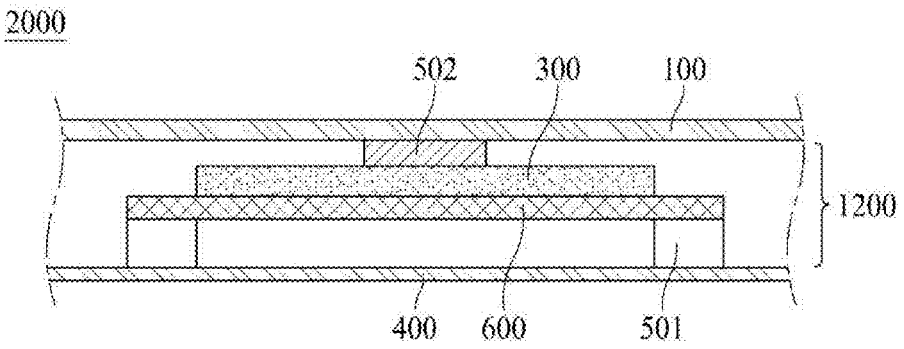
FIG. 4 illustrates a display apparatus according to a second example embodiment of the present disclosure.

FIG. 4 illustrates a display apparatus according to a second example embodiment of the present disclosure.

With reference to the example of FIG. 4, the display apparatus 2000 may include a display panel 100, a supporting member 400, and a sound-generating module 1200. The sound-generating module 1200 may be between the display panel 100 and the supporting member 400. The sound-generating module 1200 may include a sound generator 300, a vibration member 600, a vibration adjustment member 501, and a vibration transfer member 502.

The supporting member 400 and the sound generator 300 may be on a rear surface of the display panel 100. The sound generator 300 may be between the display panel 100 and the supporting member 400. The vibration member 600 may be between the sound generator 300 and the supporting member 400 to generate a low-pitched sound band. For example, the vibration member 600 may be on the rear surface of the sound generator 300. The low-pitched sound band may be transferred to the display panel 100 through an air gap between the vibration member 600 and the display panel 100. The vibration member 600 may include stainless steel, but embodiments are not limited thereto.

The vibration member 600 may have a size, e.g., diameter, area, or volume, greater than or equal to that of the sound generator 300. When the size of the vibration member 600 is greater than that of the sound generator 300, the low-pitched sound band may be more improved than when the size of the vibration member 600 is smaller than that of the sound generator 300.

At least one vibration adjustment member 501 may be between the vibration member 600 and the supporting member 400 to generate good resonance from the vibration member 600. The supporting member 400 may be on the rear surface of the vibration member 600. At least one vibration adjustment member 501 may be at the periphery of the display panel 100. At least one vibration adjustment member 501 may be at the periphery of the sound generator 300. For example, at least one vibration adjustment member 501 may be respectively at each of two peripheries of the sound generator 300.

When at least one vibration adjustment member 501 includes a soft material, resonance frequency may be lowered. The soft material may be a rubber-based material or a cushion material, but embodiments are not limited thereto. For example, the rubber-based material may be silicon or urethane, but embodiments are not limited thereto. This will be described with reference to the following Equation 1.

$$f_0 = \frac{1}{2\pi} \times \sqrt{\frac{s}{m}} \quad \text{[Equation 1]}$$

Presuming that strength of a damper of the sound generator is s (stiffness) and weight is m (mass), a resonance frequency $f_o$ of a sound wave generated by vibration of the sound generator may be determined by Equation 1. When the vibration adjustment member 501 includes a soft material, strength of the sound generator may be reduced in accordance with Equation 1 to reduce resonance frequency, whereby sound property of a low sound band may be improved.

The vibration adjustment member 501 may serve as a spring, and may lower resonance frequency by providing flexibility to vibration of the sound generator 300. Therefore, the vibration adjustment member 501 may be a suspension, a damper, a spider, or an edge, but embodiments are not limited thereto.

Therefore, at least one vibration adjustment member 501 may assist the sound generator 300 to generate a low-pitched sound band. For example, at least one vibration adjustment member 501 may adjust a low-pitched sound band of the sound generator 300 by lowering the frequency band.

Because the vibration adjustment member 501 may perform an alignment function during a bonding process of the display panel 100 and the supporting member 400, a position of the sound generator 300 may be fixed. For example, when the vibration adjustment member 501 has been previously attached to the supporting member 400 to perform an alignment function, the position of the sound generator 300 may be set, and assembly of the display panel 100 with the supporting member 400 may be improved.

The vibration transfer member 502 may be between the display panel 100 and the sound generator 300. The vibration transfer member 502 may include a material and an adhesive member. For example, the adhesive member may be a double-sided tape, a single-sided tape, an adhesive, and/or a bond, but embodiments are not limited thereto. The vibration transfer member 502 and at least one vibration adjustment member 501 may include respective materials that are different from each other. For example, the vibration transfer member 502 may be a material that is stronger than that of the vibration adjustment member 501, and may be formed of a hard material. For example, the hard material may be one or more of: a metal, a plastic, a paper, a silicon, and/or a carbon fiber, but embodiments are not limited thereto.

The vibration transfer member 502 may transmit a high-pitched sound band of the sound generator 300 to the display panel 100. The vibration transfer member 502 may be between the display panel 100 and the sound generator 300, such that the sound generator 300 may not be attached to an entire area of the display panel 100. Thus, the vibration transfer member 502 may contact the display panel 100 at its rear side and the sound generator 300 at a side facing the rear side of the display panel 100. Therefore, because a contact area between the sound generator 300 and the display panel 100 may be only a part of the display panel 100, and may not be the entire area of the display panel 100, the sound output from the sound generator 300 may not reach a high-pitched sound. Because a position area where the sound generator 300 is fixed to the display panel 100 may be reduced or minimized, unnecessary vibration or motion of the sound generator 300 may be avoided to be favorable for vibration, whereby flatness of the sound may be improved. The term "flatness" refers to a difference between a maximum point and a minimum point of a sound level pressure in frequency property. If the difference between the maximum point and the minimum point of the sound level pressure becomes small, sound characteristics may be excellent. Also, if the number of peaks and dips, which generate the difference, becomes small, sound characteristics may be excellent. The term "peak" means that a sound pressure is splashed at a specific frequency, and the term "dip" means that a specific frequency is suppressed, and thus a low sound pressure is generated.

Therefore, a display apparatus according to an example embodiment of the present disclosure may play a sound of a low sound band through the vibration member 600, may output a sound of a low sound band from the sound generator 300 through the vibration adjustment member 501, and may output a sound of a high sound band through the vibration transfer member 502. Therefore, the sound-generating module 1200 may output a low-pitched sound band to a high-pitched sound band, which may be improved from the sound of a low-pitched sound band, and may improve overall sound flatness.

Figure 5:
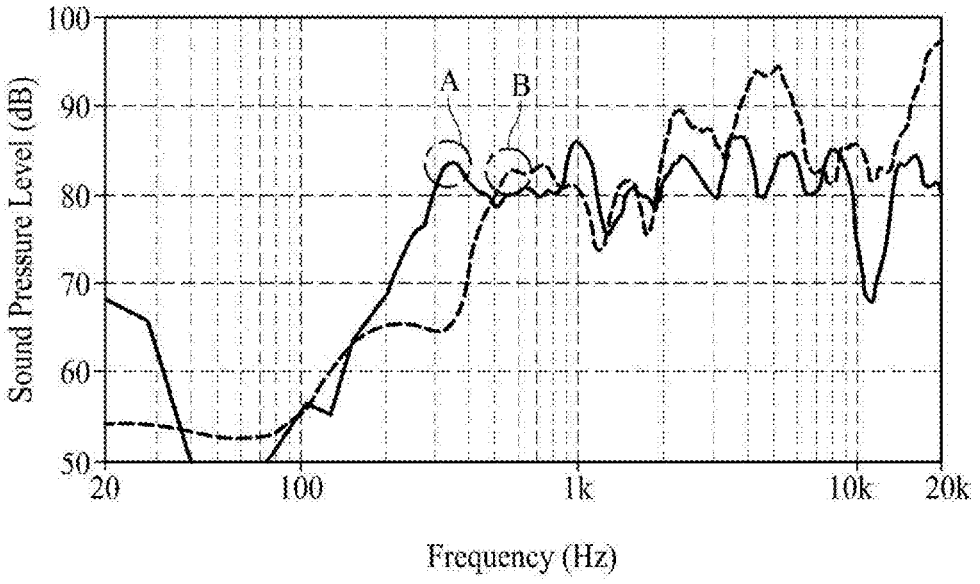
FIG. 5 illustrates a sound output characteristic according to an example embodiment of the present disclosure.

FIG. 5 illustrates a sound output characteristic according to an example embodiment of the present disclosure.

In FIG. 5, a horizontal axis (x-axis) denotes a frequency in hertz (Hz), and a vertical axis (y-axis) denotes a sound pressure level in decibels (dB).

The sound output characteristic may be measured by a sound analysis equipment. The sound analysis equipment may include a sound card for transmitting and receiving a sound to or from a control personal computer (PC), an amplifier for amplifying a signal generated from the sound card and transferring the amplified signal to a sound-generating module, and a microphone for collecting a sound generated thorough the sound-generating module in the display panel. The sound collected by the microphone may be input to the control PC through the sound card, and a control program may be employed to check the input sound to analyze the sound of the sound-generating module.

In FIG. 5, it is noted that a minimum low sound play frequency (marked with a circle "B") of a dotted line is about 550 Hz. Also, it is noted that a minimum low sound play frequency (marked with a circle "A") of a solid line is about 350 Hz. Therefore, if the display panel includes a sound generator, a vibration member, a vibration adjustment member, and a vibration transfer member, it is noted that low sound play frequency is lowered. In an example embodiment of the present disclosure, it is noted that flatness of a sound at about 350 Hz or more may be further improved than the dotted line. For example, it is noted that a peak or dip is generated at about 1 kHz or less in case of the dotted line, whereas a peak or dip is not generated at 1 kHz or less in an example embodiment of the present disclosure corresponding to the solid line. For example, based on a sound pressure level of about 80 dB, a peak is more generated at about 1 kHz or more in case of the dotted line, whereas sound planarization is slow at about 1 kHz or more in an example embodiment of the present disclosure corresponding to the solid line. Therefore, it is noted that sound planarization may be further improved in an example embodiment of the present disclosure than in the comparative dotted line.

Figure 6:
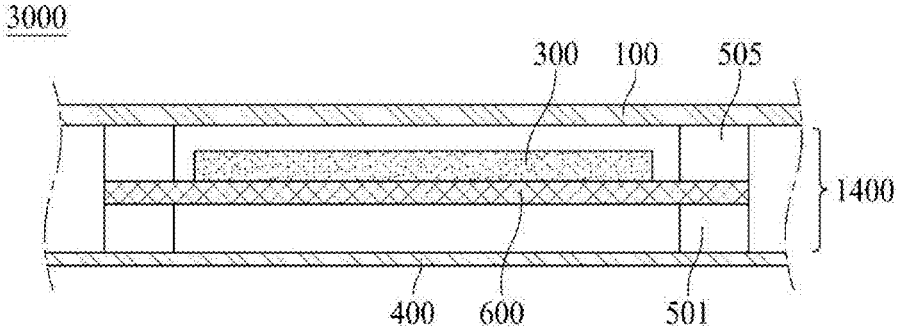
FIG. 6 illustrates a display apparatus according to a third example embodiment of the present disclosure.

FIG. 6 illustrates a display apparatus according to a third example embodiment of the present disclosure.

With reference to the example of FIG. 6, the display apparatus 3000 may include a display panel 100, a supporting member 400, and a sound-generating module 1400. The sound-generating module 1400 may be between the display panel 100 and the supporting member 400. The sound-generating module 1400 may include a sound generator 300, a vibration member 600, a vibration adjustment member 501, and a second vibration adjustment member 505.

The supporting member 400 and the sound generator 300 may be on a rear surface of the display panel 100. The sound generator 300 may be between the display panel 100 and the supporting member 400. The vibration member 600 may be between the sound generator 300 and the supporting member 400 to generate a low-pitched sound band. For example, the vibration member 600 may be on the rear surface of the sound generator 300. The sound of the low-pitched sound band may transfer to the display panel 100 through an air gap between the vibration member 600 and the display panel 100. The vibration member 600 may include a stainless steel, but embodiments are not limited thereto.

The vibration member 600 may have a size, e.g., diameter, area, or volume, greater than or equal to that of the sound generator 300. If the size of the vibration member 600 is greater than that of the sound generator 300, the sound of the low-pitched sound band may be more improved than when the size of the vibration member 600 is smaller than that of the sound generator 300.

At least one vibration adjustment member 501 may be between the vibration member 600 and the supporting member 400 to generate good resonance from the vibration member 600. At least one vibration adjustment member 501 may be at the periphery of the display panel 100. At least one vibration adjustment member 501 may be at the periphery of the sound generator 300. For example, at least one vibration adjustment member 501 may be respectively at each of two peripheries of the sound generator 300. At least one vibration adjustment member 501 may be respectively at each of two peripheries of the vibration member 600.

When at least one vibration adjustment member 501 may include a soft material, resonance frequency may be lowered. The soft material may be a rubber-based material or a cushion material, but embodiments are not limited thereto. For example, the rubber-based material may be silicon or urethane, but embodiments are not limited thereto. Because the description of the vibration adjustment member is substantially similar to that of Equation 1, a detailed description will be omitted herein.

The vibration adjustment member 501 may serve as a spring, and may lower a resonance frequency by providing flexibility to vibration of the sound generator 300. Therefore, the vibration adjustment member 501 may be a suspension, a damper, a spider, or an edge, but embodiments are not limited to these terms or structures.

Therefore, at least one vibration adjustment member 501 may assist the sound generator 300 to generate a sound of a low-pitched sound band. For example, at least one vibration adjustment member 501 may adjust a sound of a low-pitched sound band of the sound generator 300 by lowering the frequency band.

Because the vibration adjustment member 501 may perform an alignment function during a bonding process of the display panel 100 and the supporting member 400, a position of the sound generator 300 may be fixed. For example, when the vibration adjustment member 501 has been previously attached to the supporting member 400 to perform an alignment function, the position of the sound generator 300 may be set, and assembly of the display panel 100 with the supporting member 400 may be improved.

At least one second vibration adjustment member 505 may be between the display panel 100 and the vibration member 600. At least one second vibration adjustment member 505 may be at the periphery of the display panel 100. At least one second vibration adjustment member 505 may be at the periphery of the sound generator 300. For example, at least one second vibration adjustment member 505 may be respectively at two peripheries of the sound generator 300. At least one second vibration adjustment member 505 may be respectively at two peripheries of the vibration member 600.

At least one second vibration adjustment member 505 may include the same material as that of at least one vibration adjustment member 501, but embodiments are not limited thereto. For example, the second vibration adjustment member 505 may include a rubber-based material or a cushion material, but embodiments are not limited thereto. For example, the rubber-based material may be silicon or urethane, but embodiments are not limited thereto.

The second vibration adjustment member 505 may reinforce a sound of a low sound band or a low and middle sound band of the sound generator 300 together with the vibration member 600. For example, at least one vibration adjustment member 501 and at least one second vibration adjustment member 505 may adjust a sound of a low-pitched sound band or a low and middle-pitched sound band of the sound generator 300.

Therefore, a display apparatus according to the third example embodiment of the present disclosure may generate a sound of a low sound band through the vibration member 600, and the sound of a low-pitched sound band or a low and middle-pitched sound band of the sound generator 300 may be improved by the vibration adjustment member 501 and the second vibration adjustment member 505. Therefore, the sound-generating module 1400 may output a sound of a low-pitched sound band to a high-pitched sound band, which may be improved from the sound of a low sound band or a low and middle-pitched sound band, and may improve overall sound flatness.

Figure 7:
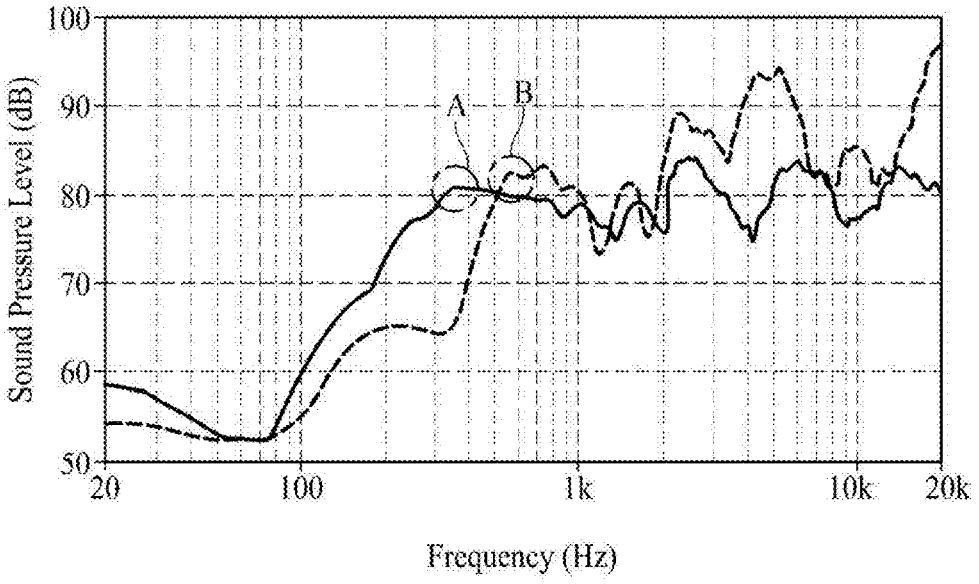
FIG. 7 illustrates a sound output characteristic according to an example embodiment of the present disclosure.

FIG. 7 illustrates a sound output characteristic according to an example embodiment of the present disclosure.

In FIG. 7, a horizontal axis (x-axis) denotes a frequency in hertz (Hz), and a vertical axis (y-axis) denotes a sound pressure level in decibels (dB).

The sound output characteristic may be measured by a sound analysis equipment. The sound analysis equipment may include a sound card for transmitting and receiving a sound to and from a control PC, an amplifier for amplifying a signal generated from the sound card and transferring the amplified signal to a sound-generating module, and a microphone for collecting a sound generated thorough the sound-generating module in the display panel. The sound collected through the microphone may be input to the control PC through the sound card, and a control program may be employed to check the input sound to analyze the sound of the sound-generating module. In FIG. 7, a dotted line measures the display apparatus of the FIG. 2 example, and a solid line measures the display apparatus of the FIG. 6 example.

It is noted that a minimum low sound play frequency (marked with a circle "B") of a dotted line in FIG. 7 is about 550 Hz. Also, it is noted that a minimum low sound play frequency (marked with a circle "A") of a solid line in FIG. 7 is about 350 Hz. Therefore, if the display panel may include a sound generator, a vibration member, a vibration adjustment member and a second vibration adjustment member, it is noted that low sound generating frequency is lowered. In an embodiment of the present disclosure, it is noted that planarization of a sound at about 350 Hz or more may be further improved than the comparative dotted line. For example, it is noted that a peak or dip is generated at about 1 kHz or less in the case of the dotted line, whereas a peak or dip is not generated at about 1 kHz or less in an embodiment of the present disclosure corresponding to the solid line. For example, based on a sound pressure level of about 80 dB, a peak is more generated at about 1 kHz or more in case of the comparative dotted line, whereas sound planarization is slow at about 1 kHz or more in an embodiment of the present disclosure corresponding to the solid line. Therefore, it is noted that sound planarization may be further improved in the embodiment of the present disclosure than the comparative dotted line.

Figure 8A:
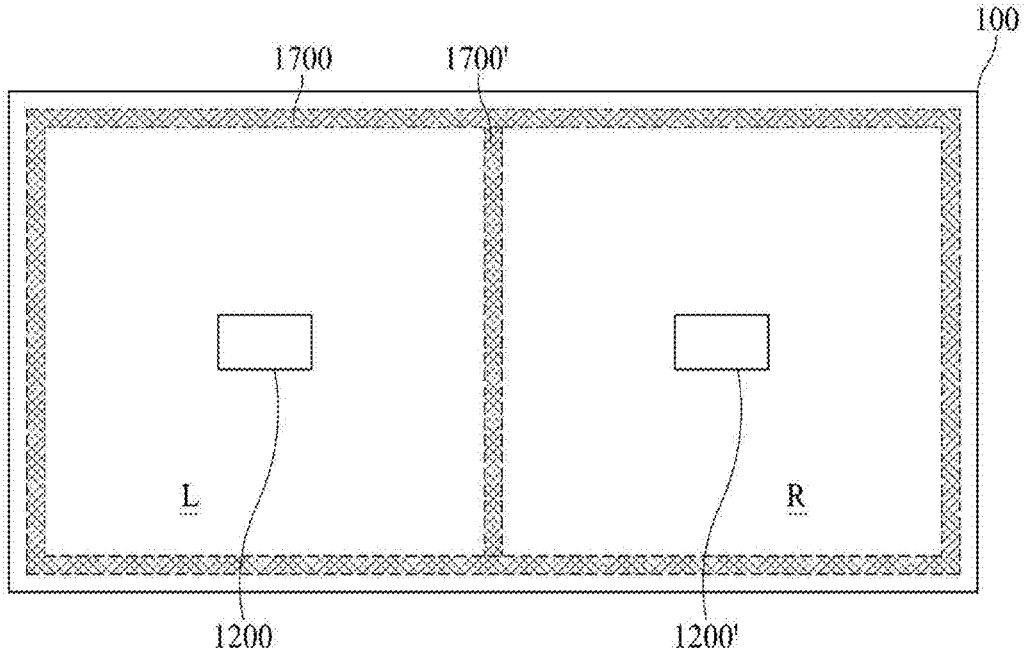
FIGS. 8A to 8C illustrate examples of a sound-generating module and a partition in a display apparatus according to an example embodiment of the present disclosure.
Figure 8B:
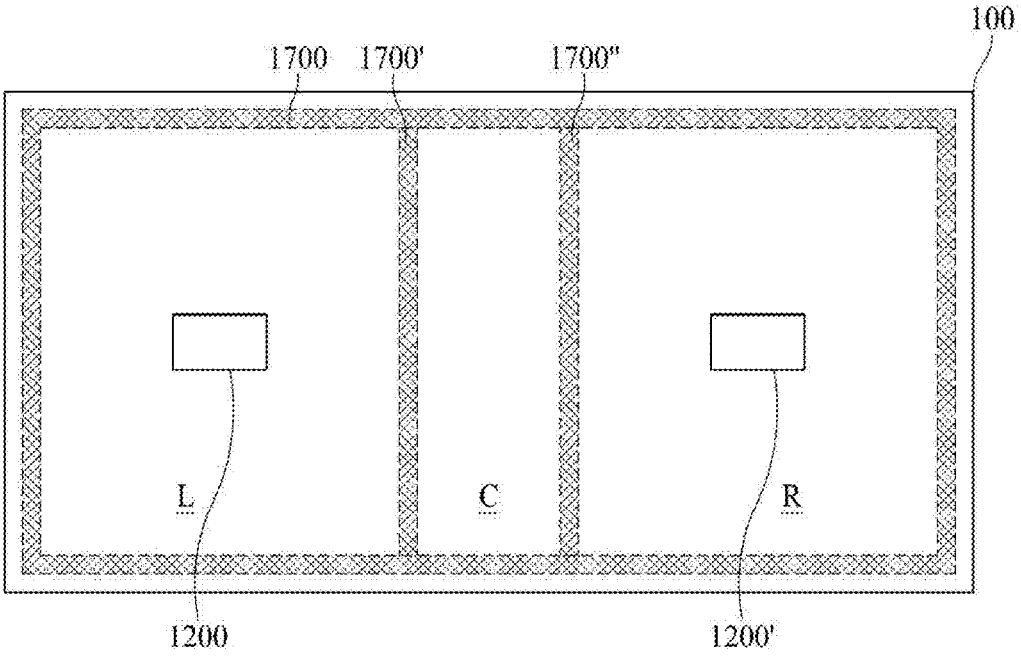
Figure 8C:
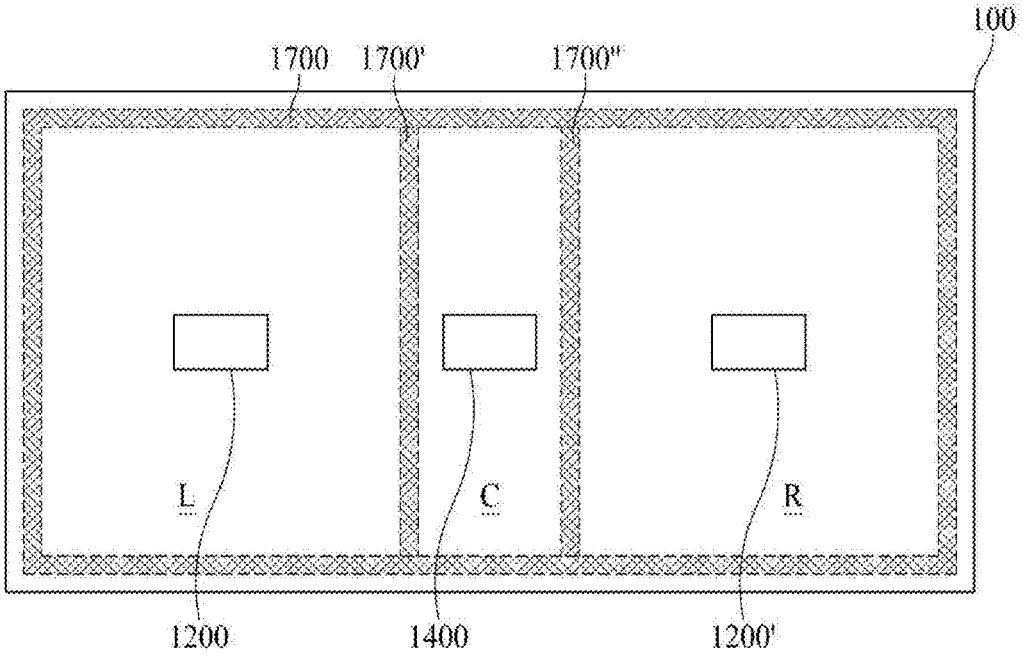

FIGS. 8A to 8C illustrate examples of a sound-generating module and a partition in a display apparatus according to an example embodiment of the present disclosure.

With reference to the examples of FIGS. 8A to 8C, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100. It should be appreciated that "left" and "right" as used herein are interchangeable, as would be understood to one of ordinary skill in the art. The terms are used herein for convenience of explanation.

With reference to the examples of FIGS. 8A and 8B, a 1-1$^{st}$ sound-generating module 1200 and a 1-2$^{nd}$ sound-generating module 1200' may be respectively at the first area L and the second area R. For example, the 1-1$^{st}$ sound-generating module 1200 may be at the first area L of the rear surface of the display panel 100, and the 1-2$^{nd}$ sound-generating module 1200' may be at the second area R of the rear surface of the display panel 100. Because the 1-1$^{st}$ sound-generating module 1200 and the 1-2$^{nd}$ sound-generating module 1200' are the sound-generating modules described above with reference to the FIG. 4 example, its detailed description will be omitted.

With reference to the example of FIG. 8C, the 1-1$^{st}$ sound-generating module 1200 and the 1-2$^{nd}$ sound-generating module 1200' may be respectively at the first area L and the second area R. The second sound-generating module 1400 may be at the third area C. Because the second sound-generating module 1400 is the sound-generating module described with reference to the FIG. 6 example, its detailed description will be omitted.

With reference to the examples of FIGS. 8A to 8C, a first partition 1700 may be at the periphery of the rear surface of the display panel 100. The first partition 1700 may be at the periphery of the supporting member or the periphery of an upper surface of the supporting member. Also, the first partition 1700 may be between the display panel and the supporting member. For example, the first partition 1700 may be between the rear surface of the display panel and the upper surface of the supporting member. The first partition 1700 may be an entire area of four sides outside the rear surface of the display panel 100. The first partition 1700 may be disposed along a shape of the display panel 100. For example, the first partition 1700 may have a rectangular shape, and may be changed in accordance with the shape of the display panel, without limitation to the rectangular shape.

With reference to the example of FIG. 8A, a second partition 1700' may be between the 1-1$^{st}$ sound-generating module 1200 and the 1-2$^{nd}$ sound-generating module 1200'. For example, the second partition 1700' may be between the first area L and the second area R.

With reference to the examples of FIGS. 8B and 8C, at least two partitions, a second partition 1700', and a third partition 1700" may be between the first sound-generating module 1200 and the second sound-generating module 1200'. For example, the second partition 1700' may be between the first area L and the third area C, and the third partition 1700" may be between the second area R and the third area C.

The first partition 1700, the second partition 1700', and the third partition 1700" may be on the rear surface of the display panel 100. The first partition 1700, the second partition 1700', and the third partition 1700" may be between the display panel and the supporting member. The first partition 1700, the second partition 1700', and the third partition 1700" may be on the rear surface or the upper surface of the supporting member.

The first partition 1700, the second partition 1700', and the third partition 1700" may include a double-sided tape, a single-sided tape, an adhesive, and/or a bond, but embodiments are not limited thereto. The first partition 1700, the second partition 1700', and the third partition 1700" may be an air gap or space in which a sound may be generated when the display panel 100 is vibrated by the sound-generating modules 1200, 1200', and 1400'. That is, the first partition 1700, the second partition 1700', and the third partition 1700" may be an air gap or space for generating or transferring a sound. The partition may be an enclosure or a baffle, but embodiments are not limited to these terms. The first partition 1700, the second partition 1700', and the third partition 1700" may have a sealed structure or a non-sealed structure. Therefore, each of the first partition 1700, the second partition 1700', and the third partition 1700" may reduce or prevent a sound from leaking through each side of the display panel 100 to output the sound to the front of the display panel 100, whereby sound output characteristic may be improved.

The second partition 1700' and the third partition 1700" may split left and right sounds generated from the 1-1$^{st}$ sound-generating module 1200 and the 1-2$^{nd}$ sound-generating module 1200'. When vibration of the display panel 100 at the space or the air gap that may be defined as the second partition 1700' and the third partition 1700" is attenuated or absorbed at the center of the display panel, the sound at the first area L corresponding to the left area may be reduced or prevented from being transferred to the space of the second area R corresponding to the right area, and the sound at the second area R corresponding to the right area may be reduced or prevented from being transferred to the first area L corresponding to the left area. Therefore, when the second partition 1700' and the third partition 1700" are configured, left and right sounds may be split, and sound output property may be improved. The 1-1$^{st}$ sound-generating module 1200 and the 1-2$^{nd}$ sound-generating module 1200' may output a sound of different low-, middle-, and high-pitched sound bands, output stereo sounds by left and right sound split, and a display apparatus having sound output characteristics of a 2.1 channel type may be provided. For example, the middle-pitched sound band may be about 200 Hz to 3 kHz, the high-pitched sound band may be about 3 kHz or more, and the low-pitched sound band may be about 200 Hz or less. Embodiments are not limited thereto.

A partition of a dual structure including two or more partitions may be provided between the 1-1$^{st}$ sound-generating module 1200 and the 1-2$^{nd}$ sound-generating module 1200'. For example, when left and right areas of the display panel have the same vibration property when the left and right areas output the same sound to realize mono sound, resonance or interference may be maximized at a certain frequency band, whereby a problem may occur in that a sound pressure level may be reduced. Therefore, two or more partitions may be provided to reduce an influence of sound property due to a difference in resonance vibration times of low-, middle-, and high-pitched sounds generated from the 1-1$^{st}$ sound-generating module of the first area L corresponding to the left area and the 1-2$^{nd}$ sound-generating module of the second area R corresponding to the right area. If three or more partitions are provided between the 1-1$^{st}$ sound-generating module and the 1-2$^{nd}$ sound-generating module, the sound pressure level reduction may be reduced, even though sound interference at the left and right areas may occur severely, whereby a discontinuous sound output property may be reduced or prevented from being recognized.

Therefore, when two or more partitions are provided at the center area of the display panel, an influence of sound property due to a difference in resonance vibration times of low-, middle-, and high-pitched sounds at the left and right areas of the display panel may be reduced. When the partitions are provided between two sound-generating modules to enable left and right split of the sound, stereo property of the sound may be improved. The sounds of low-, middle-, and high-pitched sound bands may be output by two sound-generating modules.

With reference to the example of FIG. 8A, the 1-1$^{st}$ sound-generating module 1200 may be at the first area L corresponding to the left area, and the 1-2$^{nd}$ sound-generating module 1200' may be at the second area R corresponding to the right area. Because left and right sounds may be split by the second partition 1700', degradation of sound quality, which is caused by interference at the first area L and the second area R, may be reduced. Therefore, the 1-1$^{st}$ sound-generating module 1200 and the 1-2$^{nd}$ sound-generating module 1200' may output sounds of different low-, middle-, and high-pitched sound bands in which a sound of a low sound band is improved.

With reference to the example of FIG. 8B, the 1-1$^{st}$ sound-generating module 1200 may be at the first area L corresponding to the left area, and the 1-2$^{nd}$ sound-generating module 1200' may be at the second area R corresponding to the right area. No sound-generating module may be at the third area C corresponding to the center area. For this reason, degradation of sound quality, caused by interference at the first area L and the second area R, may be reduced. Therefore, sound property of the low-, middle-, and high-pitched sound bands may be further improved. An area of the third area C may be smaller than those of the first area L and the second area R. The third area C may reduce degradation of sound quality due to interference at the first area L and the second area R. In this case, the sound of the low-pitched sound band may be improved. Therefore, the sounds of the low-, middle-, and high-pitched sound bands, in which sound of the low-pitched sound band may be improved, may be output, and stereo sounds may be output.

With reference to the example of FIG. 8C, the 1-1$^{st}$ sound-generating module 1200 may be at the first area L corresponding to the left area, the 1-2$^{nd}$ sound-generating module 1200' may be at the second area R corresponding to the right area, and the second sound-generating module 1400 may be at the third area C corresponding to the center area. The second sound-generating module 1400 may improve a sound of a low-pitched sound band or sounds of low- and middle-pitched sound bands. For example, the second sound-generating module 1400 may be a woofer speaker. Therefore, the sounds of low-, middle-, and high-pitched sound bands may be improved, and a sound of a low-pitched sound band or sounds of low- and middle-pitched sound bands may be improved. Therefore, the display apparatus, which may output stereo sounds and may have a 2.1 channel type sound output characteristic, may be provided.

FIGS. 8A to 15J illustrate examples in which sound-generating module is at the center of the first area L, which may be a left area of the display panel 100, or the second area R, which may be a right area of the display panel 100. Without limitation to this example, the sound-generating module may be inclined toward the first area L, which may be a left area of the display panel 100, or the second area R, which may be a right area of the display panel 100. Alternatively, if the sound-generating module is more inclined toward the outer sides of the first area L and the second area R, rather than when the sound-generating module is at the center of the first area L and the second area R, stereo sound property may be further improved.

Figure 9A:
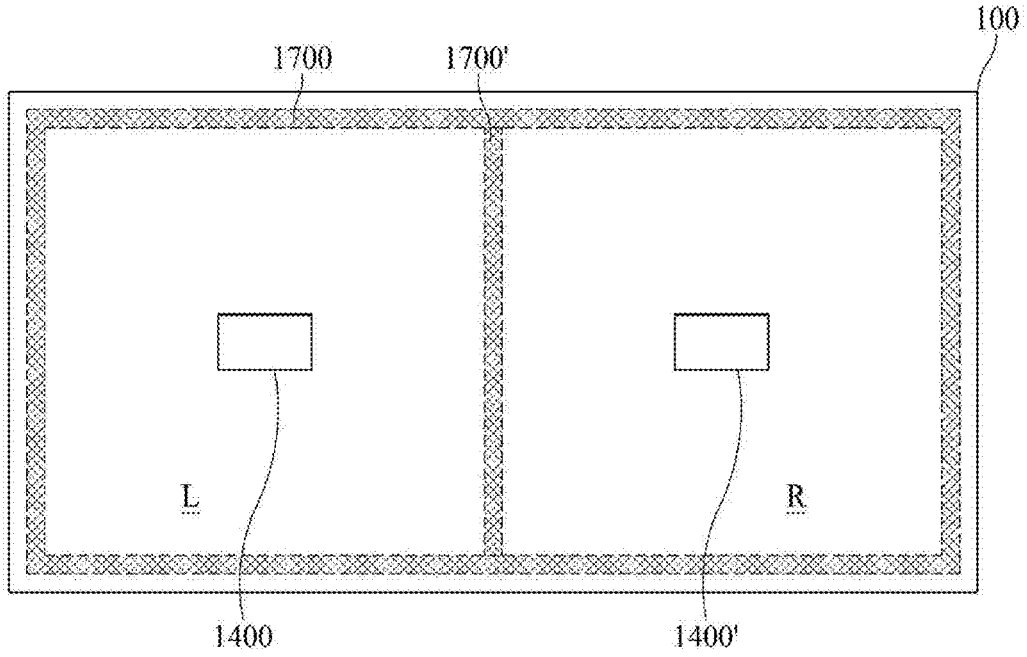
FIGS. 9A to 9C illustrate examples of a sound-generating module and a partition in a display apparatus according to an example embodiment of the present disclosure.
Figure 9B:
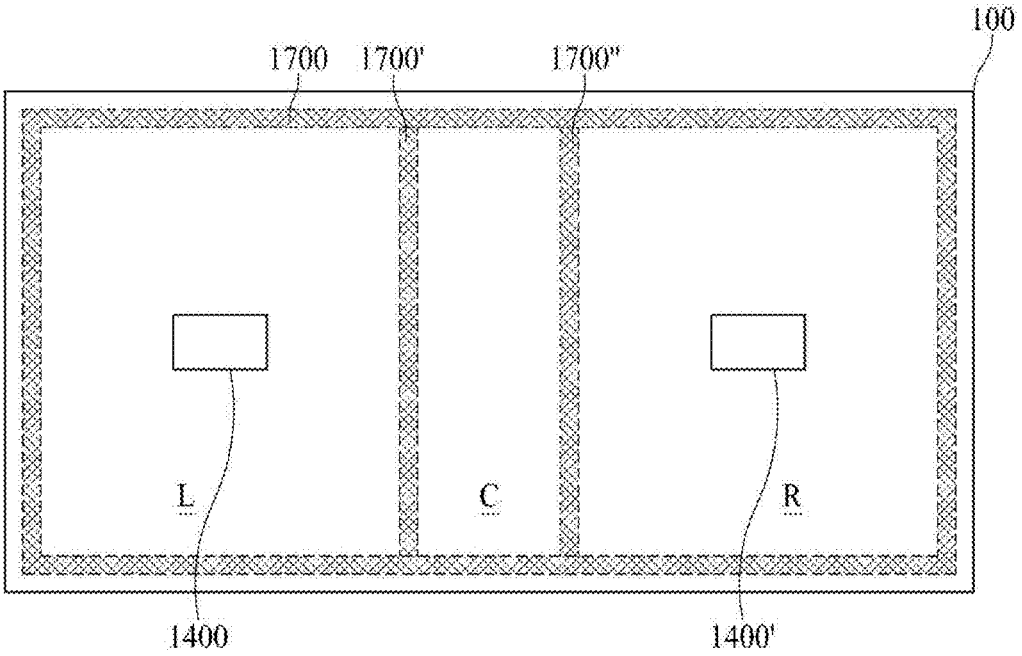
Figure 9C:
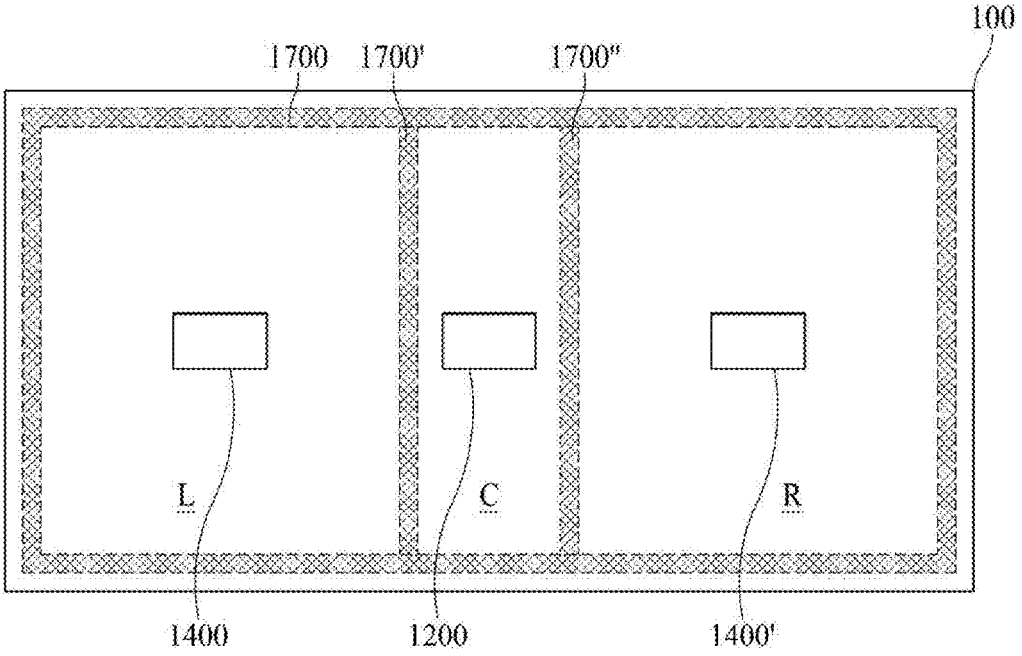

FIGS. 9A to 9C illustrate examples of a sound-generating module and a partition in a display apparatus according to an example embodiment of the present disclosure.

The first partition 1700, the second partition 1700', and the third partition 1700" described with reference to the examples of FIGS. 8A to 8C may be substantially similar to the examples of FIGS. 9A to 9C. Therefore, a detailed description may be omitted.

With reference to the examples of FIGS. 9A to 9C, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 9A and 9B, a 2-1$^{st}$ sound-generating module 1400 and a 2-2$^{nd}$ sound-generating module 1400' may be respectively at the first area L and the second area R. For example, the 2-1$^{st}$ sound-generating module 1400 may be at the first area L of the rear surface of the display panel 100, and the 2-2$^{nd}$ sound-generating module 1400' may be at the second area R of the rear surface of the display panel 100. Because the 2-1$^{st}$ sound-generating module 1400 and the 2-2$^{nd}$ sound-generating module 1400' are the sound-generating modules described with reference to the FIG. 6 example, its detailed description will be omitted.

With reference to the example of FIG. 9C, the 2-1$^{st}$ sound-generating module 1400 and the 2-2$^{nd}$ sound-generating module 1400' may be respectively at the first area L and the second area R. The first sound-generating module 1200 may be at the third area C. Because the first sound-generating module 1200 is the sound-generating module described with reference to the FIG. 4 example, its detailed description will be omitted.

With reference to the examples of FIGS. 9A to 9C, a first partition 1700 may be at the periphery of the rear surface of the display panel 100. The first partition 1700 may be at the periphery of the supporting member or the periphery of an upper surface of the supporting member. Also, the first partition 1700 may be between the display panel and the supporting member. For example, the first partition 1700 may be between the rear surface of the display panel and the upper surface of the supporting member. The first partition 1700 may be an entire area of four sides outside the rear surface of the display panel 100. The first partition 1700 may be disposed along a shape of the display panel 100. For example, the first partition 1700 may have a rectangular shape, and may be changed in accordance with the shape of the display panel, without limitation to the rectangular shape.

With reference to the example of FIG. 9A, a second partition 1700' may be between the 2-1$^{st}$ sound-generating module 1400 and the 2-2$^{nd}$ sound-generating module 1400'. For example, the second partition 1700' may be between the first area L and the second area R.

With reference to the examples of FIGS. 9B and 9C, at least two partitions, e.g., a second partition 1700' and a third partition 1700", may be between the 2-1$^{st}$ sound-generating module 1400 and the 2-2$^{nd}$ sound-generating module 1400'. For example, the second partition 1700' may be between the first area L and the third area C, and the third partition 1700" may be between the second area R and the third area C.

The first partition 1700, the second partition 1700', and the third partition 1700" may be on the rear surface of the display panel 100. The first partition 1700, the second partition 1700', and the third partition 1700" may be between the display panel and the supporting member. The first partition 1700, the second partition 1700', and the third partition 1700" may be on the rear surface or the upper surface of the supporting member.

The first partition 1700, the second partition 1700', and the third partition 1700" may be one of a double-sided tape, a single-sided tape, an adhesive, and/or a bond, but embodiments are not limited thereto.

With reference to the example of FIG. 9A, the 2-1$^{st}$ sound-generating module 1400 may be at the first area L corresponding to the left area and the 2-2$^{nd}$ sound-generating module 1400' may be at the second area R corresponding to the right area. When left and right sounds are split by the second partition 1700', degradation of sound quality, caused by interference at the first area L and the second area R, may be reduced. Therefore, the 2-1$^{st}$ sound-generating module 1400 and the 2-2$^{nd}$ sound-generating module 1400' may output sounds of different low-, middle-, and high-pitched sound bands in which a sound of a low-pitched sound band or sounds of low- and middle-pitched sound bands may be improved.

With reference to the example of FIG. 9B, the 2-1$^{st}$ sound-generating module 1400 may be at the first area L corresponding to the left area and the 2-2$^{nd}$ sound-generating module 1400' may be at the second area R corresponding to the right area. No sound-generating module may be at the third area C corresponding to the center area. For this reason, degradation of sound quality, caused by interference at the left area and the right area, may be reduced. Therefore, sound property of the low-pitched sound band may be more improved. The third area C may have an area smaller than those of the first area L and the second area R. In this case, the sound of the low-pitched sound band may be improved. The third area C may reduce degradation of sound quality due to interference at the first area L and the second area R. Therefore, the sounds of the low-, middle-, and high-pitched sound bands in which sound of the low-pitched sound band is improved may be output, and stereo sounds may be output.

With reference to the example of FIG. 9C, the 2-1$^{st}$ sound-generating module 1400 may be at the first area L corresponding to the left area, the 2-2$^{nd}$ sound-generating module 1400' may be at the second area R corresponding to the right area, and the first sound-generating module 1200 may be at the third area C corresponding to the center area. The first sound-generating module 1200 may output sounds of low-, middle-, and high-pitched sound bands in which sound of middle- and high-pitched sound bands may be improved. Therefore, the sounds of low-, middle-, and high-pitched sound bands may be improved, in which a sound of a low-pitched sound band or sounds of middle- and high-pitched sound bands may be improved. Therefore, the display apparatus, which may output stereo sounds and has 2.1 channel type sound output property, may be provided.

Figure 10A:
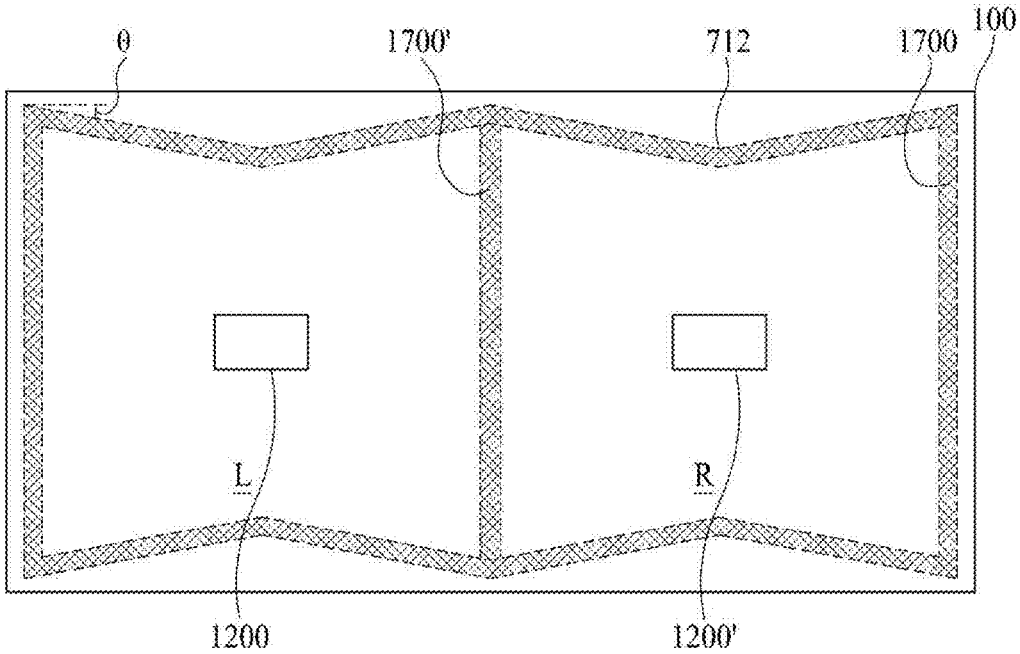
FIGS. 10A to 10C illustrate examples of a sound-generating module and a partition in a display apparatus according to an example embodiment of the present disclosure.
Figure 10B:
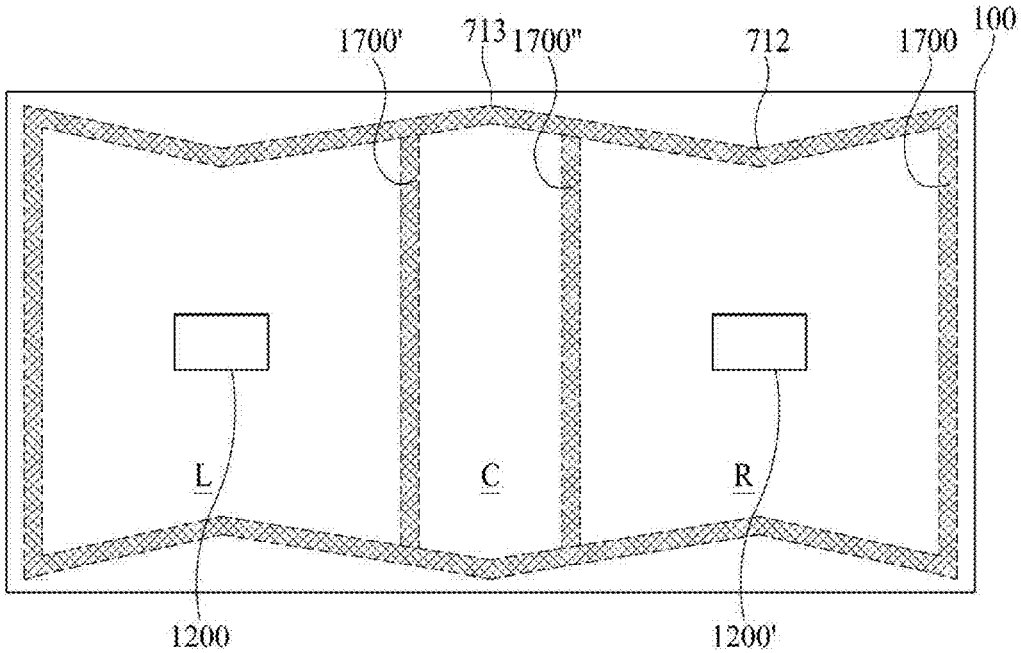
Figure 10C:
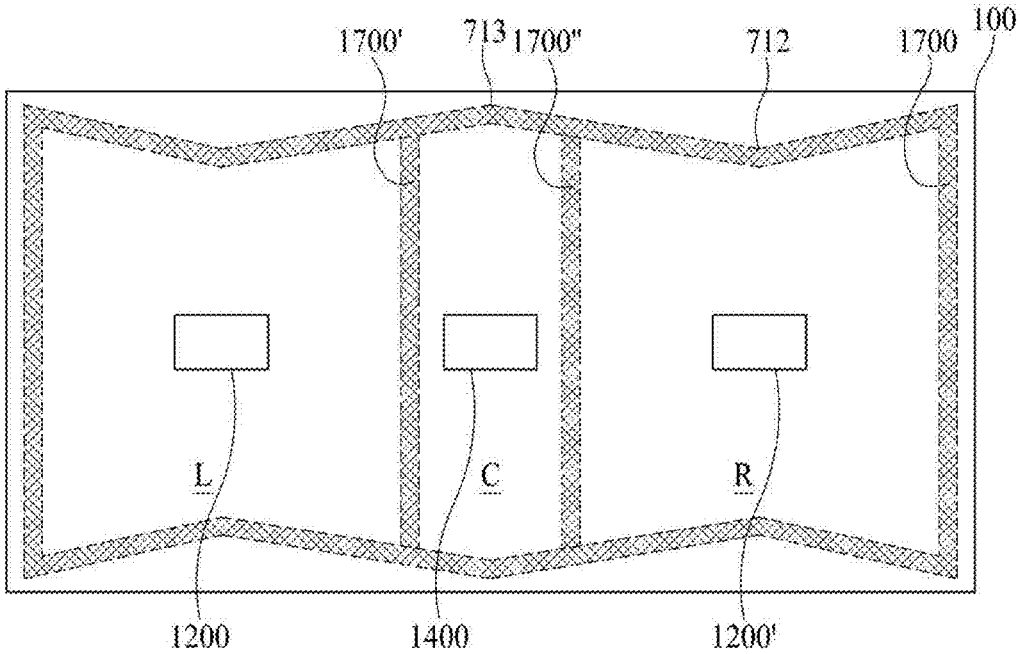

FIGS. 10A to 10C illustrate examples of a sound-generating module and a partition in a display apparatus according to an example embodiment of the present disclosure.

The first partition 1700, the second partition 1700', and the third partition 1700" described with reference to the FIGS. 8A to 8C examples may be substantially similarly applied to the examples of FIGS. 10A to 10C. Therefore, detailed description may be omitted.

With reference to the examples of FIGS. 10A to 10C, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100. With reference to the examples of FIGS. 10A to 10C, a bent portion 712 may be on at least one side of the first partition 1700.

Sound waves generated by vibrating the display panel 100 through the use of sound-generating modules 1200 and 1200' may radially progress from the center of the sound-generating modules 1200 and 1200'. These sound waves may be referred to as a "progressive wave." If the progressive wave is reflected on one side of the partition 1700, and progresses to an opposite direction, it is referred to as a "reflected wave." If this reflected wave overlaps and interferes with the progressive wave, it does not progress, and it is in a standing state, which is referred to as a "standing wave." The standing wave causes the reduction of sound pressure, which may deteriorate the sound output characteristics. Thus, to avoid or prevent the reduction of sound pressure by the standing wave generated due to the interference between the reflected wave and the progressive wave, a bent portion may be formed in the partition. The standing wave causing the reduction of sound pressure level may be generated at a point having the large progressive wave and the large reflected wave.

Therefore, the bent portion 712 may be at a point having the largest sound wave approaching from the sound-generating module. According to an example embodiment of the present disclosure, the bent portion 712 may be bent toward the sound-generating modules 1200 and 1200'.

The bent portion 712 may be in at least one side, where the largest sound wave may approach, among four sides of the first partition 1700. The bent portion 712 may face or extend toward the sound-generating modules 1200 and 1200'. For example, the bent portion 712 may face or extend toward the center of the 1-1$^{st}$ sound-generating module 1200 and the center of the 1-2$^{nd}$ sound-generating module 1200', so that it may be possible to avoid or prevent the reduction of sound pressure level by the standing wave. Therefore, at least one bent portion 712 may be on at least one side of the first partition 1700, and may face or extend toward the 1-1$^{st}$ sound-generating module 1200 and the 1-2$^{nd}$ sound-generating module 1200'.

The rear surface of the display panel 100 may include four sides, and the bent portion 712 may be on at least one first side among the four sides. Thus, the bent portion 712 may be formed in such a way that the two sides corresponding to the lower and upper sides of the four sides may have a particular inclined angle with respect to a horizontal direction (or lengthwise direction, landscape direction, or transverse direction) of the display panel 100. The bent portion 712 may be provided as two straight-line portions, and the bent portion 712 may be formed at a point where the two straight-line portions meet together. The bent portion 712 may be formed in a straight-line shape, a curved-line shape, or a round shape, but embodiments are not limited to these example shapes.

The inclined angle (θ) of the bent portion 712 may be changed based on a requirement for restriction of standing wave, and the inclined angle (θ) of the bent portion 712 may be set within a range, e.g., from 10° to 30°. For example, in an example of the sound output range for the low-pitched sound band or the large output of the sound-generating module, the inclined angle (θ) of the bent portion 712 may become large. In an example of the sound output range for the high-pitched sound band or the small output of the sound-generating module, the inclined angle (θ) of the bent portion 712 may become small. In one example, the inclined angle (θ) of the bent portion 712 may be the angle obtained by one side of the first partition 1700 with respect to a horizontal direction (or length direction) of the display panel 100. As used herein, the horizontal direction or transverse direction corresponds to the direction of the long side of the display apparatus, and the vertical direction or longitudinal direction corresponds to the direction of the short side of the display apparatus.

With reference to the examples of FIGS. 10B and 10C, a second bent portion 713 may be between the second partition 1700' and the third partition 1700". A shape of the second bent portion 713 may be the same as that of the bent portion 712, but embodiments are not limited thereto. For example, the second bent portion 713 may face or extend outwardly, or may extend toward a direction different from that of the bent portion 712. The second bent portion 713 may not be provided, or may be between the second partition 1700' and the third partition 1700" in a straight-line shape. The bent portion 712 and the second bent portion 713 may have a sealed structure or a non-sealed structure.

With reference to the example of FIG. 10A, the 1-1$^{st}$ sound-generating module 1200 and the 1-2$^{nd}$ sound-generating module 1200' may be respectively at the first area L and the second area R. For example, the 1-1$^{st}$ sound-generating module 1200 may be at the first area L on the rear surface of the display panel 100, and the 1-2$^{nd}$ sound-generating module 1200' may be at the second area R on the rear surface of the display panel 100. When left and right sounds are by the second partition 1700', degradation of sound quality, caused by interference at the first area L and the second area R, may be reduced. Therefore, the 1-1$^{st}$ sound-generating module 1200 and the 1-2$^{nd}$ sound-generating module 1200' may output sounds of different low, middle and high sound bands in which a sound of a low-pitched sound band may be improved. Because the bent portion 712 may reduce the reduction of sound pressure level caused by the standing wave, a display apparatus may be provided in which sound of the low-pitched sound band may be further improved, and sounds of different low-, middle-, and high-pitched sound bands may be further improved.

With reference to the example of FIG. 10B, the 1-1$^{st}$ sound-generating module 1200 may be at the first area L corresponding to the left area and the 1-2$^{nd}$ sound-generating module 1200' may be at the second area R corresponding to the right area. No sound-generating module may be at the third area C corresponding to the center area. As such, degradation of sound quality, caused by interference at the left area and the right area, may be reduced. Also, sound characteristics of the low-, middle-, and high-pitched sound bands may be further improved. The size, e.g., area, of the third area C may be relatively smaller than those of the first area L and the second area R. In this case, the sound of the low-pitched sound band may be improved. For example, the third area C may enable a reduction of deterioration of sound quality caused by the interference of the first area L and the second area R. Therefore, the sounds of the low-, middle-, and high-pitched sound bands, in which sound of the low-pitched sound band may be improved, may be output. Because the bent portion 712 may reduce the reduction of sound pressure level caused by the standing wave, a display apparatus may be provided in which sound of the low-pitched sound band may be further improved, and sounds of low-, middle-, and high-pitched sound bands may be further improved.

With reference to the example of FIG. 10C, the 1-1$^{st}$ sound-generating module 1200 and the 1-2$^{nd}$ sound-generating module 1200' may be respectively at the first area L and the second area R. The second sound-generating module 1400 is at the third area C. The second sound-generating module 1400 may improve a sound of a low-pitched sound band or sounds of low- and middle-pitched sound bands. For example, the second sound-generating module 1400 may be a woofer speaker. Because the bent portion 712 may reduce the reduction of sound pressure level caused by the standing wave, a display apparatus may be provided in which sound of the low-pitched sound band may be further improved, and sounds of low-, middle-, and high-pitched sound bands may be further improved.

Figure 11A:
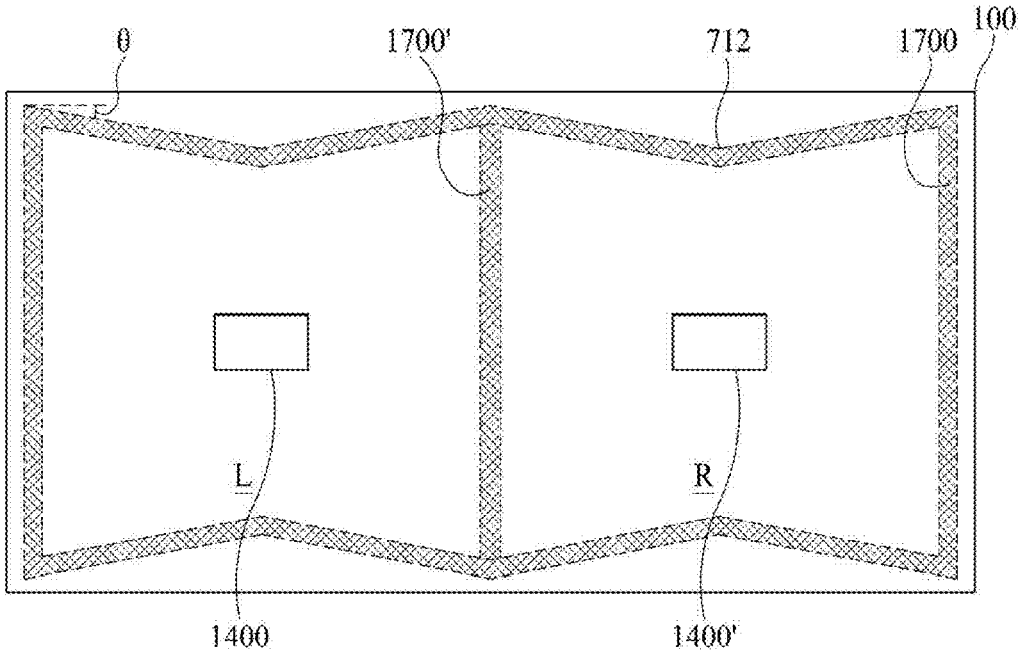
FIGS. 11A to 11C illustrate examples of a sound-generating module and a partition in a display apparatus according to an example embodiment of the present disclosure.
Figure 11B:
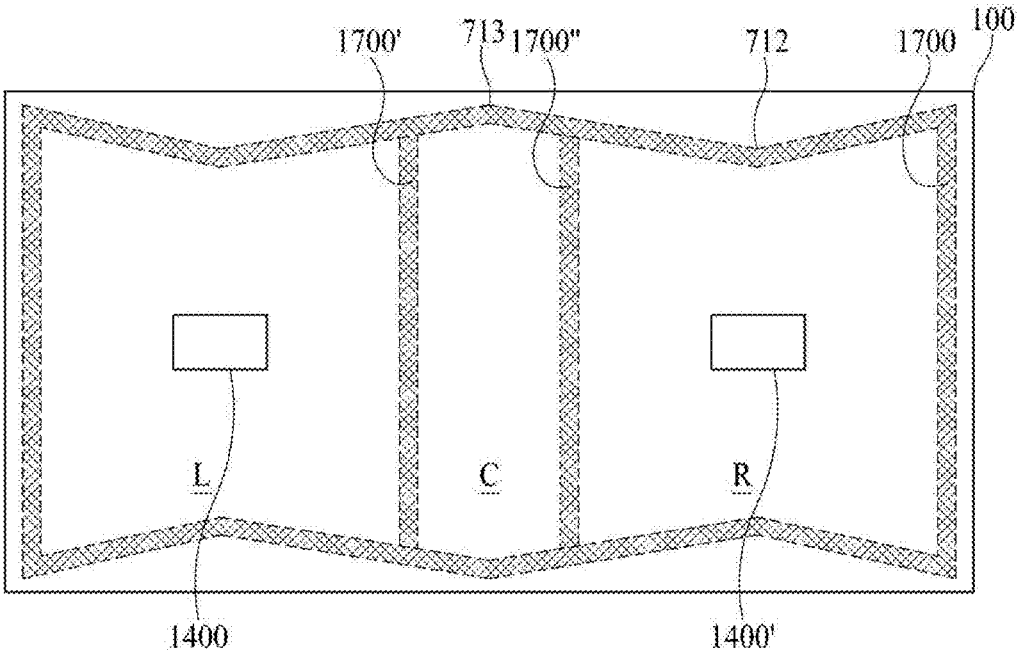
Figure 11C:
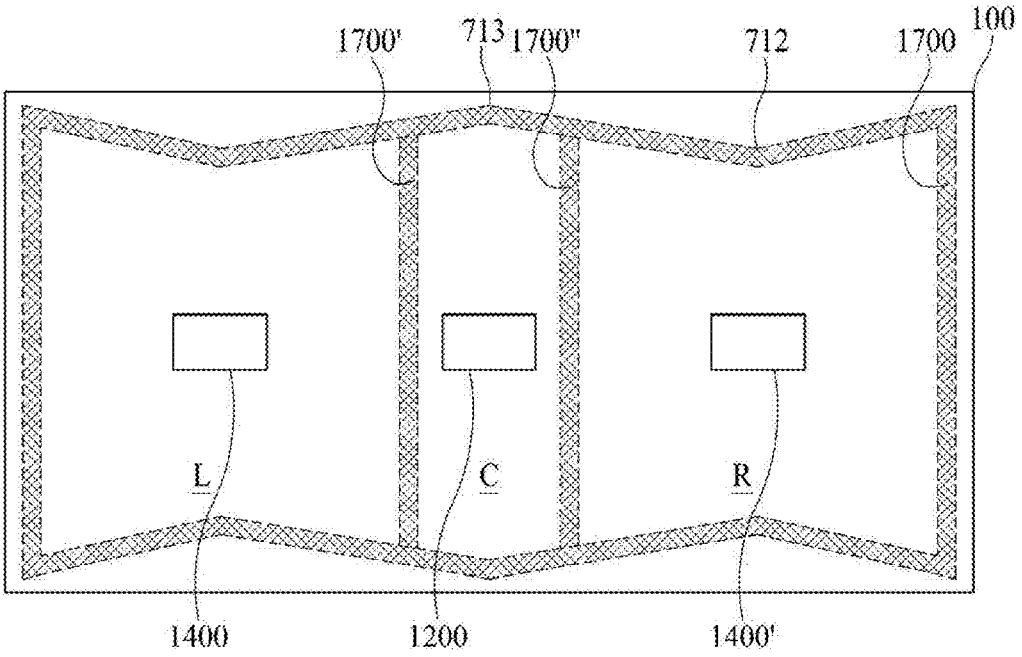

FIGS. 11A to 11C illustrate examples of a sound-generating module and a partition in a display apparatus of the present disclosure.

The first partition 1700, the second partition 1700', and the third partition 1700" described with reference to the examples of FIGS. 9A to 9C may be substantially similar to the examples of FIGS. 11A to 11C. Therefore, a duplicate description may be omitted.

With reference to the examples of FIGS. 11A to 11C, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 11A and 11B, a 2-1$^{st}$ sound-generating module 1400 and a 2-2$^{nd}$ sound-generating module 1400' may be respectively at the first area L and the second area R. For example, the 2-1$^{st}$ sound-generating module 1400 may be at the first area L of the rear surface of the display panel 100, and the 2-2$^{nd}$ sound-generating module 1400' may be at the second area R of the rear surface of the display panel 100.

With reference to the example of FIG. 11C, the 2-1$^{st}$ sound-generating module 1400 and the 2-2$^{nd}$ sound-generating module 1400' may be respectively at the first area L and the second area R. The first sound-generating module 1200 may be at the third area C.

With reference to the examples of FIGS. 11A to 11C, a bent portion 712 may be on at least one side of the first partition 1700. The bent portion 712 may be in at least one side, where the largest sound wave may approach, among four sides of the first partition 1700. The bent portion 712 may face or extend toward the sound-generating modules 1400 and 1400'. For example, the bent portion 712 may face or extend toward the center of the 2-1$^{st}$ sound-generating module 1400 and the center of the 2-2$^{nd}$ sound-generating module 1400', so that it may be possible to avoid or prevent the reduction of sound pressure level by the standing wave. Therefore, at least one bent portion 712 may be on at least one side of the first partition 1700 and may face or extend toward the 2-1$^{st}$ sound-generating module 1400 and the 2-2$^{nd}$ sound-generating module 1400'.

The rear surface of the display panel 100 may include four sides, and the bent portion 712 may be on at least one first side among the four sides. Thus, the bent portion 712 may be formed in such a way that the two sides corresponding to the lower and upper sides of the four sides may have a particular inclined angle with respect to a horizontal direction (or lengthwise direction, landscape direction, or transverse direction) of the display panel 100. The bent portion 712 may be provided as two straight-line portions, and the bent portion 712 may be formed at the point where the two straight-line portions meet together. The bent portion 712 may be formed in a straight-line shape, a curved-line shape, or a round shape, but embodiments are not limited to these example shapes.

The inclined angle (θ) of the bent portion 712 may be changed based on a requirement for restriction of standing wave, and the inclined angle (θ) of the bent portion 712 may be set within a range, e.g., from 10° to 30°. For example, in an example of the sound output range for the low-pitched sound range or the large output of the sound-generating module, the inclined angle (θ) of the bent portion 712 may become large. In an example of the sound output range for the high-pitched sound range or the small output of the sound-generating module, the inclined angle (θ) of the bent portion 712 may become small. In one example, the inclined angle (θ) of the bent portion 712 may be the angle obtained by one side of the first partition 1700 with respect to a horizontal direction (or length direction) of the display panel 100. As used herein, the horizontal direction or transverse direction corresponds to the direction of the long side of the display apparatus, and the vertical direction or longitudinal direction corresponds to the direction of the short side of the display apparatus.

With reference to the examples of FIGS. 11B and 11C, a second bent portion 713 may be between the second partition 1700' and the third partition 1700". A shape of the second bent portion 713 may be the same as that of the bent portion 712, but embodiments are not limited thereto. For example, the second bent portion 713 may face or extend toward a direction different from that of the bent portion 712. The second bent portion 713 may not be provided, or may have a straight-line shape. The bent portion 712 and the second bent portion 713 may have a sealed structure or a non-sealed structure.

With reference to the example of FIG. 11A, the 2-1$^{st}$ sound-generating module 1400 may be at the first area L corresponding the left area, and the 2-2$^{nd}$ sound-generating module 1400' may be at the second area R corresponding to the right area. When left and right sounds are separated by the second partition 1700', degradation of sound quality, caused by interference at the first area L and the second area R, may be reduced. Therefore, the 2-1$^{st}$ sound-generating module 1400 and the 2-2$^{nd}$ sound-generating module 1400' may output sounds of different low-, middle-, and high-pitched sound bands in which a sound of a low-pitched sound band or a low- and middle-pitched sound bands may be improved. Because the bent portion 712 may reduce the reduction of sound pressure level caused by the standing wave, a display apparatus may be provided in which sound of the low-pitched sound band or the low- and middle-pitched sound bands may be further improved, and sounds of different low-, middle-, and high-pitched sound bands may be further improved.

With reference to the example of FIG. 11B, the 2-1$^{st}$ sound-generating module 1400 may be at the first area L corresponding to the left area, and the 1-2$^{nd}$ sound-generating module 1200' may be at the second area R corresponding to the right area. No sound-generating module may be at the third area C corresponding to the center area. As such, degradation of sound quality, caused by interference at the left area and the right area, may be reduced. Also, sound characteristics of the low-pitched sound band may be further improved. The size, e.g., area, of the third area C may be relatively smaller than those of the first area L and the second area R. In this case, the sound of the low-pitched sound band may be improved. For example, the third area C may enable a reduction of deterioration of sound quality caused by the interference of the first area L and the second area R. Therefore, the sounds of the low-, middle-, and high-pitched sound bands, in which sound of the low-pitched sound band may be improved, may be output. Because the bent portion 712 may reduce the reduction of sound pressure level caused by the standing wave, a display apparatus may be provided in which sound of the low-pitched sound band may be further improved, and the sounds of low-middle-high sound bands may be further improved.

With reference to the example of FIG. 11C, the 2-1$^{st}$ sound-generating module 1400 may be at the first area L corresponding to the left area, and the 2-2$^{nd}$ sound-generating module 1400' may be at the second area R corresponding to the right area. The first sound-generating module 1200 may be at the third area C corresponding to the center area. The first sound-generating module 1200 may output sounds of low-, middle-, and high-pitched sound bands in which a sound of a low-pitched sound band or sounds of middle-high-pitched sound bands may be improved. Because the bent portion 712 may reduce the reduction of sound pressure level caused by the standing wave, a display apparatus may be provided in which sound of the low-pitched sound band and middle- and high-pitched sound bands may be further improved, and sounds of low-, middle-, and high-pitched sound bands may be further improved.

FIGS. 12A to 12J illustrate examples of a sound-generating module and a partition in a display apparatus according to an example embodiment of the present disclosure.

The first partition 1700, the second partition 1700', and the third partition 1700" described with reference to the examples of FIGS. 8A to 8C may be substantially similar to the examples of FIGS. 12A to 12J. Therefore, a duplicate description may be omitted.

With reference to the examples of FIGS. 12A to 12I, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 12A, 12B, 12D, 12E, 12GG, and 12I, a 1-1$^{st}$ sound-generating module 1200 and a 1-2$^{nd}$ sound-generating module 1200' may be respectively at the first area L and the second area R. For example, the 1-1$^{st}$ sound-generating module 1200 may be at the first area L of the rear surface of the display panel 100, and the 1-2$^{nd}$ sound-generating module 1200' may be at the second area R of the rear surface of the display panel 100.

With reference to the examples of FIGS. 12C, 12F, 12H, and 12J, the 1-1$^{st}$ sound-generating module 1200 and the 1-2$^{nd}$ sound-generating module 1200' may be respectively at the first area L and the second area R. The second sound-generating module 1400 may be at the third area C.

With reference to the examples of FIGS. 12A to 12J, a pad portion may be on at least one side of the first partition 1700 to reduce a reduction of sound pressure level caused by standing wave generated in a vertical direction of the sound-generating modules 1200 and 1200'. For example, the first partition 1700 may include a first side, and a second side vertical to the first side, and the pad portion may be on the second side. At least one or more pad portions may be provided. The first side may be a horizontal direction of the display panel 100, and the second side may be a vertical direction of the display panel 100. Therefore, at least one pad portion may be on the second side vertical to the first side of the first partition 1700, or may be on the second side of the first partition and at least one side of the second partition or the third partition.

Figure 12A:
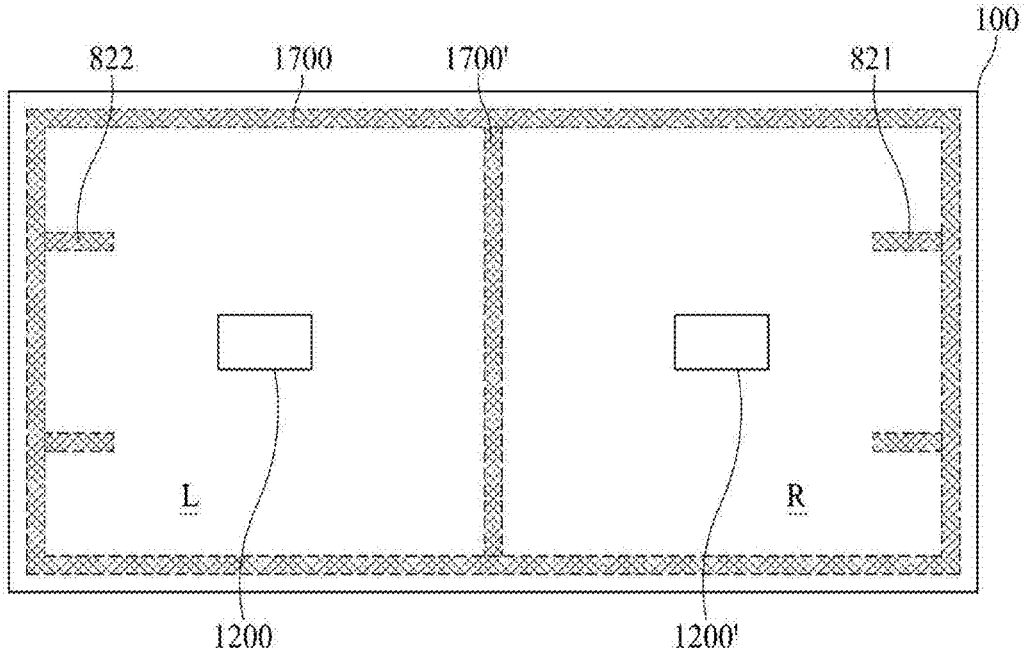
FIGS. 12A to 12J illustrate examples of a sound-generating module and a partition in a display apparatus according to an example embodiment of the present disclosure.
Figure 12B:
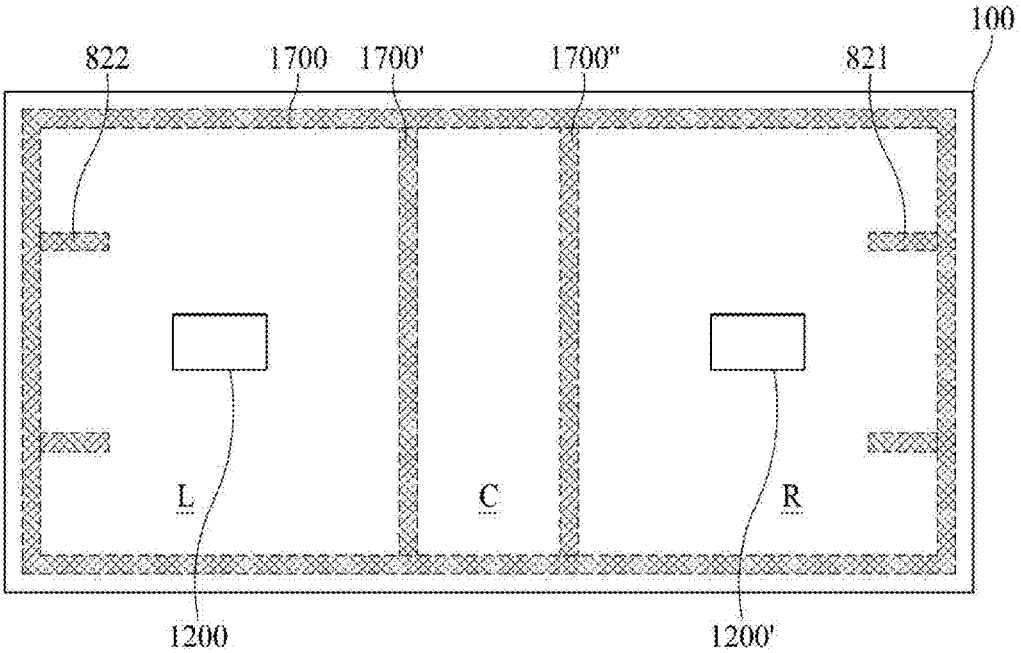
Figure 12C:
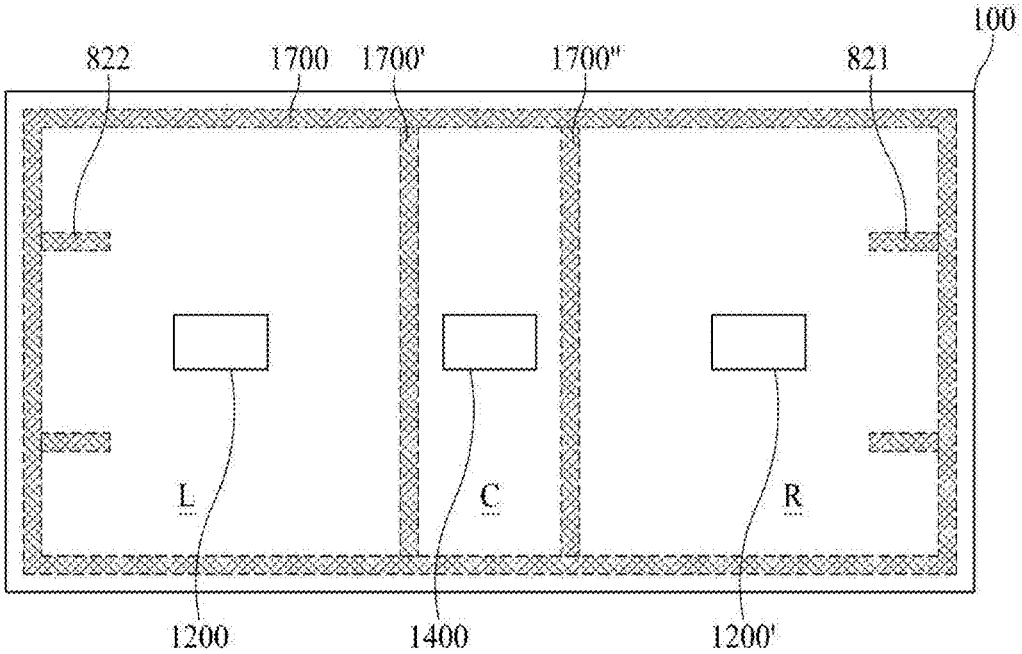

With reference to the examples of FIGS. 12A, 12B, and 12C, a pad portion 821 may be on the first side of the first partition 1700. The second pad portion 822 may be on the second side of the first partition 1700. For example, the pad portion 821 may face or extend toward the 1-2$^{nd}$ sound-generating module 1200', and the second pad portion 822 may face or extend toward the 1-1$^{st}$ sound-generating module 1200. The pad portion 821 may be at the second area R, and the second pad portion 822 may be at the first area L. At least one pad portion 821 and at least one second pad portion 822 may be on one or more sides of the first partition 1700. The pad portion 821 and the second pad portion 822 may be disposed symmetrically with respect to the sound-generating module. Therefore, the pad portion 821 and the second pad portion 822 may reduce a reduction of sound pressure level caused by the standing wave generated in a vertical direction of the sound-generating modules 1200 and 1200', and vibration may be transferred to both sides, whereby sound output characteristics may be improved.

In the example of FIGS. 12A to 12J, one or more pad portions 821 and one or more second pad portions 822 may be on the second side vertical to the first side of the four sides of the display panel 100. Two or more pad portions 821 and second pad portions 822 may be provided, without limitation to the examples of FIGS. 12A to 12J.

With reference to the example of FIG. 12A, the 1-1$^{st}$ sound-generating module 1200 and the 1-2$^{nd}$ sound-generating module 1200' may be respectively at the first area L and the second area R. For example, the 1-1$^{st}$ sound-generating module 1200 may be at the first area L on the rear surface of the display panel 100, and the 1-2$^{nd}$ sound-generating module 1200' may be at the second area R on the rear surface of the display panel 100. Because left and right sounds may be split by the second partition 1700', the 1-1$^{st}$ sound-generating module 1200 and the 1-2$^{nd}$ sound-generating module 1200' may output sounds of different low-, middle-, and high-pitched sound bands in which a sound of a low-pitched sound band may be improved. Because the pad portion 821 and the second pad portion 822 may reduce the reduction of sound pressure level caused by the standing wave, a display apparatus may be provided in which sound of the low-pitched sound band may be further improved, and the sound of different low-, middle-, and high-pitched sound bands may be further improved.

With reference to the example of FIG. 12B, the 1-1$^{st}$ sound-generating module 1200 may be at the first area L corresponding to the left area and the 1-2$^{nd}$ sound-generating module 1200' may be at the second area R corresponding to the right area. A sound-generating module may not be at the third area C corresponding to the center area. Therefore, sounds of low-, middle-, and high-pitched sound bands, in which sound of the low-pitched sound band may be improved, may be output. The pad portion 821 and the second pad portion 822 may reduce the reduction of sound pressure level caused by the standing wave. Therefore, the sound of the low-pitched sound band may be further improved, and the sounds of low-, middle-, and high-pitched sound bands may be further improved.

With reference to the example of FIG. 12C, the 1-1$^{st}$ sound-generating module 1200 may be at the first area L corresponding to the left area, and the 1-2$^{nd}$ sound-generating module 1200' may be at the second area R corresponding to the right area. The second sound-generating module 1400 may be at the third area C corresponding to the center area. For example, the second sound-generating module 1400 may be a woofer speaker. The second sound-generating module 1400 may improve a sound of a low-pitched sound band or sounds of low- and middle-pitched sound bands. Therefore, the sounds of low-, middle-, and high-pitched sound bands may be output, in which sound of the low-pitched sound band or the sounds of the low- and middle-pitched sound bands may be improved. The pad portion 821 and the second pad portion 822 may reduce the reduction of sound pressure level caused by the standing wave. Therefore, a display apparatus may be provided in which sound of the low-pitched sound band or the low- and middle-pitched sound bands may be further improved, and sounds of low-, middle-, and high-pitched sound bands may be further improved.

Figure 12D:
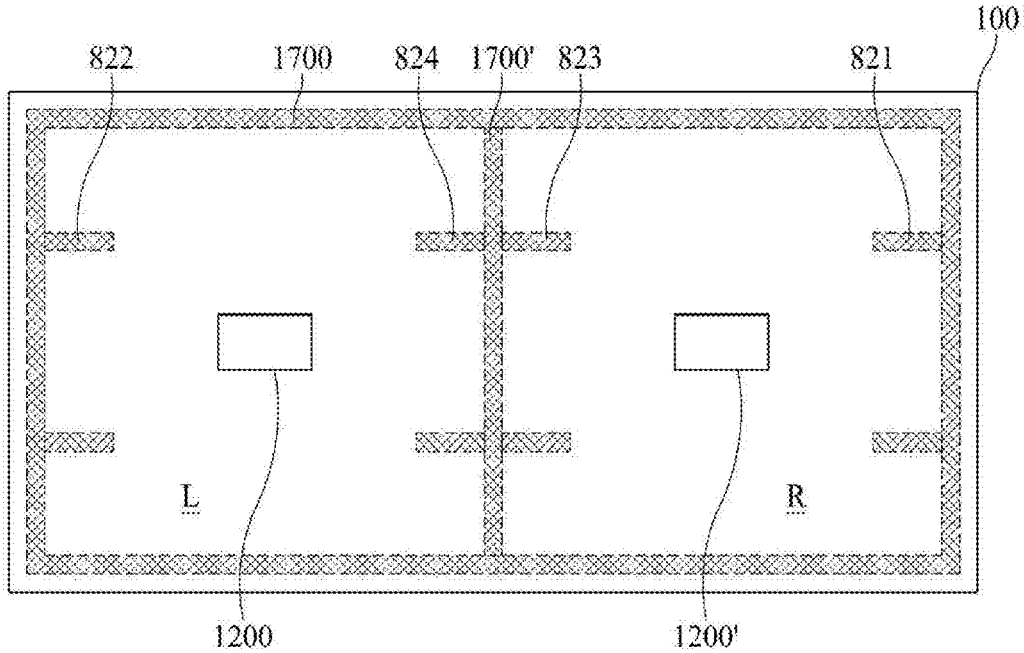

With reference to the example of FIG. 12D, a third pad portion 823 may be on a side facing the second side of the first partition 1700. At least one or more third pad portions 823 may be provided. A fourth pad portion 824 may be on a side facing the second side of the first partition 1700. At least one or more fourth pad portions 824 may be provided. For example, the third pad portion 823 may face or extend toward the 1-2$^{nd}$-sound-generating module 1200', and the fourth pad portion 824 may face or extend toward the 1-1$^{st}$ sound-generating module 1200. The third pad portion 823 may be at the second area R, and the fourth pad portion 824 may be at the first area L. For example, the third pad portion 823 may face the pad portion 821, and the fourth pad portion 824 may face the second pad portion 822. The third and fourth pad portions 823 and 824 may be disposed symmetrically with respect to the second partition 1700'. Because the third pad portion 823 and the fourth pad portion 824 may be capable of trapping the reflected wave from the sound-generating modules 1200 and 1200', the reduction of sound pressure level caused by the standing wave may decrease. Therefore, a display apparatus may be provided in which sound of the low-pitched sound band may be further improved, and sounds of different middle- and high-pitched sound bands may be further improved.

Figure 12E:
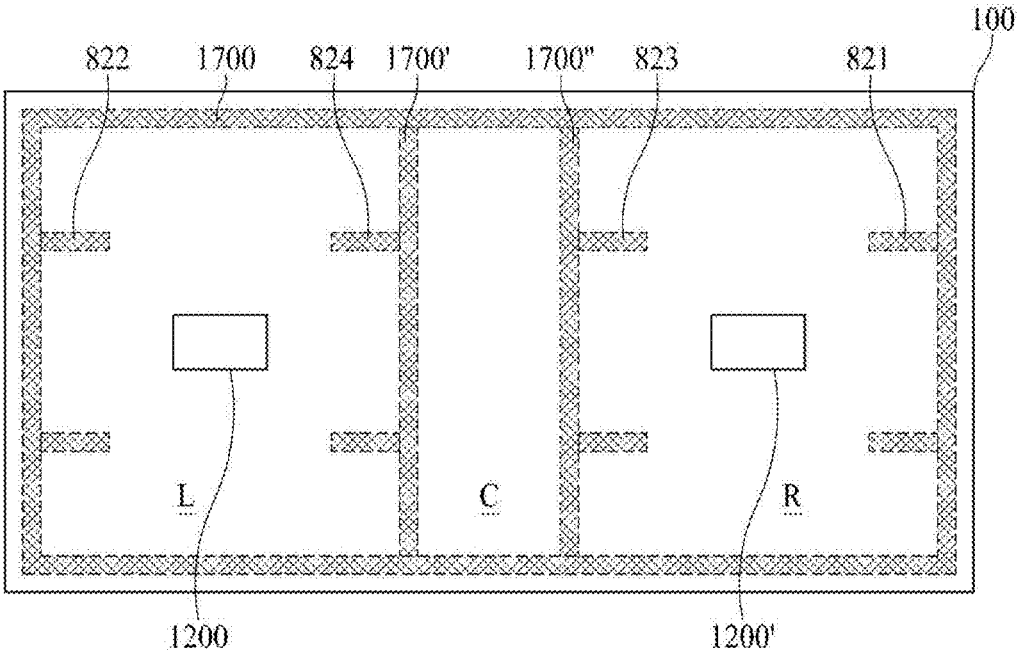

With reference to the example of FIG. 12E, the pad portion 821 may be on the second side of the first partition 1700. The second pad portion 822 may be on the second side of the first partition 1700. For example, the pad portion 821 may face or extend toward the 1-2$^{nd}$ sound-generating module 1200', and the second pad portion 822 may face or extend toward the 1-1$^{st}$ sound-generating module 1200. The pad portion 821 may be at the second area R, and the second pad portion 822 may be at the first area L.

The third pad portion 823 may be on the side facing the second side of the first partition 1700. At least one or more third pad portions 823 may be provided. The fourth pad portion 824 may be on the side facing the second side of the first partition 1700. At least one or more fourth pad portions 824 may be provided. For example, the third pad portion 823 may face or extend toward the 1-2$^{nd}$ sound-generating module 1200', and the fourth pad portion 824 may face or extend toward the 1-1$^{st}$ sound-generating module 1200. The third pad portion 823 may be at the second area R, and the fourth pad portion 824 may be at the first area L. For example, the third pad portion 823 may face the pad portion 821, and the fourth pad portion 824 may face the second pad portion 822. The third pad portion 823 may be on the second side of the third partition 1700", and may face or extend toward the 1-2$^{nd}$ sound-generating module 1200'. The fourth pad portion 824 may be on the second side of the second partition 1700', and may face or extend toward the 1-1$^{st}$ sound-generating module 1200. Therefore, because the pad portion 821, the second pad portion 822, the third pad portion 823 and the fourth pad portion 824 may reduce the reduction of sound pressure level caused by the standing wave generated in a vertical direction of the sound-generating modules 1200 and 1200,' and vibration may be transferred to both sides, sound output characteristics may be improved. Therefore, a display apparatus may be provided in which sound of the low-pitched sound band may be further improved, and sounds of low-, middle-, and high-pitched sound bands may be further improved.

Figure 12F:
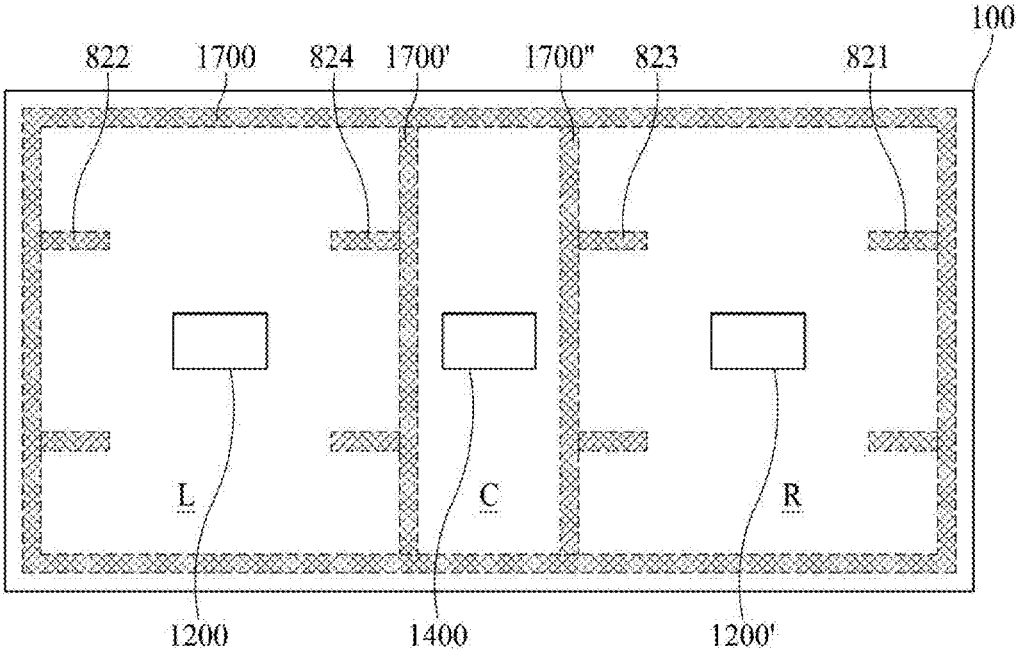

With reference to the example of FIG. 12F, duplicate description of the pad portion to the fourth pad portion described with reference to the example of FIG. 12E will be omitted. The second sound-generating module 1400 may be at the third area C of the display panel 100. For example, the second sound-generating module 1400 may be a woofer speaker. The pad portion may be disposed to reduce the reduction of sound pressure level caused by the standing wave. Therefore, a display apparatus may be provided in which sound of the low-pitched sound band or low- and middle-pitched sound bands may be further improved, and sounds of low-, middle-, and high-pitched sound bands may be further improved.

Figure 12G:
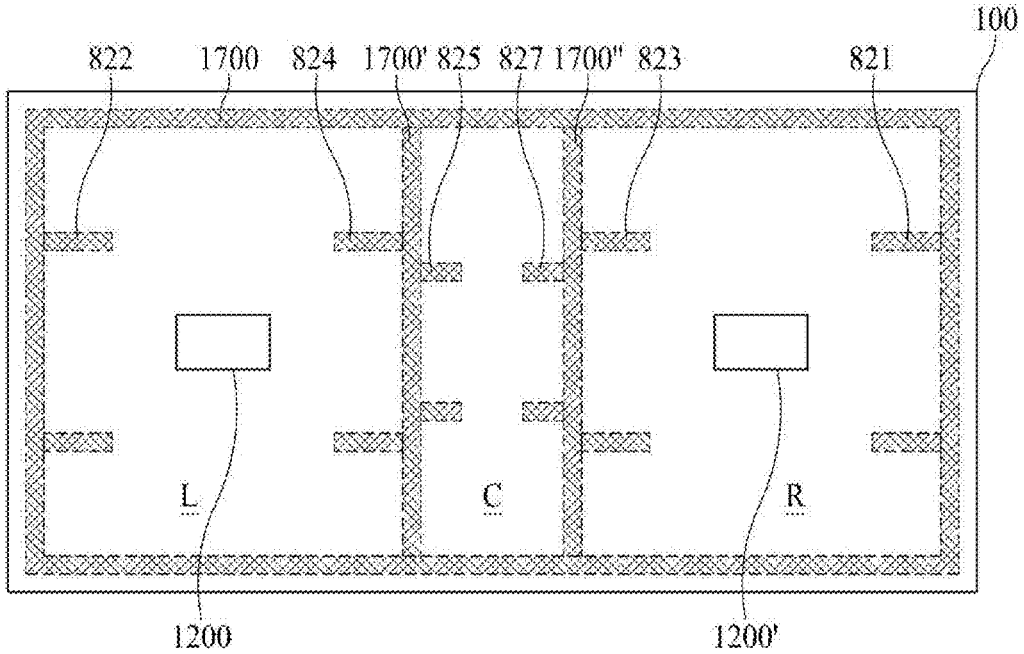

With reference to the example of FIG. 12G, duplicate description of the pad portion to the fourth pad portion described with reference to the example of FIG. 12E will be omitted. At least one first member 825 and at least one second member 827 may be at the third area corresponding to the center area of the display panel 100. For example, at least one or more members may be on at least one side of the second partition 1700' and the third partition 1700", and may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the 1-1$^{st}$ sound-generating module 1200. For example, the first member 825 may be above or below the second member 827 with respect to the 1-1$^{st}$ sound-generating module 1200. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 12H:
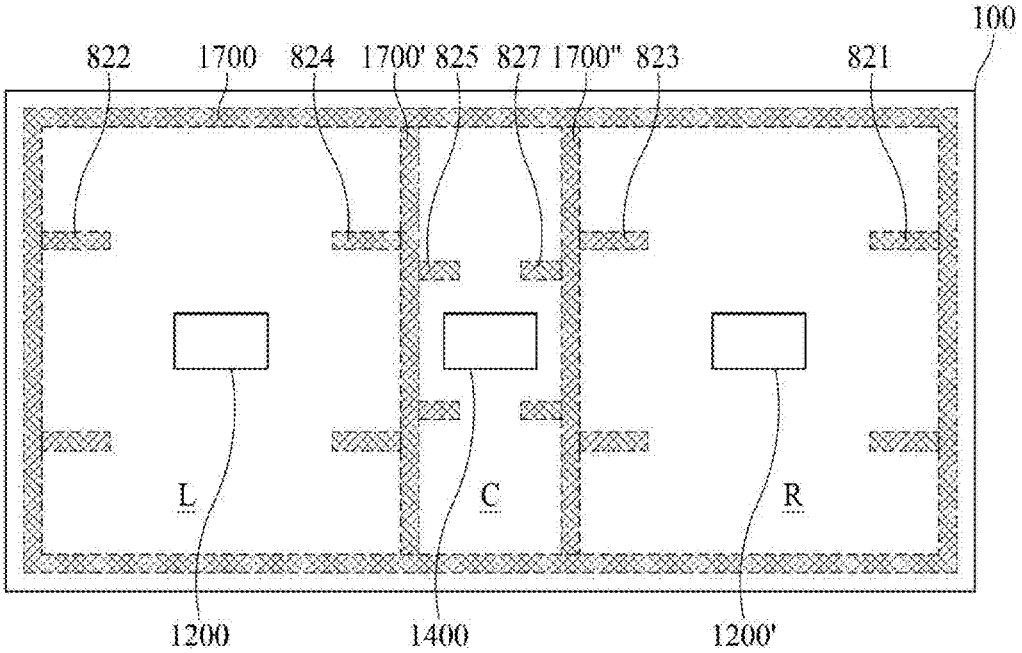

With reference to the example of FIG. 12H, the second sound-generating module 1400 may be at the third area C. At least one first member 825 and at least one second member 827 may be between the third pad portions 823 or the fourth pad portions 824, or may be between the pad portions 821 or the second pad portions 822. The first member 825 and the second member 827 may be disposed symmetrically or asymmetrically with respect to the second sound-generating module 1400. For example, the first member 825 may be above or below the second member 827 with respect to the second sound-generating module 1400. Therefore, because the first member 825 and the second member 827 may control transmission of a wave or vibration to the first area L and/or the second area R, the sound of middle- and high-pitched sound bands may be improved. Also, the sound of the low-pitched sound band or low- and middle-pitched sound bands may be improved by the second sound-generating module 1400. For example, the second sound-generating module 1400 may be a woofer speaker. Therefore, a display apparatus may be provided in which sound of the low-pitched sound band or low- and middle-pitched sound bands may be further improved, and sounds of low-, middle-, and high-pitched sound bands may be further improved.

Figure 12I:
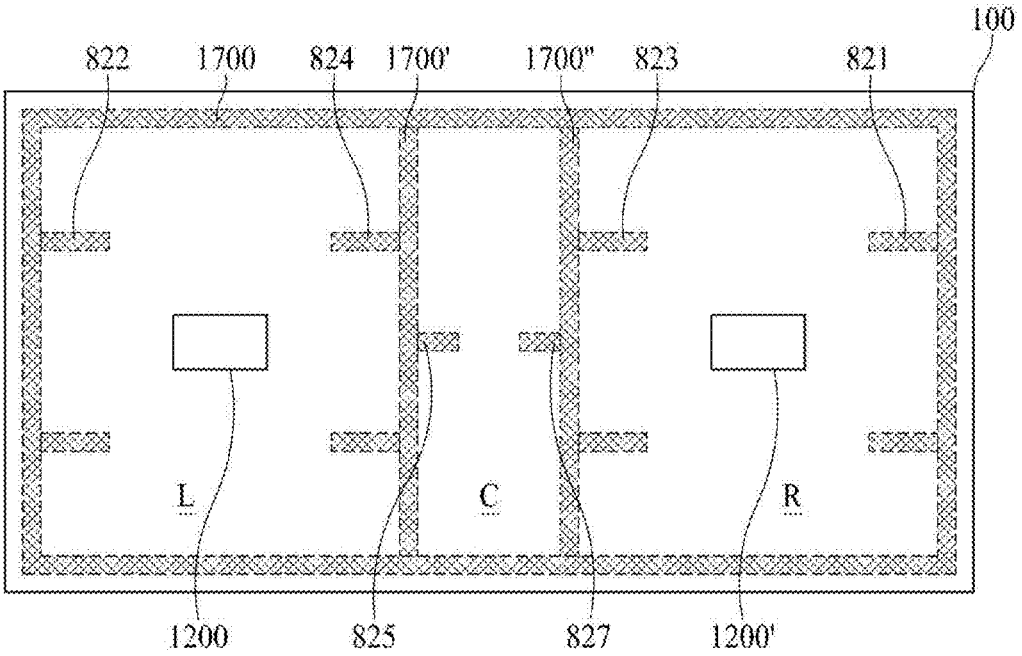

With reference to the example of FIG. 12I, duplicate description of the pad portion to the fourth pad portion described with reference to the example of FIG. 12E will be omitted. The first member 825 and the second member 827 may be at the center area of the display panel 100. The first member 825 and the second member 827 may be between the third pad portions 823 or the fourth pad portions 824, or may be between the pad portions 821 or the second pad portions 822. The first member 825 and the second member 827 may be disposed symmetrically with respect to the sound-generating modules 1200 and 1200'. For example, the first member 825 and the second member 827 may be on the same line as the 1-1$^{st}$ sound-generating module 1200 with respect to the 1-1$^{st}$ sound-generating module 1200. The first member 825 and the second member 827 may be disposed asymmetrically with respect to the sound-generating modules 1200 and 1200'. For example, with respect to the 1-1$^{st}$ sound-generating module 1200, the first member 825 may be above the 1-1$^{st}$ sound-generating module 1200, and the second member 827 may be below the 1-1$^{st}$ sound-generating module 1200. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 12J:
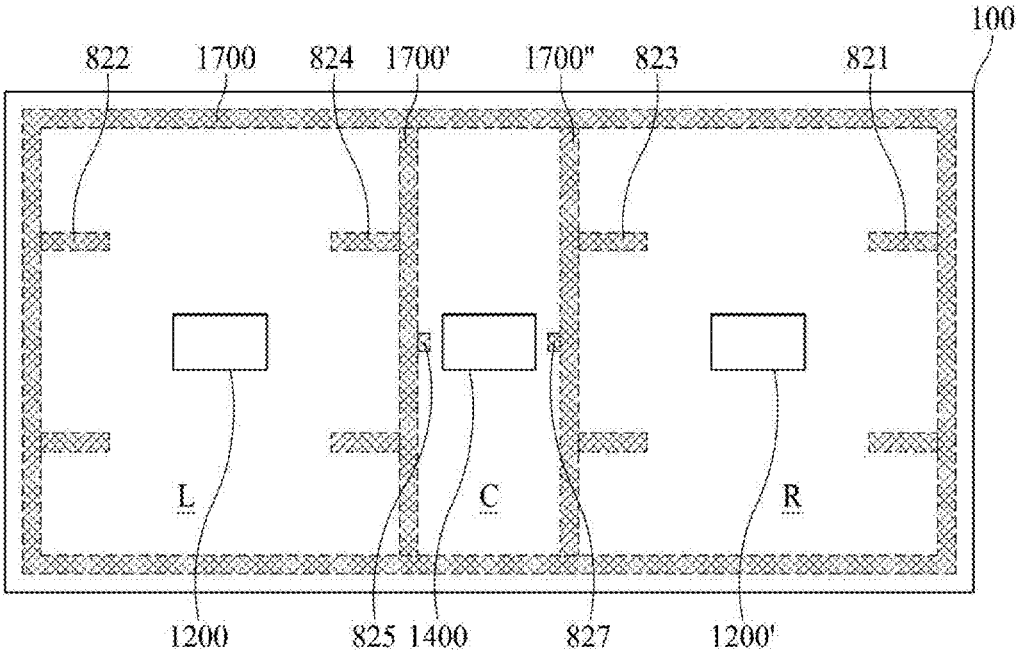

With reference to the example of FIG. 12J, the second sound-generating module 1400 may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the second sound-generating module 1400. For example, the first member 825 may be above or below the second member 827 with respect to the second sound-generating module 1400. Therefore, because the first member 825 and the second member 827 may control transmission of a wave or vibration to the first area L and/or the second area R, the sound of middle- and high-pitched sound bands may be improved. Also, the sound of the low-pitched sound band or low- and middle-pitched sound bands may be improved by the second sound-generating module 1400. For example, the second sound-generating module 1400 may be a woofer speaker. Therefore, a display apparatus may be provided in which sound of the low-pitched sound band or low- and middle-pitched sound bands may be further improved, and sounds of low-, middle-, and high-pitched sound bands may be further improved.

FIGS. 13A to 13J illustrate examples of a sound-generating module and a partition in a display apparatus according to an example embodiment of the present disclosure.

The first partition 1700, the second partition 1700', and the third partition 1700" described with reference to the examples of FIGS. 9A to 9C may be substantially similar to the examples of FIGS. 13A to 13J. Therefore, a duplicate description may be omitted.

With reference to the examples of FIGS. 13A to 13J, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 13A, 13B, 13D, 13E, 13G, and 13I, a 2-1$^{st}$ sound-generating module 1400 and a 2-2$^{nd}$ sound-generating module 1400' may be respectively at the first area L and the second area R. For example, the 2-1$^{st}$ sound-generating module 1400 may be at the first area L of the rear surface of the display panel 100, and the 2-2$^{nd}$ sound-generating module 1400' may be at the second area R of the rear surface of the display panel 100.

Figure 13A:
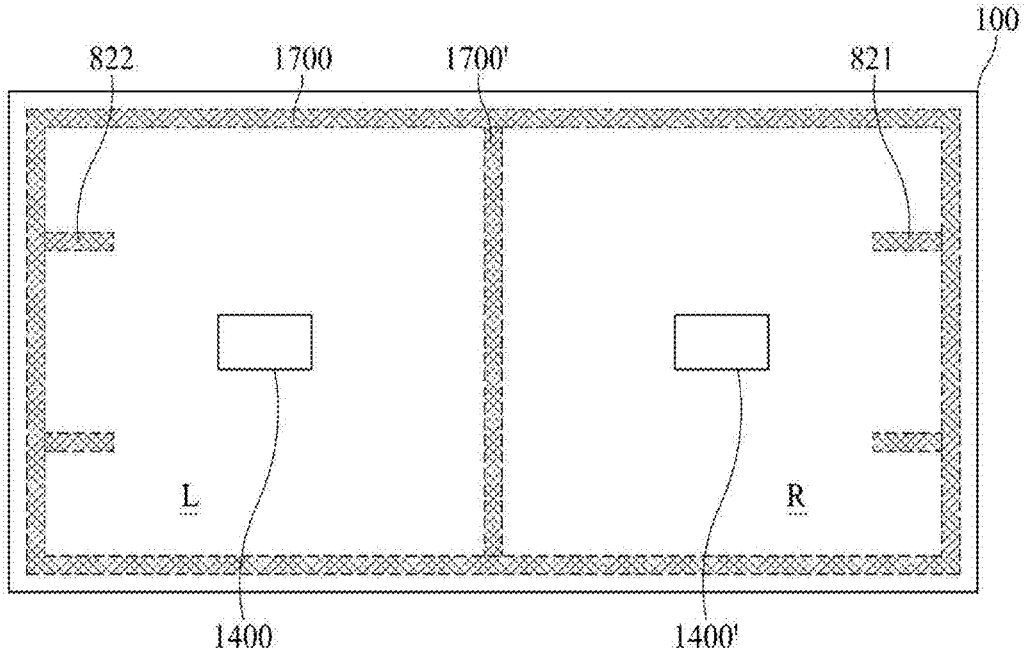
FIGS. 13A to 13J illustrate examples of a sound-generating module and a partition in a display apparatus according to an example embodiment of the present disclosure.
Figure 13B:
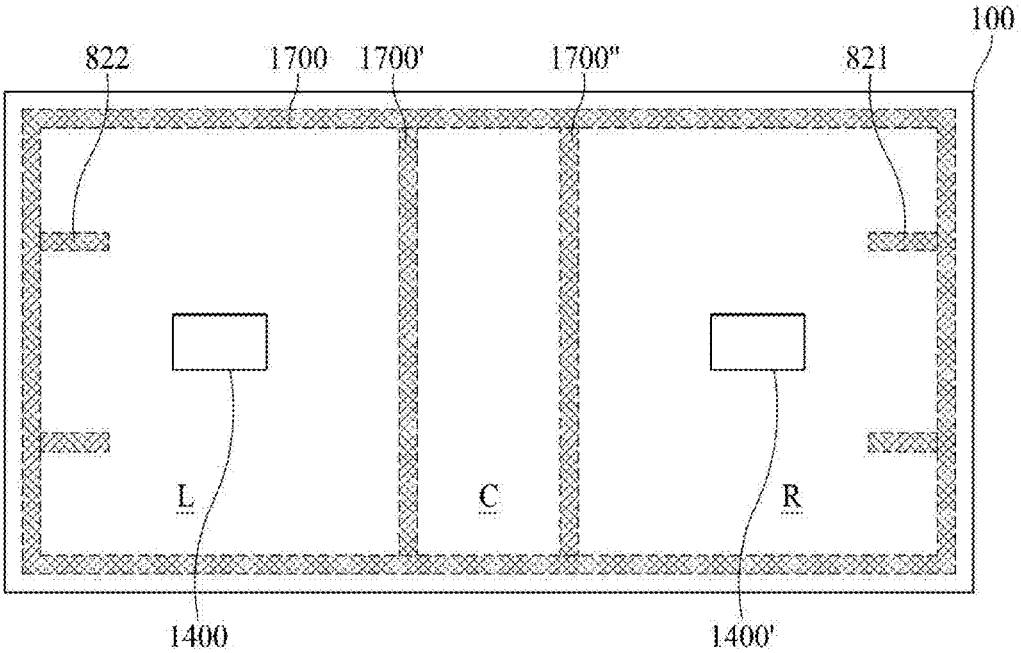
Figure 13C:
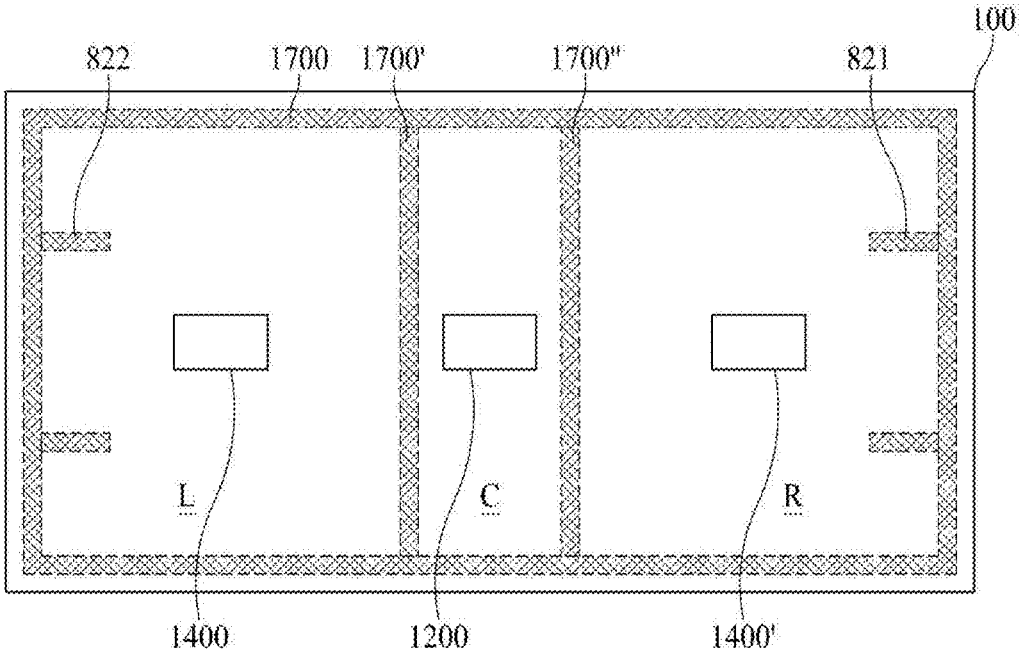

With reference to the examples of FIGS. 13Cc, 13F, 13H, and 13J, the 2-1$^{st}$ sound-generating module 1400 and the 2-2$^{nd}$ sound-generating module 1400' may be respectively at the first area L and the second area R. The first sound-generating module 1200 may be at the third area C.

With reference to the example of FIG. 13A, the pad portion 821 and the second pad portion 822 may reduce the reduction of sound pressure level caused by the standing wave generated in a vertical direction of the sound-generating modules 1400 and 1400'. Therefore, a display apparatus may be provided in which sound of the low-pitched sound band or low- and middle-pitched sound bands may be further improved, and the sounds of different low-, middle-, and high-pitched sound bands may be further improved.

With reference to the example of FIG. 13B, the pad portion 821 and the second pad portion 822 may reduce the reduction of sound pressure level caused by the standing wave generated in a vertical direction of the sound-generating modules 1400 and 1400'. Therefore, a display apparatus may be provided in which sound of the low-pitched sound band may be further improved, and the sounds of low-, middle-, and high-pitched sound bands may be further improved.

With reference to the example of FIG. 13C, the first sound-generating module 1200 may output the sounds of low-, middle-, and high-pitched sound bands in which sound of the middle- and high-pitched sound bands may be improved. The pad portion 821 and the second pad portion 822 may reduce the reduction of sound pressure level caused by the standing wave generated in a vertical direction of the sound-generating modules 1400 and 1400'. Therefore, a display apparatus may be provided in which sound of the middle- and high-pitched sound bands may be further improved, and the sound of the low-, middle-, and high-pitched sound bands may be further improved.

Figure 13D:
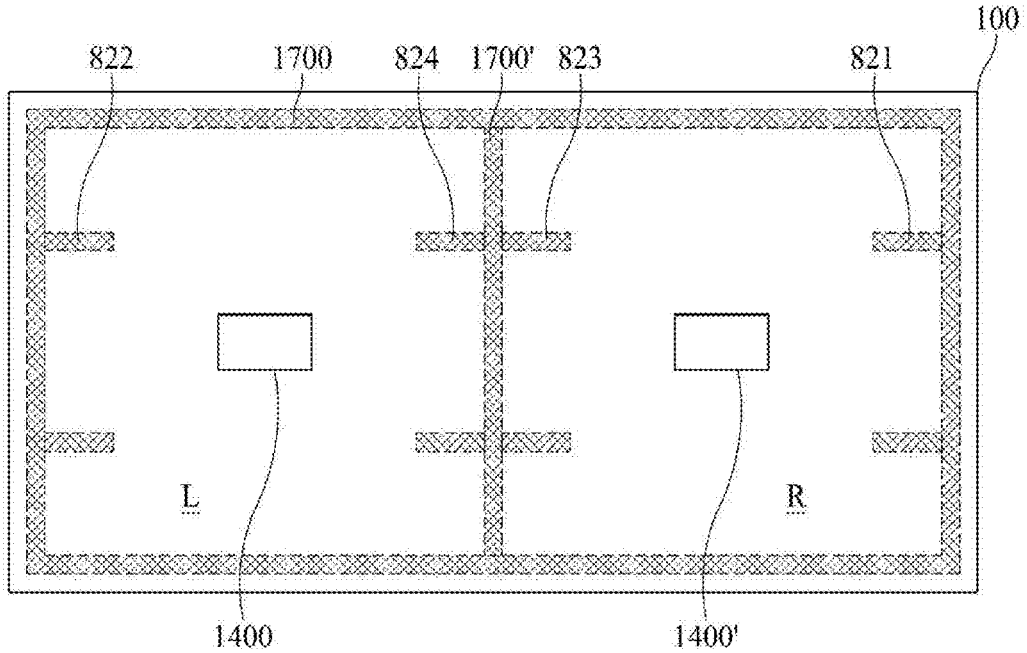
Figure 13E:
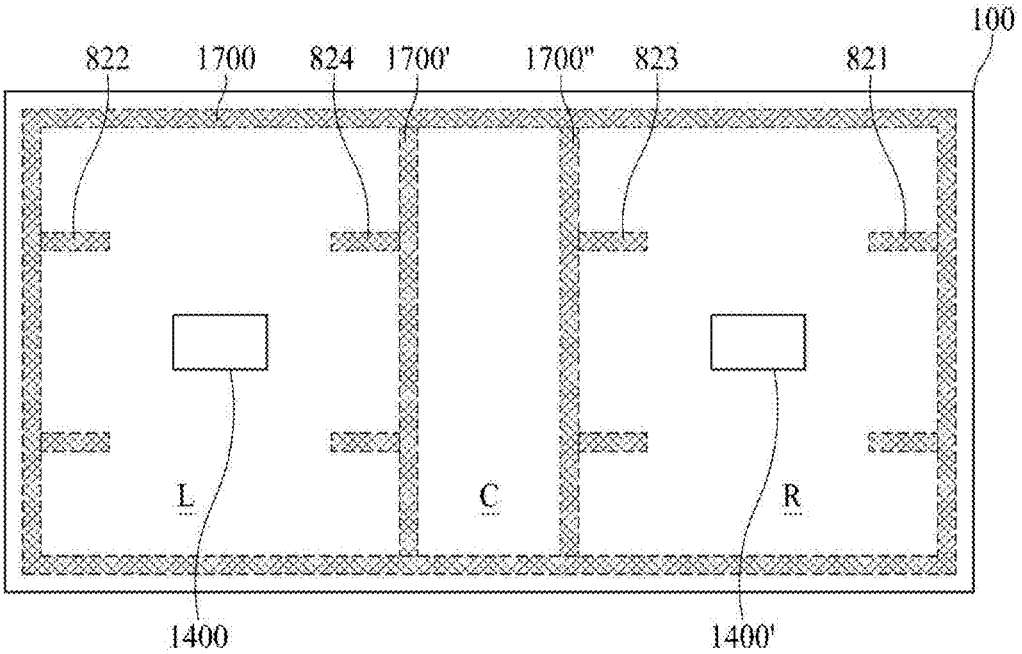

With reference to the examples of FIGS. 13D and 13E, the pad portion 821, the second pad portion 822, the third pad portion 823, and the fourth pad portion 824 may reduce the reduction of sound pressure level caused by the standing wave generated in a vertical direction of the sound-generating modules 1400 and 1400', and vibration may be transferred to both sides, whereby sound output characteristics may be improved. Therefore, in the example of FIG. 13D, a display apparatus may be provided in which sound of the low-pitched sound band or the low- and middle-pitched sound bands may be further improved, and sounds of different low-, middle-, and high-pitched sound bands may be further improved. In the example of FIG. 13E, a display apparatus may be provided in which sound of the low-pitched sound band may be further improved, and sounds of low-, middle-, and high-pitched sound bands may be further improved.

Figure 13F:
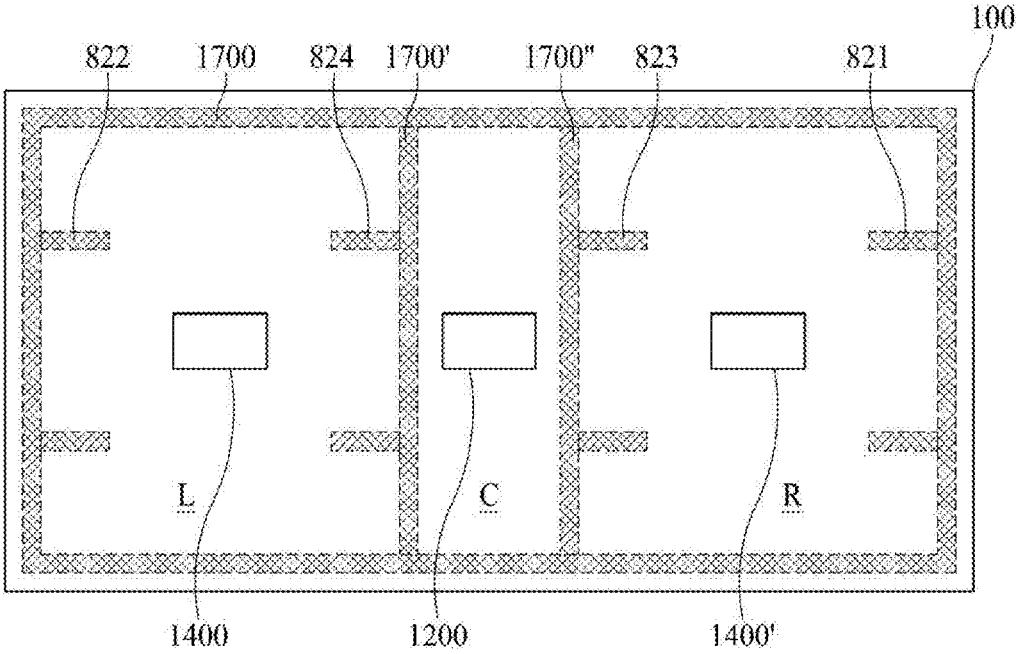

With reference to the example of FIG. 13F, the pad portion 821, the second pad portion 822, the third pad portion 823, and the fourth pad portion 824 may reduce the reduction of sound pressure level caused by the standing wave generated in a vertical direction of the sound-generating modules 1400 and 1400'. Therefore, a display apparatus may be provided in which sounds of the low-pitched sound band and the middle- and high-pitched sound bands may be further improved, and sounds of low-, middle-, and high-pitched sound bands may be further improved.

Figure 13G:
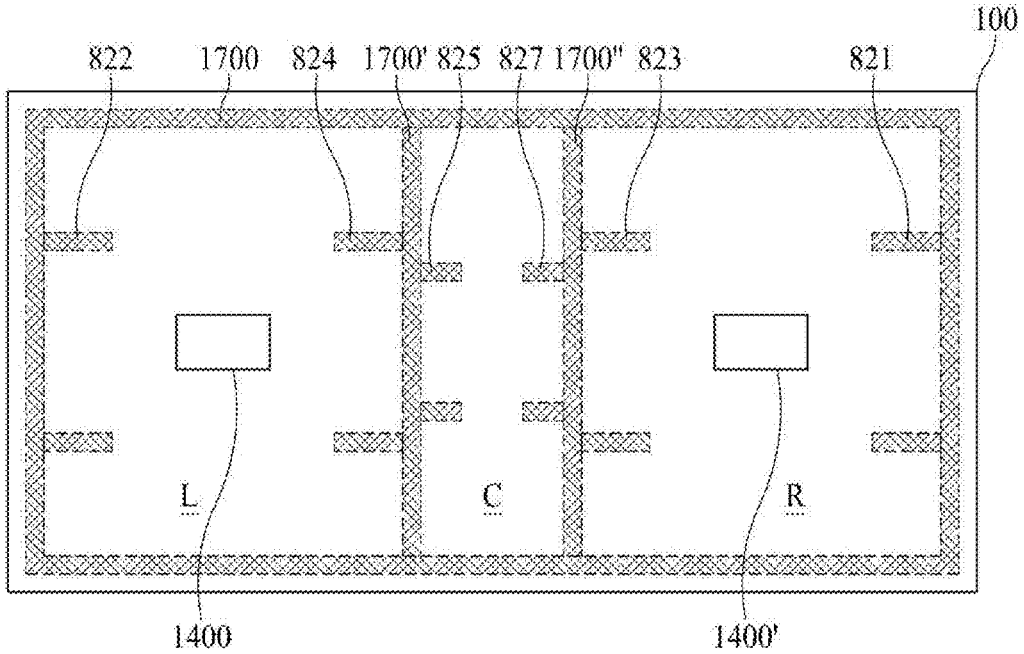

With reference to the example of FIG. 13G, at least one first member 825 and at least one second member 827 may be at the third area corresponding to the center area of the display panel 100. For example, at least one or more members may be on at least one side of the second partition 1700' and the third partition 1700", and may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the 2-1$^{st}$ sound-generating module 1400. For example, the first member 825 may be above or below the second member 827 with respect to the 2-1$^{st}$ sound-generating module 1400. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 13H:
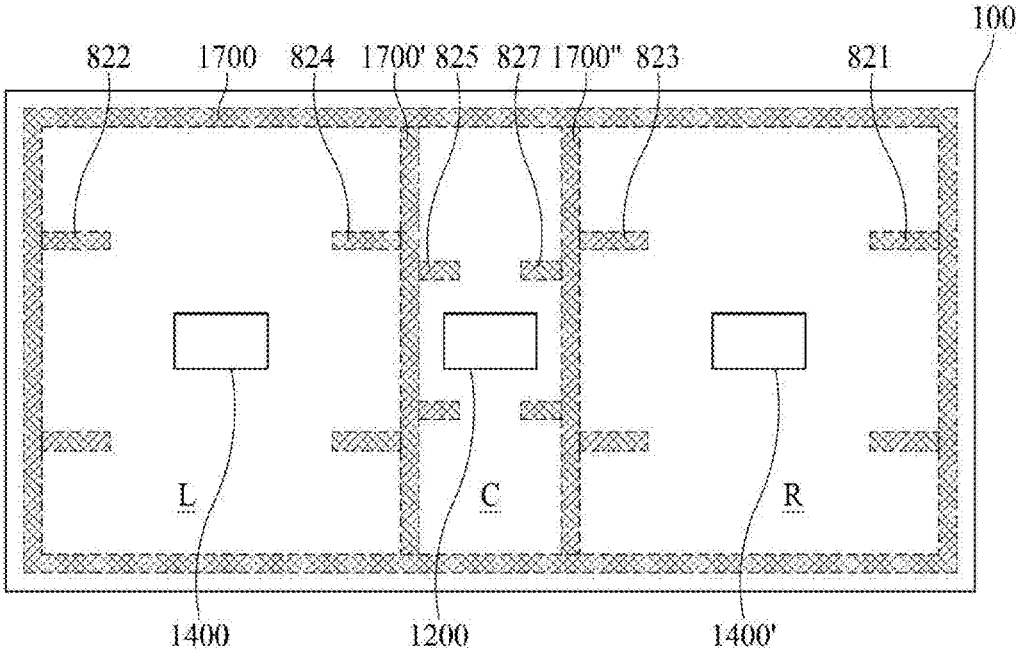

With reference to the example of FIG. 13H, the first sound-generating module 1200 may be at the third area C. At least one first member 825 and at least one second member 827 may be between the third pad portions 823 or the fourth pad portions 824, or may be between the pad portions 821 or the second pad portions 822. The first member 825 and the second member 827 may be disposed symmetrically or asymmetrically with respect to the first sound-generating module 1200. For example, the first member 825 may be above or below the second member 827 with respect to the first sound-generating module 1200. Therefore, when the first member 825 and the second member 827 control transmission of a wave or vibration to the first area L and/or the second area R, the sound of low-pitched sound band or low- and middle-pitched sound bands may be improved. Also, the sounds of the low-pitched sound band and the middle- and high-pitched sound bands may be improved by the first sound-generating module 1200. Therefore, a display apparatus may be provided in which sounds of the low-pitched sound band and the middle- and high-pitched sound bands may be further improved, and sounds of low-, middle-, and high-pitched sound bands may be further improved.

Figure 13I:
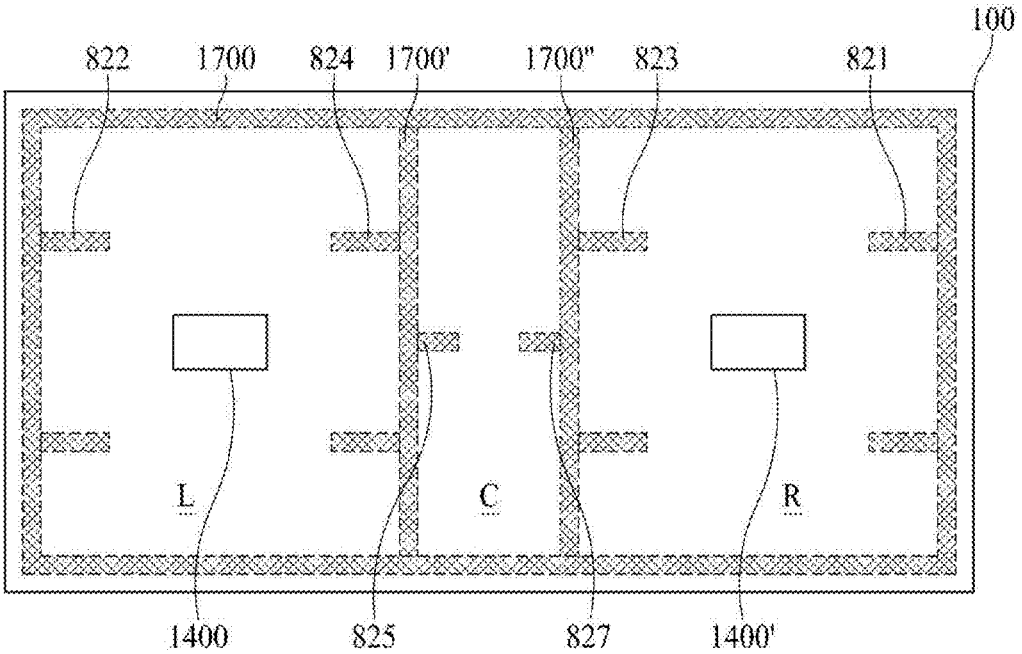

With reference to the example of FIG. 13I, duplicate description of the pad portion to the fourth pad portion described with reference to the example of FIG. 13E will be omitted. The first member 825 and the second member 827 may be at the third area C, which may be the center area of the display panel 100. The first member 825 and the second member 827 may be between the third pad portions 823 or the fourth pad portions 824, or may be between the pad portions 821 or the second pad portions 822. The first member 825 and the second member 827 may be disposed symmetrically with respect to the sound-generating modules 1400 and 1400'. For example, the first member 825 and the second member 827 may be on the same line as the 2-1$^{st}$ sound-generating module 1400 with respect to the 2-1$^{st}$ sound-generating module 1400. The first member 825 and the second member 827 may be disposed asymmetrically with respect to the sound-generating modules 1400 and 1400'. For example, with respect to the 2-1$^{st}$ sound-generating module 1400, the first member 825 may be above the 2-1$^{st}$ sound-generating module 1400, and the second member 827 may be below the 2-1$^{st}$ sound-generating module 1400. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 13J:
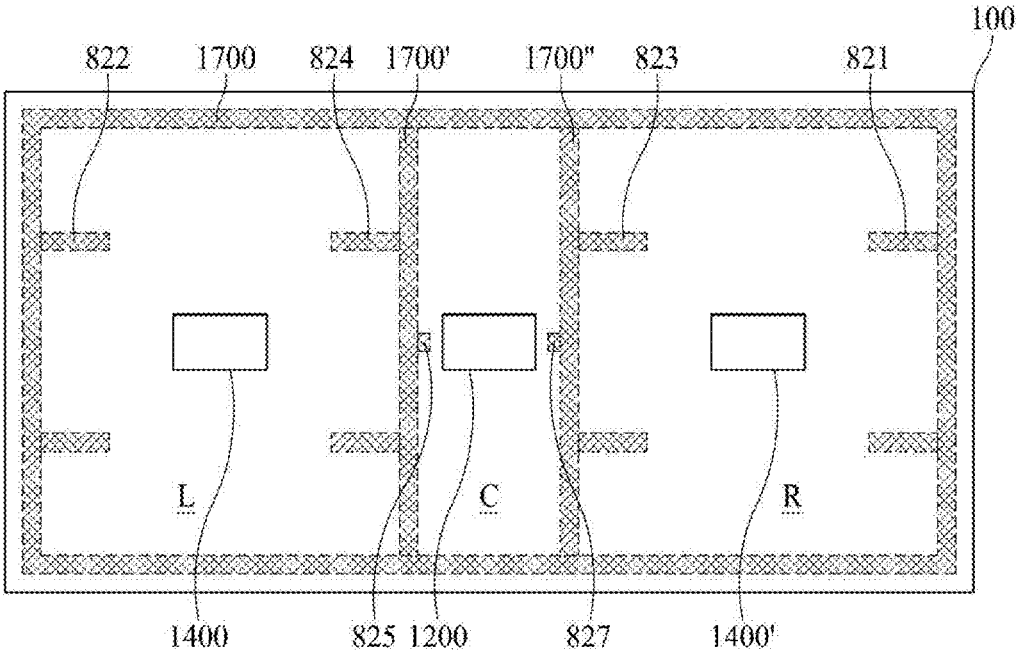

With reference to the example of FIG. 13J, the first sound-generating module 1200 may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the first sound-generating module 1200. For example, the first member 825 may be above or below the second member 827 with respect to the first sound-generating module 1200. Therefore, because the first member 825 and the second member 827 may control transmission of a wave or vibration to the first area L and/or the second area R, the sound of the low-pitched sound band or the middle- and high-pitched sound bands may be improved. Also, the sounds of the low-pitched sound band and the middle- and high-pitched sound bands may be improved by the first sound-generating module 1200. Therefore, a display apparatus may be provided in which sounds of the low-pitched sound band and the middle- and high-pitched sound bands may be further improved, and sounds of low-, middle-, and high-pitched sound bands may be further improved.

FIGS. 14A to 14J illustrate examples of a sound-generating module and a partition in a display apparatus according to an example embodiment of the present disclosure.

The first partition 1700, the second partition 1700', and the third partition 1700" described with reference to the examples of FIGS. 8A to 8C may be substantially similar to the examples of FIGS. 14A to 14J. A duplicate description may be omitted.

With reference to the examples of FIGS. 14A to 14J, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 14A, 14B, 14D, 14E, 14G, and 14I, a 1-1$^{st}$ sound-generating module 1200 and a 1-2$^{nd}$ sound-generating module 1200' may be respectively at the first area L and the second area R. For example, the 1-1$^{st}$ sound-generating module 1200 may be at the first area L of the rear surface of the display panel 100, and the 1-2$^{nd}$ sound-generating module 1200' may be at the second area R of the rear surface of the display panel 100.

With reference to the examples of FIGS. 14C, 14F, 14H, and 14J, the 1-1$^{st}$ sound-generating module 1200 and the 1-2$^{nd}$ sound-generating module 1200' may be respectively at the first area L and the second area R. The second sound-generating module 1400 may be at the third area C.

With reference to the examples of FIGS. 14A to 14J, a bent portion 712 may be in at least one side of the first partition 1700. The bent portion 712 may be in at least one side, where the largest sound wave may approach, among four sides of the first partition 1700. The bent portion 712 may face or extend toward the sound-generating modules 1200 and 1200'. For example, the bent portion 712 may face or extend toward the center of the 1-1$^{st}$ sound-generating module 1200 and the center of the 1-2$^{nd}$ sound-generating module 1200', so that it may be possible to avoid or prevent the reduction of sound pressure level caused by the standing wave.

With reference to the examples of FIGS. 14B, 14C, 14E, 14F, 14G, 14H, 14I, and 14J, a second bent portion 713 may be between the second partition 1700' and the third partition 1700". A shape of the second bent portion 713 may be the same as that of the bent portion 712, but embodiments are not limited thereto. For example, the second bent portion 713 may face or extend toward a direction different from that of the bent portion 712. The second bent portion 713 may not be provided, or may be between the second partition 1700' and the third partition 1700", e.g., in a straight-line shape. The bent portion 712 and the second bent portion 713 may have a sealed structure or a non-sealed structure.

With reference to the examples of FIGS. 14A to 14J, a pad portion may be on at least one side of the first partition 1700 to reduce a reduction of sound pressure level caused by standing wave generated in a vertical direction of the sound-generating modules 1200 and 1200'. For example, the first partition 1700 may include a first side, and a second side vertical to the first side, and the pad portion may be in the second side. At least one or more pad portions may be provided. The first side may be a horizontal direction of the display panel 100, and the second side may be a vertical direction of the display panel 100. Therefore, in the example of FIG. 14, because the pad portion and the bent portion are disposed to reduce the reduction of sound pressure level caused by the standing wave, a display apparatus may be provided in which sound output characteristics may be further improved.

Figure 14A:
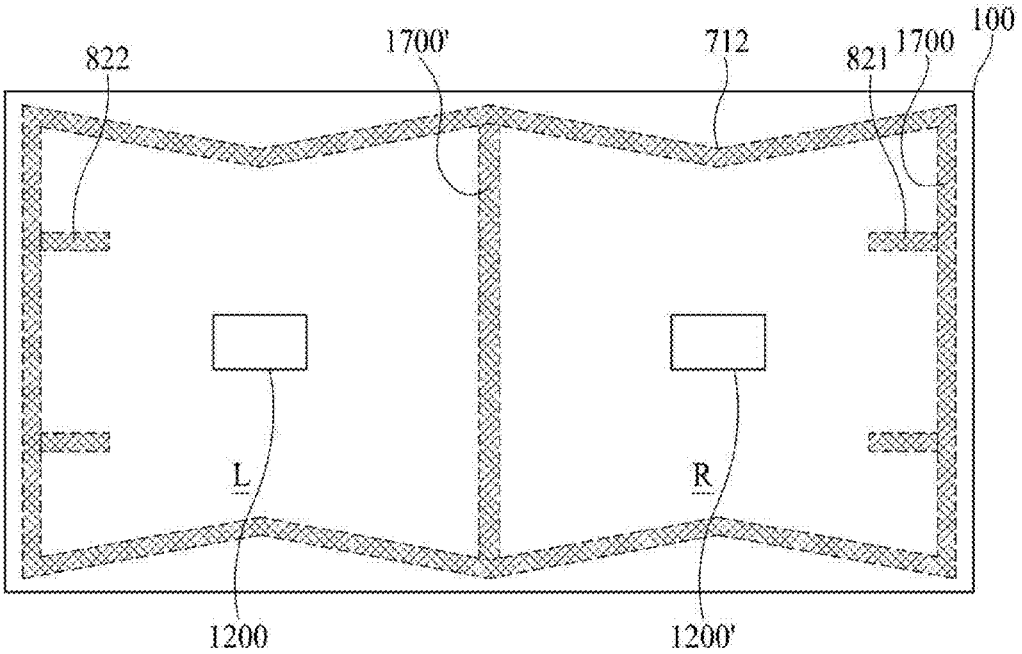
FIGS. 14A to 14J illustrate examples of a sound-generating module and a partition in a display apparatus according to an example embodiment of the present disclosure.
Figure 14B:
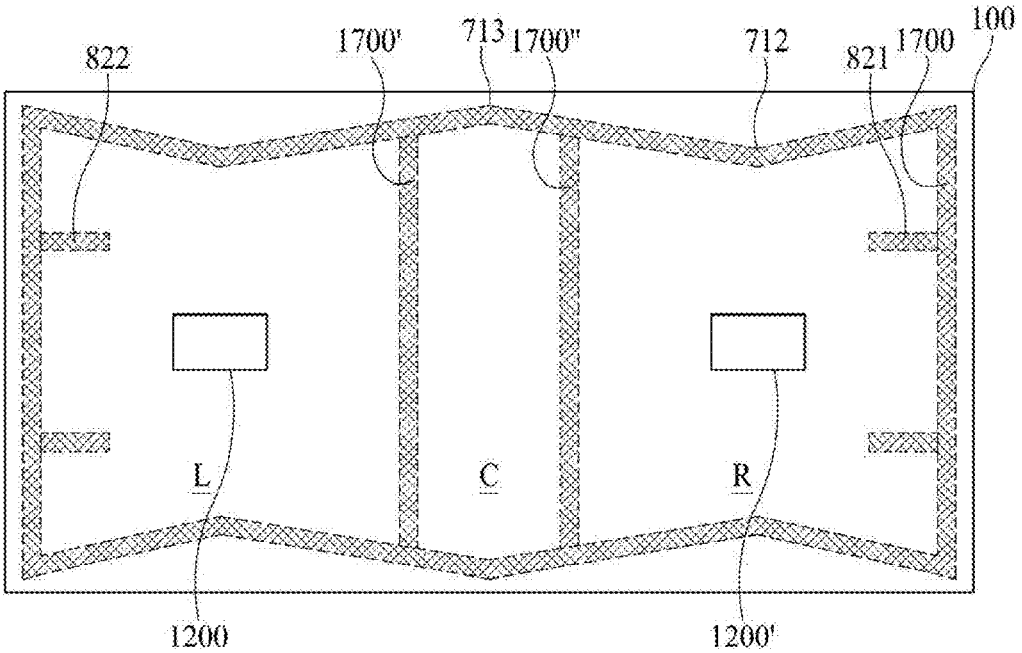
Figure 14C:
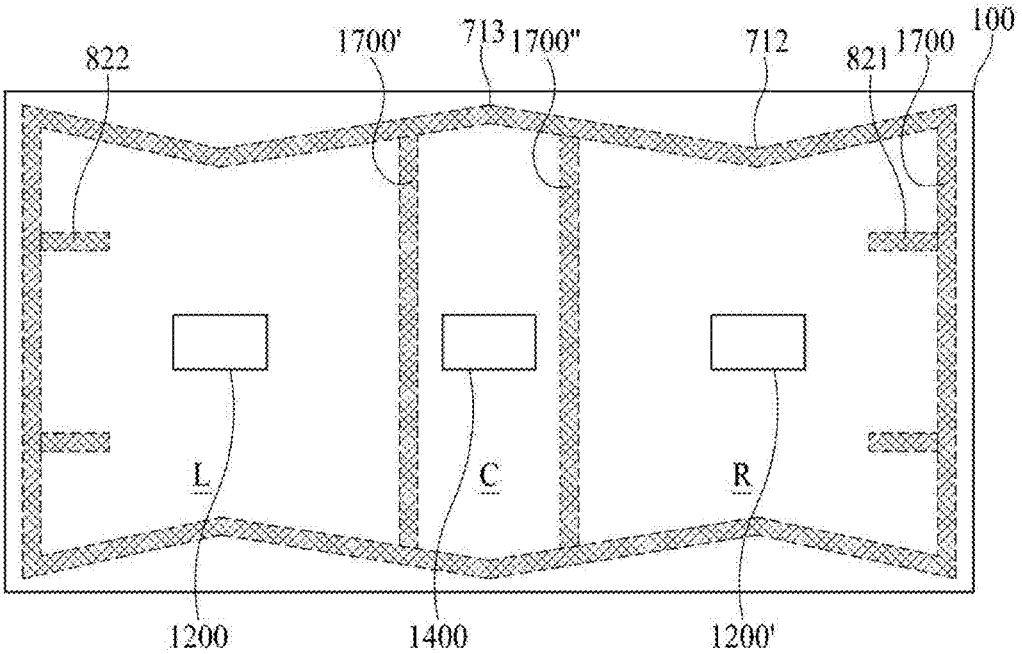

With reference to the examples of FIGS. 14A, 14B, and 14C, a pad portion 821 may be on the second side of the first partition 1700. The second pad portion 822 may be on the second side of the first partition 1700. For example, the pad portion 821 may face or extend toward the 1-2$^{nd}$ sound-generating module 1200', and the second pad portion 822 may face or extend toward the 1-1$^{st}$ sound-generating module 1200. The pad portion 821 may be at the second area R, and the second pad portion 822 may be at the first area L. At least one pad portion 821 and at least one second pad portion 822 may be on one or more sides of the first partition 1700. The pad portion 821 and the second pad portion 822 may be disposed symmetrically with respect to the sound-generating module. Therefore, the pad portion 821 and the second pad portion 822 may reduce the reduction of sound pressure level caused by the standing wave generated in a vertical direction of the sound-generating modules 1200 and 1200', and vibration may be transferred to both sides, whereby sound output characteristics may be improved.

In the example of FIG. 14, one or more pad portions 821 and one or more second pad portions 822 may be on the second side vertical to the first side of the four sides of the display panel 100. Two or more pad portions 821 and second pad portions 822 may be provided, without limitation to the example of FIG. 14.

With reference to the example of FIG. 14A, the 1-1$^{st}$ sound-generating module 1200 and the 1-2$^{nd}$ sound-generating module 1200' may be respectively at the first area L and the second area R. For example, the 1-1$^{st}$ sound-generating module 1200 may be at the first area L on the rear surface of the display panel 100, and the 1-2$^{nd}$ sound-generating module 1200' may be at the second area R on the rear surface of the display panel 100. Because left and right sounds may be split by the second partition 1700', the 1-1$^{st}$ sound-generating module 1200 and the 1-2$^{nd}$ sound-generating module 1200' may output sounds of different middle- and high-pitched sound bands in which a sound of a low-pitched sound band may be improved. Because the pad portion 821, the second pad portion 822, and the bent portion 712 may reduce the reduction of sound pressure level caused by the standing wave, a display apparatus may be provided in which sound of the low-pitched sound band may be further improved, and sounds of different low-, middle-, and high-pitched sound bands may be further improved.

With reference to the example of FIG. 14B, the 1-1$^{st}$ sound-generating module 1200 may be at the first area L corresponding to the left area and the 1-2$^{nd}$ sound-generating module 1200' may be at the second area R corresponding to the right area. A sound-generating module may not be at the third area C corresponding to the center area. Therefore, sounds of low-, middle-, and high-pitched sound bands, in which sound of the low-pitched sound band may be improved, may be output. The pad portion 821, the second pad portion 822, and the bent portions 712 and 713 may reduce the reduction of sound pressure level caused by the standing wave. Therefore, a display apparatus may be provided in which sound of the low-pitched sound band may be further improved, and sounds of low-, middle-, and high-pitched sound bands may be further improved.

With reference to the example of FIG. 14C, the 1-1$^{st}$ sound-generating module 1200 may be at the first area L corresponding to the left area, and the 1-2$^{nd}$ sound-generating module 1200' may be at the second area R corresponding to the right area. The second sound-generating module 1400 may be at the third area C corresponding to the center area. The second sound-generating module 1400 may improve a sound of a low-pitched sound band or sounds of low- and middle-pitched sound bands. For example, the second sound-generating module 1400 may be a woofer speaker. Therefore, the sounds of low-, middle-, and high-pitched sound bands may be output, in which sound of the low-pitched sound band or sounds of the low- and middle-pitched sound bands may be improved. The pad portion 821, the second pad portion 822, and the bent portions 712 and 713 may reduce the reduction of sound pressure level caused by the standing wave. Therefore, a display apparatus may be provided in which sound of the low-pitched sound band or the low-middle-pitched sound bands may be further improved, and sounds of low-, middle-, and high-pitched sound bands may be further improved.

Figure 14D:
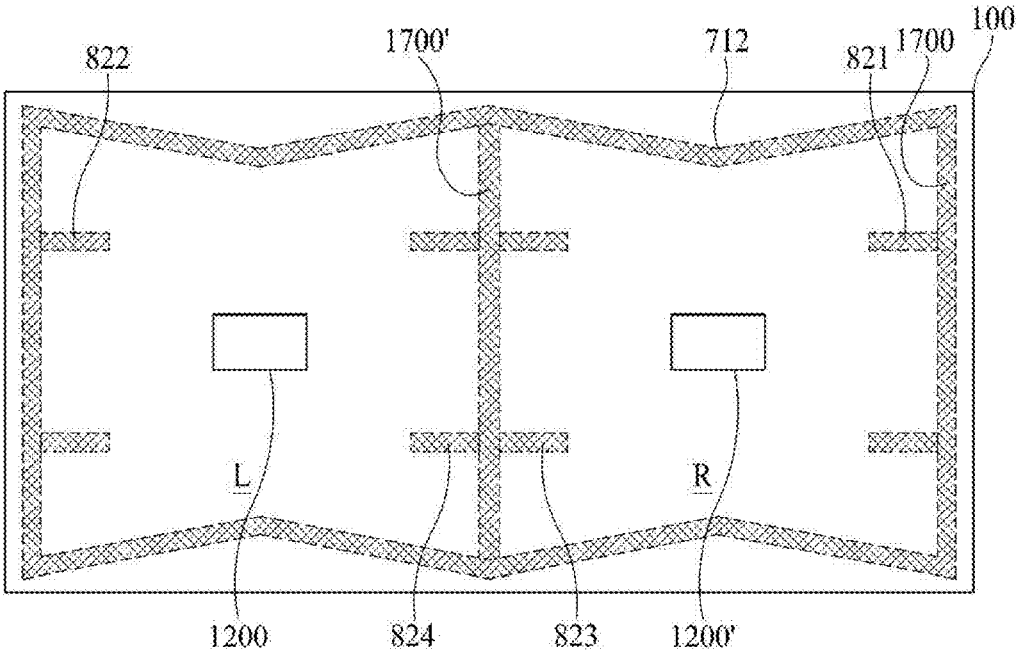

With reference to the example of FIG. 14D, a third pad portion 823 may further be on a side facing the second side of the first partition 1700. At least one or more third pad portions 823 may be provided. A fourth pad portion 824 may be on a side facing the second side of the first partition 1700. At least one or more fourth pad portions 824 may be provided. For example, the third pad portion 823 may face or extend toward the 1-2$^{nd}$ sound-generating module 1200', and the fourth pad portion 824 may face or extend toward the 1-1$^{st}$ sound-generating module 1200. The third pad portion 823 may be at the second area R, and the fourth pad portion 824 may be at the first area L. For example, the third pad portion 823 may face the pad portion 821, and the fourth pad portion 824 may face the second pad portion 822. The third and fourth pad portions 823 and 824 may be disposed with respect to the second partition 1700'. Because the third pad portion 823 and the fourth pad portion 824 may be capable of trapping the reflected wave from the sound-generating modules 1200 and 1200', a reduction of sound pressure level caused by the standing wave may decrease. Therefore, a display apparatus may be provided in which sound of the low-pitched sound band may be further improved, and sounds of different middle-high-pitched sound bands may be further improved.

Figure 14E:
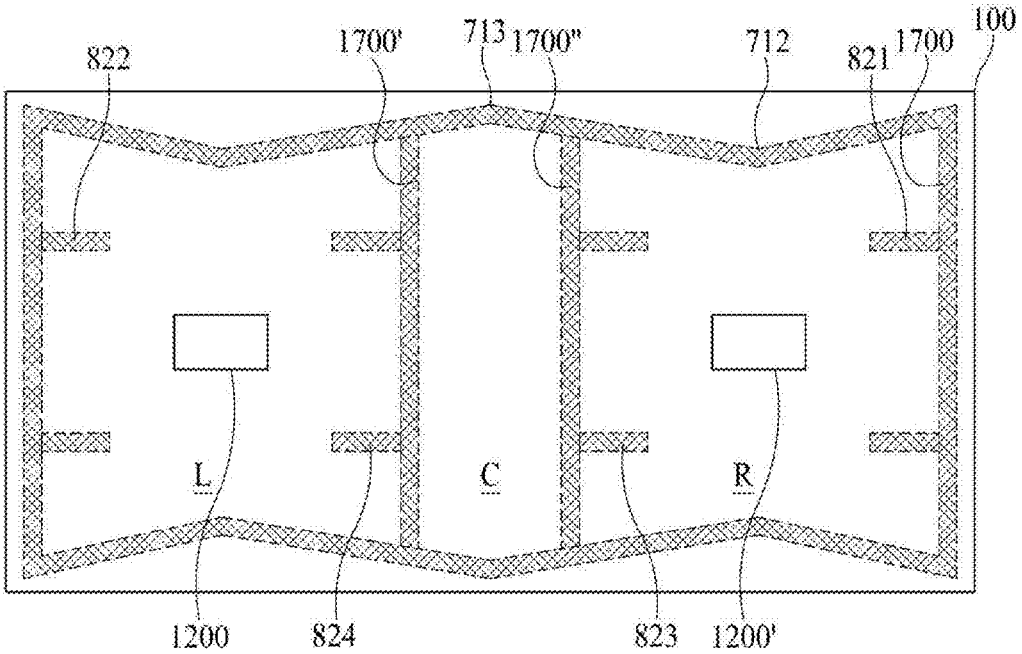

With reference to the example of FIG. 14E, the pad portion 821 may be on the second side of the first partition 1700. The second pad portion 822 may be on the second side of the first partition 1700. For example, the pad portion 821 may face or extend toward the 1-2$^{nd}$ sound-generating module 1200', and the second pad portion 822 may face or extend toward the 1-1$^{st}$ sound-generating module 1200. The pad portion 821 may be at the second area R, and the second pad portion 822 may be at the first area L.

The third pad portion 823 may be on the side facing the second side of the first partition 1700. At least one or more third pad portions 823 may be provided. The fourth pad portion 824 may be on the side facing the second side of the first partition 1700. At least one or more fourth pad portions 824 may be provided. For example, the third pad portion 823 may face or extend toward the 1-2$^{nd}$ sound-generating module 1200', and the fourth pad portion 824 may face or extend toward the 1-1$^{st}$ sound-generating module 1200. The third pad portion 823 may be at the second area R, and the fourth pad portion 824 may be at the first area L. For example, the third pad portion 823 may face the pad portion 821, and the fourth pad portion 824 may face the second pad portion 822. The third pad portion 823 may be on the second side of the third partition 1700", and may face or extend toward the 1-2$^{nd}$ sound-generating module 1200'. The fourth pad portion 824 may be on the second side of the second partition 1700', and may face or extend toward the 1-1$^{st}$ sound-generating module 1200. Therefore, because the pad portion 821, the second pad portion 822, the third pad portion 823 and the fourth pad portion 824 may reduce the reduction of sound pressure level caused by the standing wave generated in a vertical direction of the sound-generating modules 1200 and 1200' and vibration may be transferred to both sides, sound output characteristics may be improved. Therefore, a display apparatus may be provided in which sound of the low-pitched sound band may be further improved, and sounds of low-, middle-, and high-pitched sound bands may be further improved.

Figure 14F:
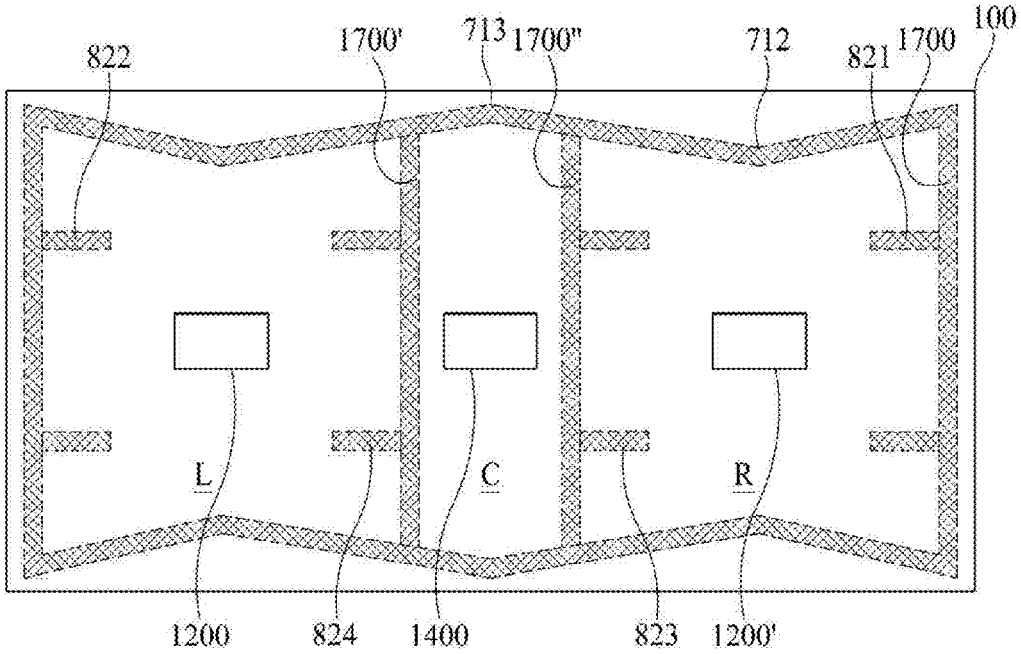

With reference to the example of FIG. 14F, duplicate description of the pad portion to the fourth pad portion described with reference to the example of FIG. 14E will be omitted. The second sound-generating module 1400 may be at the third area C of the display panel 100. For example, the second sound-generating module 1400 may be a woofer speaker. Because the pad portion may be disposed to reduce the reduction of sound pressure level caused by the standing wave, sound output characteristics may be improved. Therefore, a display apparatus may be provided in which sound of the low-pitched sound band or low- and middle-pitched sound bands may be further improved, and sounds of low-, middle-, and high-pitched sound bands may be further improved.

Figure 14G:
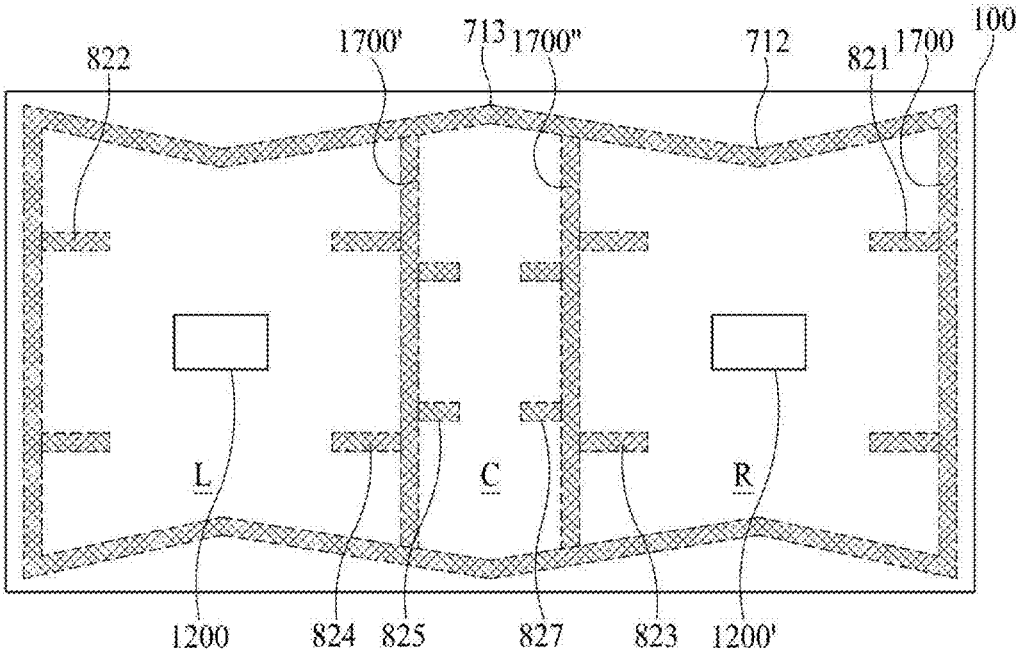

With reference to the example of FIG. 14G, duplicate description of the pad portion to the fourth pad portion described with reference to the example of FIG. 14E will be omitted. At least one first member 825 and at least one second member 827 may be at the third area corresponding to the center area of the display panel 100. For example, at least one or more members may be on at least one side of the second partition 1700' and the third partition 1700", and may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the second sound-generating module 1400. For example, the first member 825 may be above or below the second member 827 with respect to the second sound-generating module 1400. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 14H:
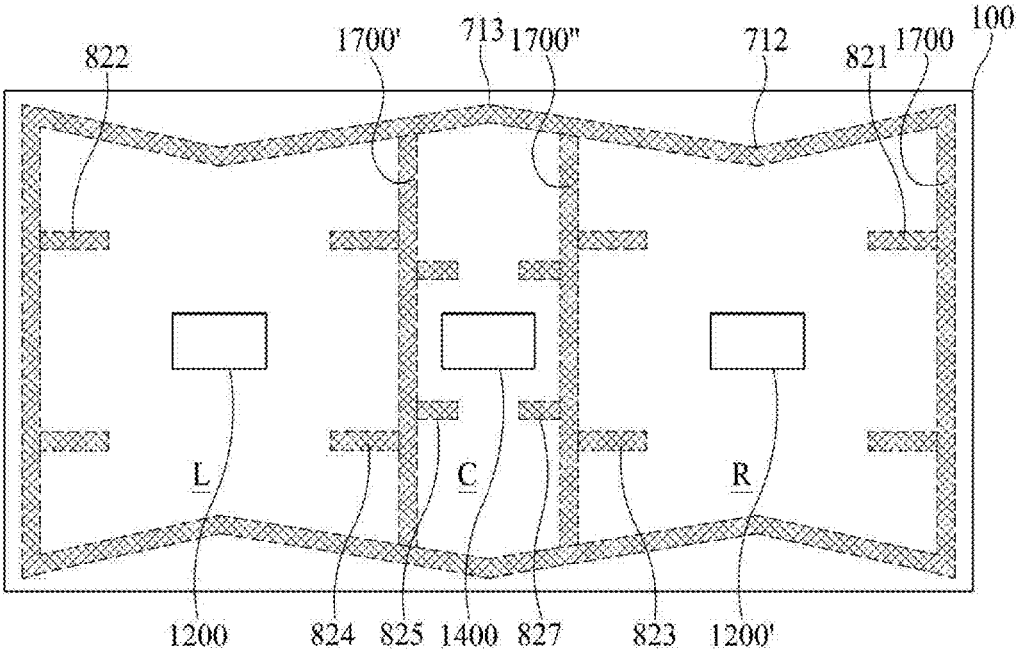

With reference to the example of FIG. 14H, the second sound-generating module 1400 may be at the third area C. At least one first member 825 and at least one second member 827 may be between the third pad portions 823 or the fourth pad portions 824, or may be between the pad portions 821 or the second pad portions 822. The first member 825 and the second member 827 may be disposed symmetrically or asymmetrically with respect to the second sound-generating module 1400. For example, the first member 825 may be above or below the second member 827 with respect to the second sound-generating module 1400. Because the first member 825 and the second member 827 may control transmission of a wave or vibration to the first area L and/or the second area R, the sound of middle and high sound bands may be improved. Also, the sound of the low sound band or low and middle sound bands may be improved by the second sound-generating module 1400. For example, the second sound-generating module 1400 may be a woofer speaker. Therefore, a display apparatus may be provided in which sound of the low-pitched sound band or low- and middle-pitched sound bands may be further improved, and sounds of low-, middle-, and high-pitched sound bands may be further improved.

Figure 14I:
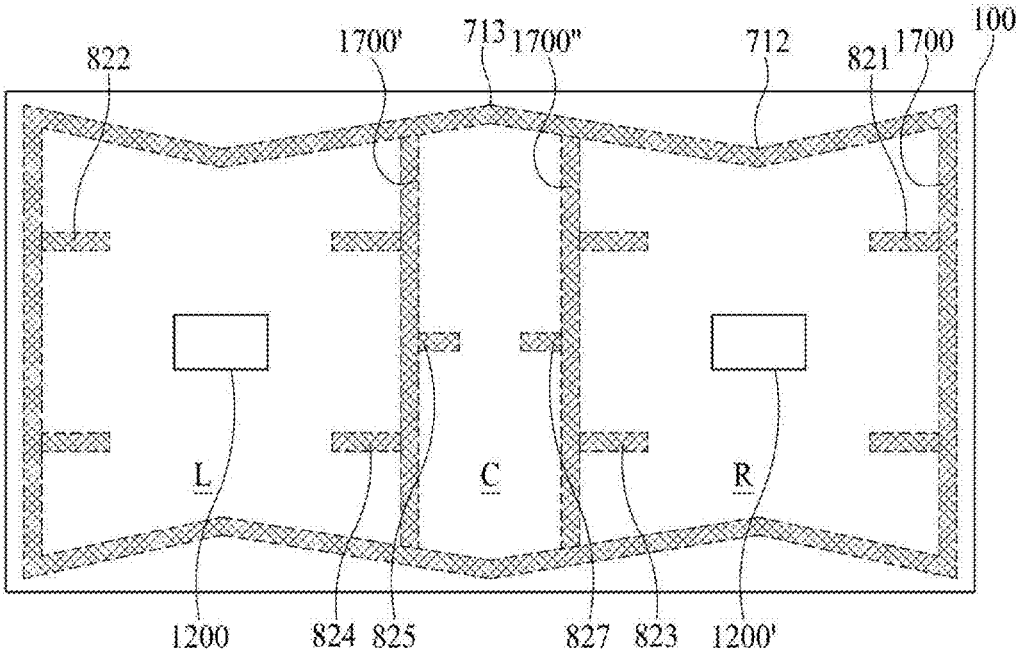

With reference to the example of FIG. 14I, duplicate description of the pad portion to the fourth pad portion described with reference to the example of FIG. 14E will be omitted. The first member 825 and the second member 827 may be at the third area C corresponding to the center area of the display panel 100. The first member 825 and the second member 827 may be between the third pad portions 823 or the fourth pad portions 824, or may be between the pad portions 821 or the second pad portions 822. The first member 825 and the second member 827 may be disposed symmetrically with respect to the sound-generating modules 1200 and 1200'. For example, the first member 825 and the second member 827 may be on the same line as the 1-1$^{st}$ sound-generating module 1200 with respect to the 1-1$^{st}$ sound-generating module 1200. The first member 825 and the second member 827 may be disposed asymmetrically with respect to the sound-generating modules 1200 and 1200'. For example, with respect to the 1-1$^{st}$ sound-generating module 1200, the first member 825 may be above the 1-1$^{st}$ sound-generating module 1200, and the second member 827 may be below the 1-1$^{st}$ sound-generating module 1200. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 14J:
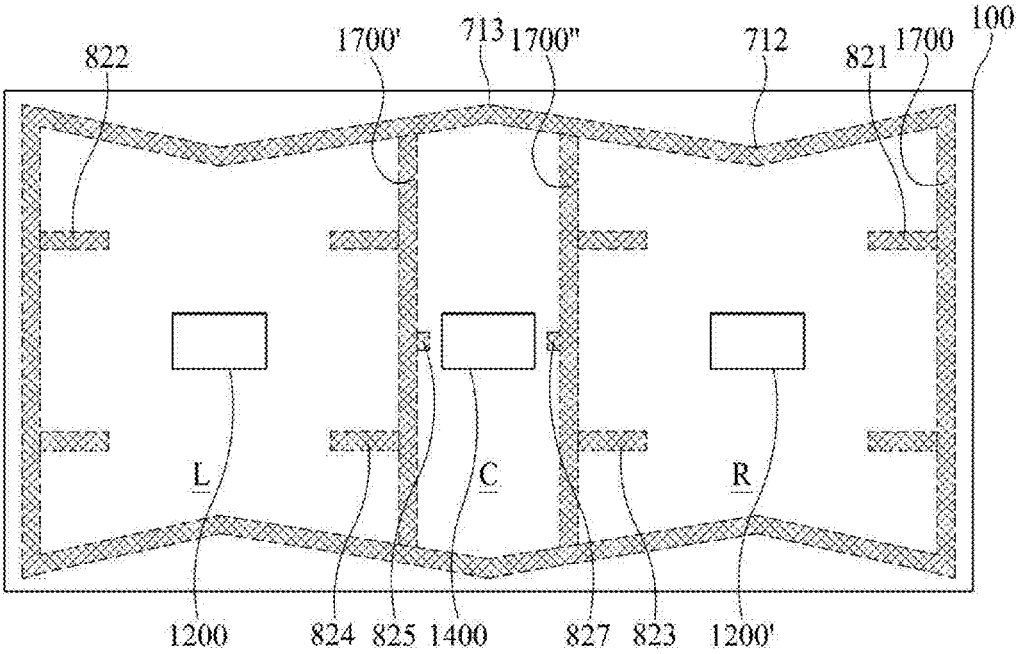

With reference to the example of FIG. 14J, the second sound-generating module 1400 may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the second sound-generating module 1400. For example, the first member 825 may be above or below the second member 827 with respect to the second sound-generating module 1400. Therefore, because the first member 825 and the second member 827 may control transmission of a wave or vibration to the first area L and/or the second area R, the sound of middle-high-pitched sound band may be improved. Also, the sound of the low-pitched sound band or low- and middle-pitched sound bands may be improved by the second sound-generating module 1400. For example, the second sound-generating module 1400 may be a woofer speaker. Therefore, a display apparatus may be provided in which sound of the low-pitched sound band or low- and middle-pitched sound bands may be further improved, and sounds of low-, middle-, and high-pitched sound bands may be further improved.

FIGS. 15A to 15J illustrate examples of a sound-generating module and a partition in a display apparatus according to an example embodiment of the present disclosure.

The first partition 1700, the second partition 1700', and the third partition 1700" described with reference to the examples of FIGS. 9A to 9C may be substantially similar to the examples of FIGS. 15A to 15J, and a duplicate description may be omitted. Because a pad portion and a bent portion are the substantially similar to those described with reference to the examples of FIGS. 14A to 14J, a duplicate description will be omitted or be briefly provided.

With reference to the examples of FIGS. 15A to 15J, the rear surface of the display panel 100 may include a first area L, a second area R, and a third area C. The first area L may be a left area of the rear surface of the display panel 100, the second area R may be a right area of the rear surface of the display panel 100, and the third area C may be a center area of the rear surface of the display panel 100.

With reference to the examples of FIGS. 15A, 15B, 15D, 15E, 15G, and 15I, a 2-1$^{st}$ sound-generating module 1400 and a 2-2$^{nd}$ sound-generating module 1400' may be respectively at the first area L and the second area R. For example, the 2-1$^{st}$ sound-generating module 1400 may be at the first area L of the rear surface of the display panel 100, and the 2-2$^{nd}$ sound-generating module 1400' may be at the second area R of the rear surface of the display panel 100.

With reference to the examples of FIGS. 15C, 15F, 15H, and 15J, the 2-1$^{st}$ sound-generating module 1400 and the 2-2$^{nd}$ sound-generating module 1400' may be respectively at the first area L and the second area R. The first sound-generating module 1200 may be at the third area C.

Figure 15A:
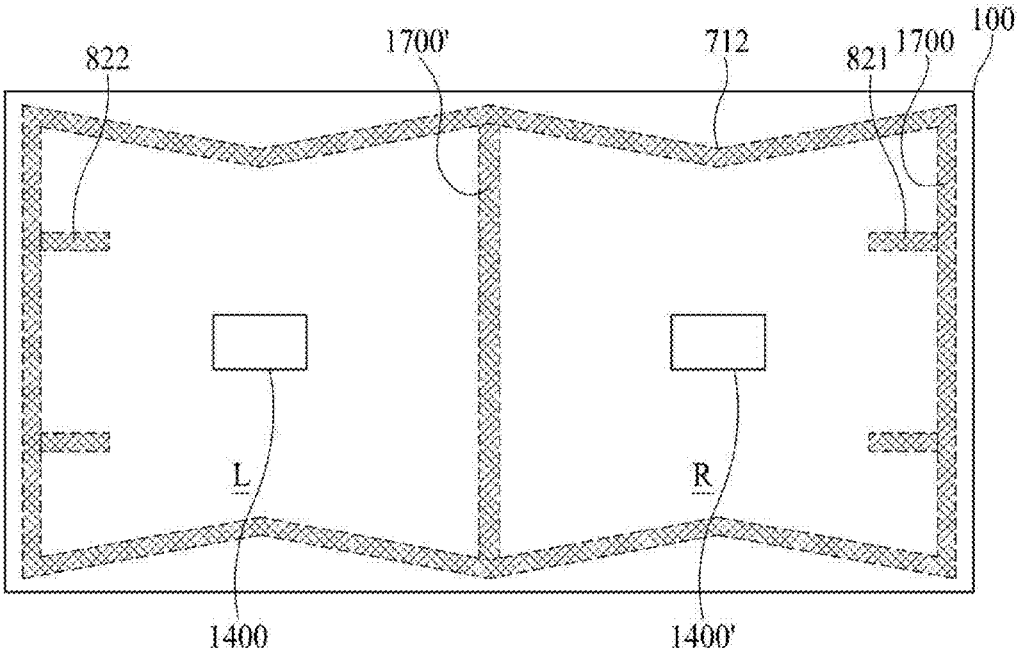
FIGS. 15A to 15J illustrate examples of a sound-generating module and a partition in a display apparatus according to an example embodiment of the present disclosure.

With reference to the example of FIG. 15A, the pad portion 821, the second pad portion 822, and the bent portions 712 and 713 may reduce the reduction of sound pressure level caused by the standing wave generated in a vertical direction of the sound-generating modules 1400 and 1400'. Therefore, a display apparatus may be provided in which sound of the low-pitched sound band or low- and middle-pitched sound bands may be further improved, and sounds of different low-, middle-, and high-pitched sound bands may be further improved.

Figure 15B:
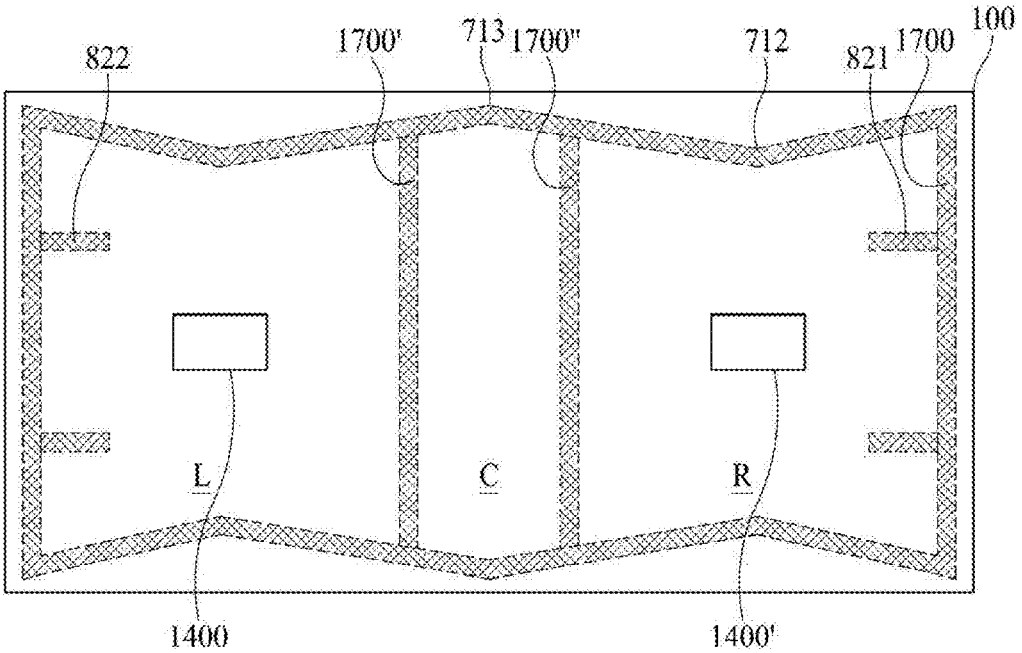

With reference to the example of FIG. 15B, the pad portion 821, the second pad portion 822, and the bent portions 712 and 713 may reduce the reduction of sound pressure level caused by the standing wave generated in a vertical direction of the sound-generating modules 1400 and 1400'. Therefore, a display apparatus may be provided in which sound of the low-pitched sound band may be further improved, and sounds of low-, middle-, and high-pitched sound bands may be further improved.

Figure 15C:
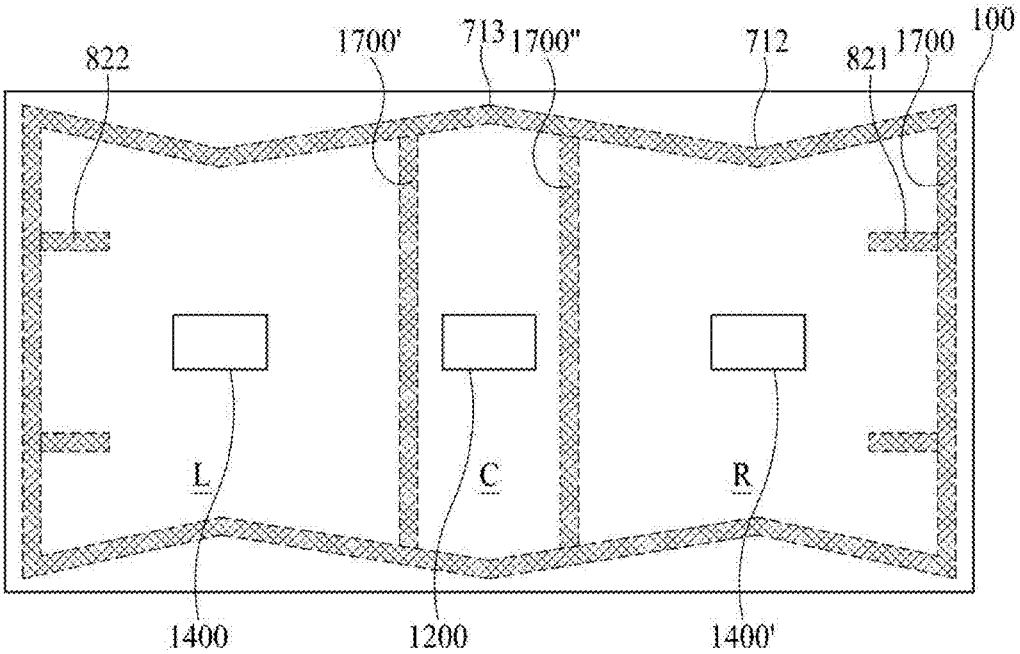

With reference to the example of FIG. 15C, the pad portion 821, the second pad portion 822, and the bent portions 712 and 713 may reduce the reduction of sound pressure level caused by the standing wave generated in a vertical direction of the sound-generating modules 1400 and 1400'. Therefore, a display apparatus may be provided in which sounds of the middle- and high-pitched sound bands may be further improved, and sounds of the low-, middle-, and high-pitched sound bands may be further improved.

Figure 15D:
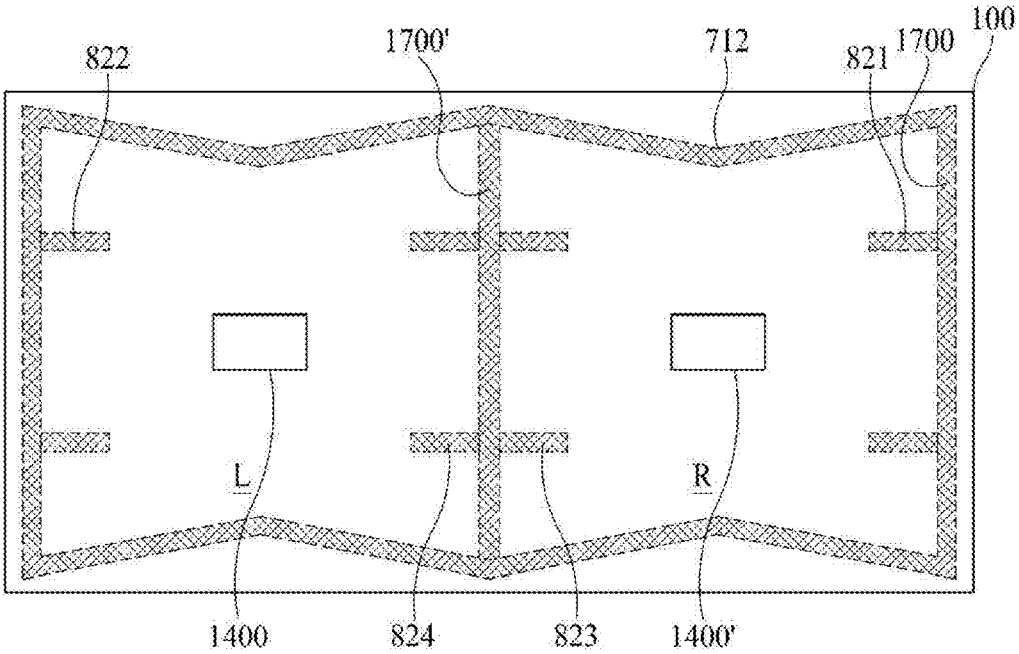
Figure 15E:
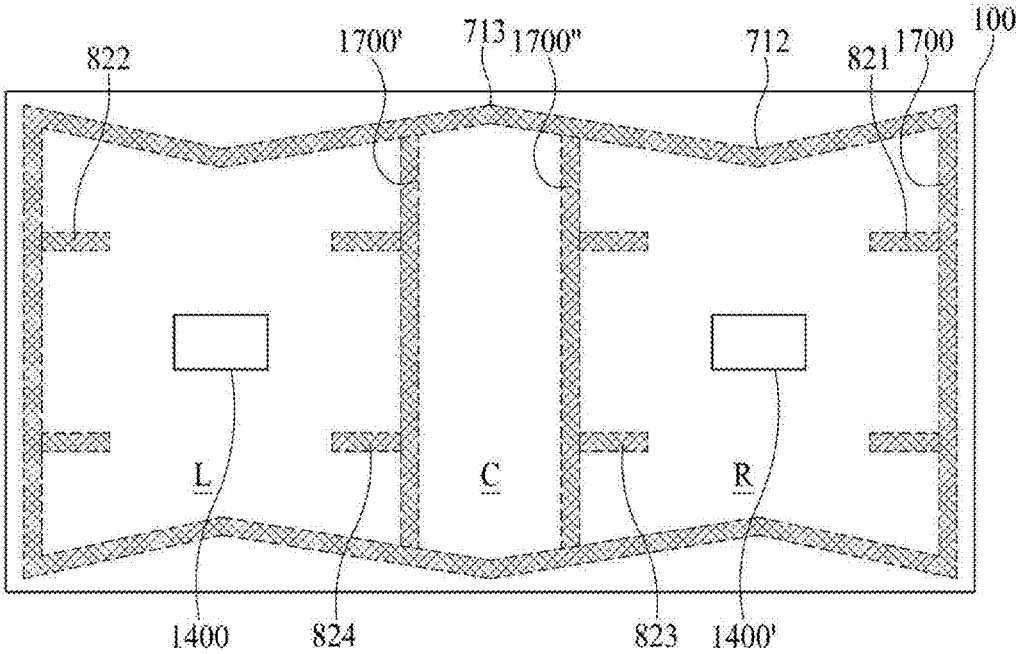

With reference to the examples of FIGS. 15D and 15E, the pad portion 821, the second pad portion 822, the third pad portion 823, the fourth pad portion 824, and the bent portions 712 and 713 may reduce the reduction of sound pressure level caused by the standing wave generated in a vertical direction of the sound-generating modules 1400 and 1400', and vibration may be transferred to both sides, whereby sound output characteristics may be improved. Therefore, in the example of FIG. 15D, a display apparatus may be provided in which sound of the low-pitched sound band or the low- and middle-pitched sound bands may be further improved, and sounds of different low-, middle-, and high-pitched sound bands may be further improved. In the example of FIG. 15E, a display apparatus may be provided in which sound of the low-pitched sound band may be further improved, and sounds of low-, middle-, and high-pitched sound bands may be further improved.

Figure 15F:
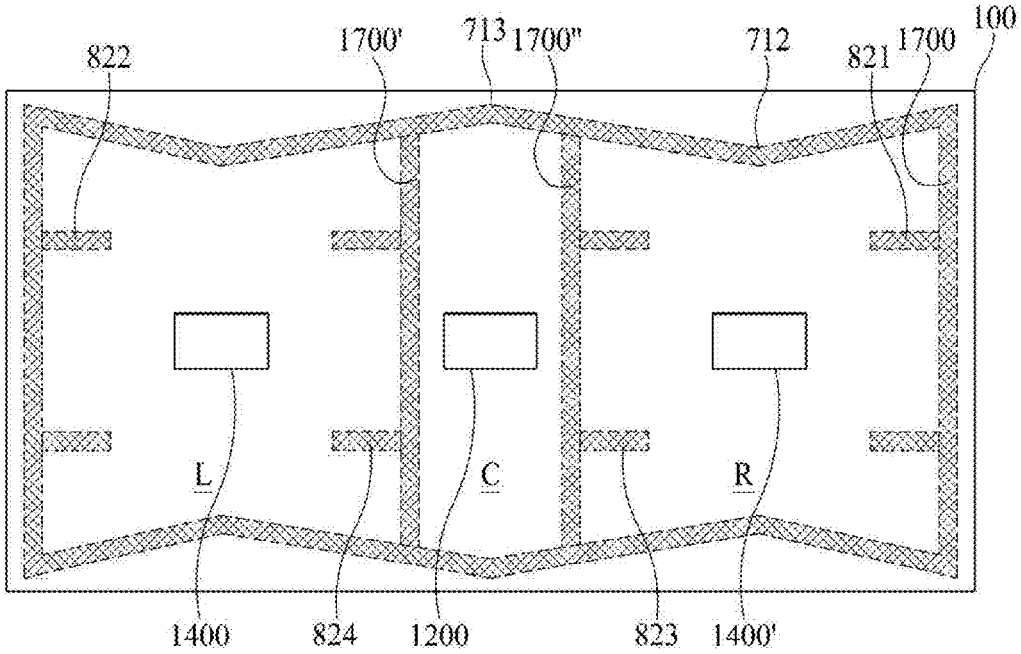

With reference to the example of FIG. 15F, the pad portion 821, the second pad portion 822, the third pad portion 823, the fourth pad portion 824, and the bent portions 712 and 713 may reduce the reduction of sound pressure level caused by the standing wave generated in a vertical direction of the sound-generating modules 1400 and 1400'. Therefore, a display apparatus may be provided in which sounds of the low-pitched sound band and the middle- and high-pitched sound bands may be further improved, and sounds of low-, middle-, and high-pitched sound bands may be further improved.

Figure 15G:
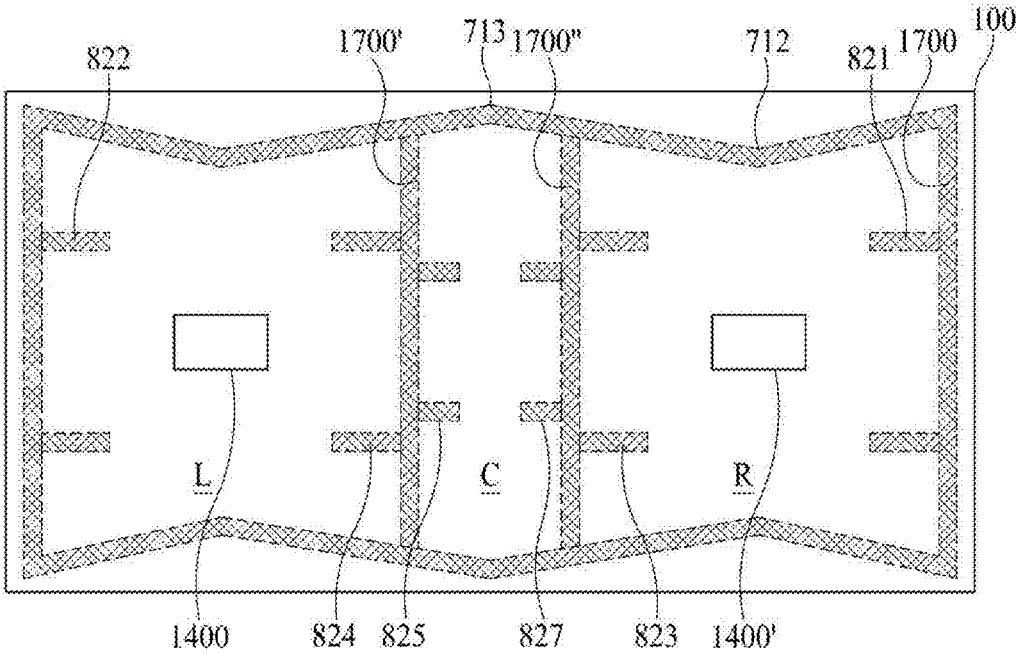

With reference to the example of FIG. 15G, at least one first member 825 and at least one second member 827 may be at the third area C corresponding to the center area of the display panel 100. For example, at least one or more members may be on at least one side of the second partition 1700' and the third partition 1700", and may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the 2-1$^{st}$ sound-generating module 1400. For example, the first member 825 may be above or below the second member 827 with respect to the 2-1$^{st}$ sound-generating module 1400. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 15H:
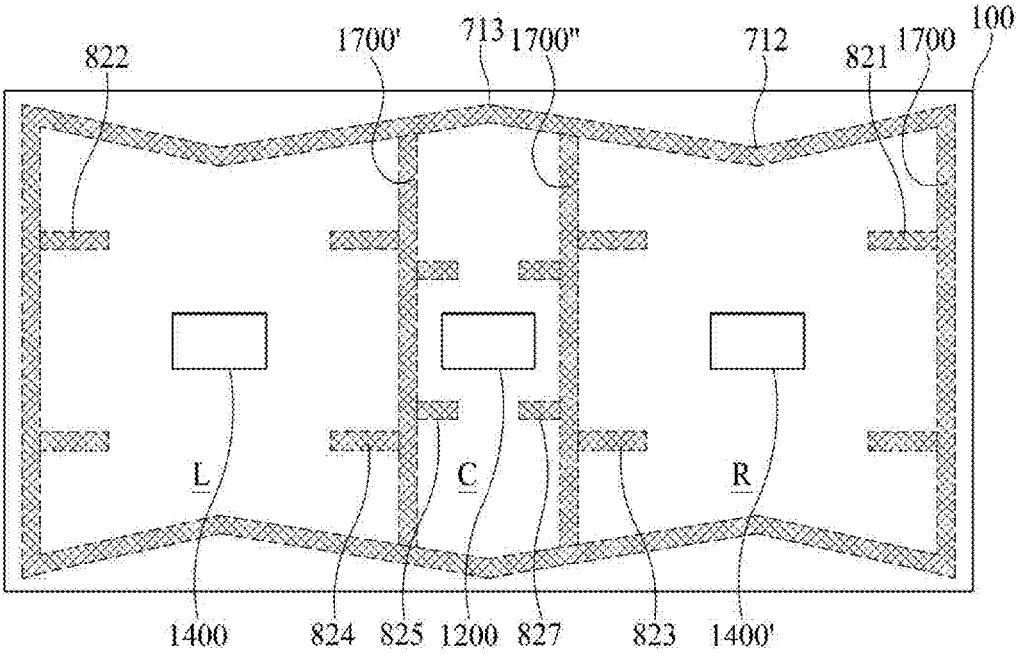

With reference to the example of FIG. 15H, the first sound-generating module 1200 may be at the third area C. At least one first member 825 and at least one second member 827 may be between the third pad portions 823 or the fourth pad portions 824, or may be between the pad portions 821 or the second pad portions 822. The first member 825 and the second member 827 may be disposed symmetrically or asymmetrically with respect to the first sound-generating module 1200. For example, the first member 825 may be above or below the second member 827 with respect to the first sound-generating module 1200. Therefore, because the first member 825 and the second member 827 may control transmission of a wave or vibration to the first area L and/or the second area R of the display panel 100, the sound of low-pitched sound band or low- and middle-pitched sound bands may be improved. Also, the sounds of the low-pitched sound band and the middle- and high-pitched sound bands may be improved by the first sound-generating module 1200. Therefore, a display apparatus may be provided in which sounds of the low-pitched sound band and the middle- and high-pitched sound bands may be further improved, and sounds of low-, middle-, and high-pitched sound bands may be further improved.

Figure 15I:
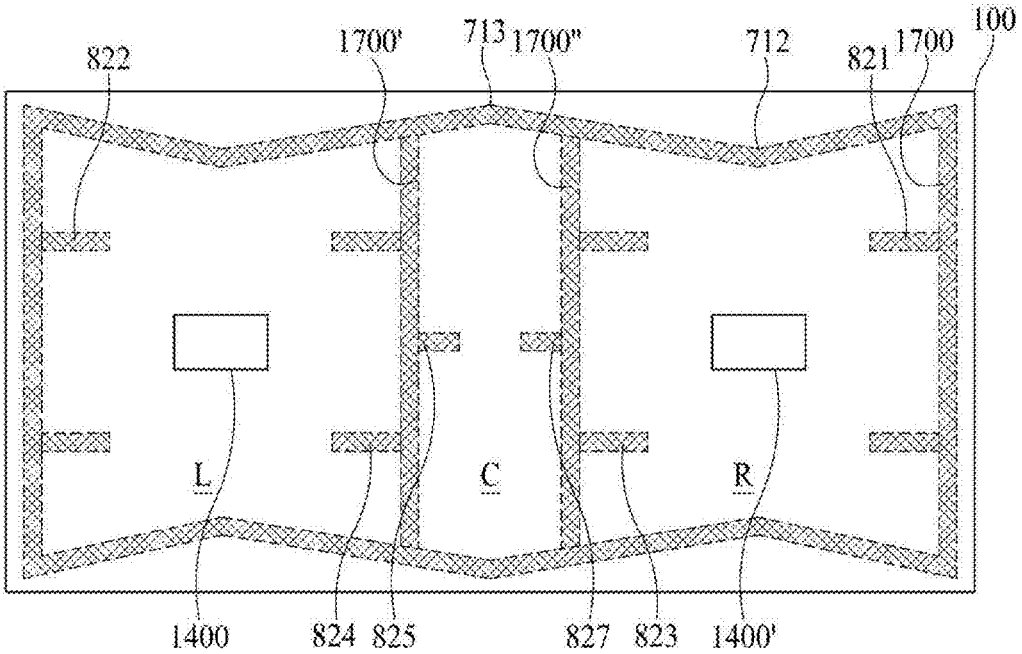

With reference to the example of FIG. 15I, duplicate description of the pad portion to the fourth pad portion described with reference to the example of FIG. 15E will be omitted. The first member 825 and the second member 827 may be at the third area C, which may be the center area of the display panel 100. The first member 825 and the second member 827 may be between the third pad portions 823 or the fourth pad portions 824, or may be between the pad portions 821 or the second pad portions 822. The first member 825 and the second member 827 may be disposed symmetrically with respect to the sound-generating modules 1400 and 1400'. For example, the first member 825 and the second member 827 may be on the same line as the 2-1$^{st}$ sound-generating module 1400 with respect to the 2-1$^{st}$ sound-generating module 1400. The first member 825 and the second member 827 may be disposed asymmetrically with respect to the sound-generating modules 1400 and 1400'. For example, with respect to the 2-1$^{st}$ sound-generating module 1400, the first member 825 may be above the 2-1$^{st}$ sound-generating module 1400, and the second member 827 may be below the 2-1$^{st}$ sound-generating module 1400. The first member 825 and the second member 827 may control transmission of a wave or vibration between the second partition 1700' and the third partition 1700" to the first area L and/or the second area R. Therefore, a display apparatus may be provided in which sound of the low-pitched sound band may be further improved, and sounds of low-, middle-, and high-pitched sound bands may be further improved.

Figure 15J:
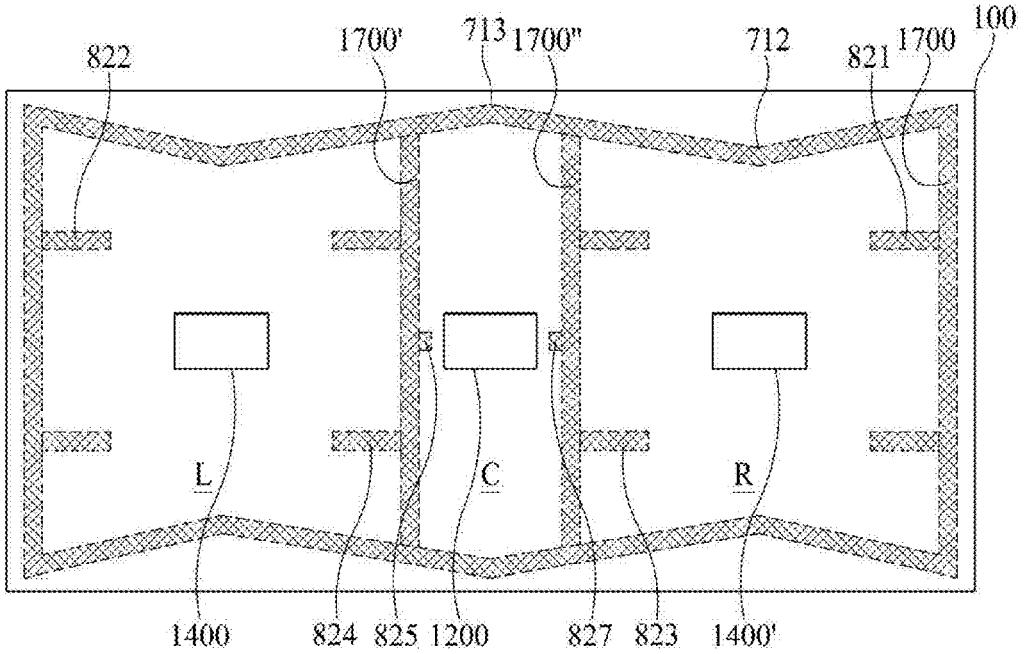

With reference to the example of FIG. 15J, the first sound-generating module 1200 may be at the third area C. The first member 825 and the second member 827 may be between the third pad portions 823 or the fourth pad portions 824, or may be between the pad portions 821 or the second pad portions 822. The first member 825 and the second member 827 may be disposed symmetrically or asymmetrically with respect to the first sound-generating module 1200. For example, the first member 825 may be above or below the second member 827 with respect to the first sound-generating module 1200. Therefore, because the first member 825 and the second member 827 may control transmission of a wave or vibration to the first area L and/or the second area R of the display panel 100, the sound of the low-pitched sound band or the middle- and high-pitched sound bands may be improved. Also, the sounds of the low-pitched sound band and the middle- and high-pitched sound bands may be improved by the first sound-generating module 1200. Therefore, a display apparatus may be provided in which sounds of the low-pitched sound band and the middle- and high-pitched sound bands may be further improved, and sounds of low-, middle-, and high-pitched sound bands may be further improved.

The sound generator according to an example embodiment of the present disclosure may be applied to the sound generator in the display apparatus. The display apparatus according to an example embodiment of the present disclosure may be applied, for example, to a mobile apparatus, a video phone, a smart watch, a watch phone, a wearable apparatus, a foldable apparatus, a rollable apparatus, a bendable apparatus, a flexible apparatus, a curved apparatus, an electronic organizer, an electronic book, a portable multimedia player (PMP), a personal digital assistant (PDA), an MP3 player, a mobile medical apparatus, a desktop personal computer (PC), a laptop PC, a netbook computer, workstation, navigation, vehicle navigation, signage apparatus, a game apparatus, a television, a notebook computer, a monitor, a camera, a camcorder, an automotive display, and a home appliance. The sound generator of the present disclosure may be applied to an organic light-emitting lighting apparatus or an inorganic light-emitting lighting apparatus. If the sound generator is applied to the lighting apparatus, the sound generator may serve as a lamp or lighting and a speaker.

The display apparatus according to an example embodiment of the present disclosure may be described as follows.

According to an embodiment of the present disclosure, a display apparatus may include: a display panel configured to display an image, a supporting member on a rear surface of the display panel, a sound generator between the display panel and the supporting member, and a vibration member between the sound generator and the supporting member, the vibration member having a diameter greater than or equal to that of the sound generator.

For example, a display apparatus according to an embodiment of the present disclosure may further include: a vibration transfer member between the display panel and the sound generator, and at least one vibration adjustment member between the vibration member and the supporting member. For example, in a display apparatus according to an embodiment of the present disclosure, the vibration transfer member and the at least one vibration adjustment member may include different materials.

For example, in a display apparatus according to an embodiment of the present disclosure, the vibration transfer member may be at a center of the sound generator, and a respective one of the at least one vibration adjustment member may be at two peripheries of the sound generator. For example, in a display apparatus according to an embodiment of the present disclosure, the vibration transfer member may be configured to transfer a sound of a high-pitched sound band of the sound generator to the display panel, and the at least one vibration adjustment member may be configured to adjust a sound of a low pitched sound band of the sound generator.

For example, a display apparatus according to an embodiment of the present disclosure may further include: at least one vibration adjustment member between the vibration member and the supporting member, and at least one second vibration adjustment member between the display panel and the vibration member. For example, in a display apparatus according to an embodiment of the present disclosure, the at least one vibration adjustment member and the at least one second vibration adjustment member may include a same material.

For example, in a display apparatus according to an embodiment of the present disclosure, respective ones of the at least one vibration adjustment member and the at least one second vibration adjustment member may be each at two peripheries of the sound generator. For example, in a display apparatus according to an embodiment of the present disclosure, the at least one vibration adjustment member and the at least one second vibration adjustment member may be configured to adjust a sound of a low-pitched sound band of the sound generator. For example, in a display apparatus according to an embodiment of the present disclosure, the sound generator may include a piezoelectric sound generator.

According to an embodiment of the present disclosure, a display apparatus may include: a display panel configured to display an image, a supporting member on a rear surface of the display panel, a sound generator between the display panel and the supporting member, a vibration member on a rear surface of the sound generator, and at least one vibration adjustment member between the vibration member and the supporting member.

For example, in a display apparatus according to an embodiment of the present disclosure, a diameter of the vibration member may be greater than or equal to that of the sound generator. For example, in a display apparatus according to an embodiment of the present disclosure, the at least one vibration adjustment member may be configured to adjust a low-pitched sound band of the sound generator.

For example, a display apparatus according to an embodiment of the present disclosure may further include a vibration transfer member between the display panel and the sound generator. For example, in a display apparatus according to an embodiment of the present disclosure, the vibration transfer member may be at a center of the sound generator, and the at least one vibration adjustment member may be at two peripheries of the sound generator.

For example, in a display apparatus according to an embodiment of the present disclosure, the vibration transfer member may be configured to transfer a high-pitched sound band of the sound generator, and the at least one vibration adjustment member may be configured to adjust a low-pitched sound band of the sound generator. For example, in a display apparatus according to an embodiment of the present disclosure, the vibration transfer member and the at least one vibration adjustment member may include different materials.

For example, a display apparatus according to an embodiment of the present disclosure may further include at least one second vibration adjustment member between the display panel and the vibration member. For example, in a display apparatus according to an embodiment of the present disclosure, respective ones of the at least one vibration adjustment member and the at least one second vibration adjustment member may be each at two peripheries of the sound generator.

For example, in a display apparatus according to an embodiment of the present disclosure, the at least one vibration adjustment member and the at least one second vibration adjustment member may include a same material. For example, in a display apparatus according to an embodiment of the present disclosure, the at least one vibration adjustment member and the at least one second vibration adjustment member may be configured to adjust a low-pitched sound band of the sound generator.

According to an embodiment of the present disclosure, a display apparatus may include: a display panel configured to display an image, and a sound-generating module including: a supporting member on a rear surface of the display panel, a sound generator, a vibration member between the sound generator and the supporting member, and at least one vibration adjustment member between the vibration member and the supporting member.

For example, in a display apparatus according to an embodiment of the present disclosure, the sound-generating module may further include: a first sound-generating module including a vibration transfer member between the display panel and the sound generator, and a second sound-generating module including at least one second vibration adjustment member between the display panel and the vibration member. For example, in a display apparatus according to an embodiment of the present disclosure, a rear surface of the display panel may include a first area, a second area, and a third area, and one of the first sound-generating module or the second sound-generating module may be in each of the first area and the second area.

For example, a display apparatus according to an embodiment of the present disclosure may further include: a first partition at a periphery of the rear surface of the display panel, and a second partition between the first area and the second area. For example, a display apparatus according to an embodiment of the present disclosure may further include: a first partition at a periphery of the rear surface of the display panel, a second partition between the first area and the second area, and at least one bent portion on at least one side of the first partition, and extending toward the first sound-generating module or the second sound-generating module.

For example, a display apparatus according to an embodiment of the present disclosure may further include: a first partition at a periphery of the rear surface of the display panel, a second partition between the first area and the second area, at least one bent portion on a first side of the first partition, and extending toward the first sound-generating module or the second sound-generating module, and at least one pad portion on a second side vertical to a first side of the first partition or on the second side of the first partition and at least one side of the second partition. For example, a display apparatus according to an embodiment of the present disclosure may further include: a first partition at a periphery of the rear surface of the display panel, a second partition between the first area and the second area, and at least one pad portion on a second side vertical to a first side of the first partition or on the second side of the first partition and at least one side of the second partition.

For example, in a display apparatus according to an embodiment of the present disclosure, a rear surface of the display panel may include a first area, a second area, and a third area, the first sound-generating module may be at each of the first area and the second area and the second sound-generating module may be at the third area, or the first sound-generating module may be at each of the first area and the second area. For example, a display apparatus according to an embodiment of the present disclosure may further include: a first partition at a periphery of the rear surface of the display panel, a second partition between the first area and the third area, and a third partition between the second area and the third area.

For example, a display apparatus according to an embodiment of the present disclosure may further include: a first partition at a periphery of the rear surface of the display panel, a second partition between the first area and the third area, a third partition between the second area and the third area, and at least one bent portion on at least one side of the first partition, and extending toward the first sound-generating module or the second sound-generating module. For example, a display apparatus according to an embodiment of the present disclosure may further include: a first partition at a periphery of the rear surface of the display panel, a second partition between the first area and the third area, a third partition between the second area and the third area, at least one bent portion on a first side of the first partition, and extending toward the first sound-generating module or the second sound-generating module, and at least one pad portion on a second side vertical to the first side of the first partition, or on the second side of the first partition and at least one side of the second partition and the third partition.

For example, a display apparatus according to an embodiment of the present disclosure may further include at least one member on at least one side of the second partition and the third partition and in the third area. For example, a display apparatus according to an embodiment of the present disclosure may further include: a first partition at a periphery of the rear surface of the display panel, a second partition between the first area and the third area, a third partition between the second area and the third area, and at least one pad portion on a second side vertical to a first side of the first partition or on the second side of the first partition and at least one side of the second partition and the third partition. For example, a display apparatus according to an embodiment of the present disclosure may further include at least one member on at least one side of the second partition and the third partition and in the third area.

For example, in a display apparatus according to an embodiment of the present disclosure, a rear surface of the display panel may include a first area, a second area, and a third area, the second sound-generating module may be at each of the first area and the second area and the first sound-generating module may be at the third area, or the second sound-generating module may be at each of the first area and the second area. For example, a display apparatus according to an embodiment of the present disclosure may further include: a first partition at a periphery of the rear surface of the display panel, a second partition between the first area and the third area, and a third partition between the second area and the third area.

For example, a display apparatus according to an embodiment of the present disclosure may further include: a first partition at a periphery of the rear surface of the display panel, a second partition between the first area and the third area, a third partition between the second area and the third area, and at least one bent portion on at least one side of the first partition, and extending toward the first sound-generating module or the second sound-generating module. For example, a display apparatus according to an embodiment of the present disclosure may further include: a first partition at a periphery of the rear surface of the display panel, a second partition between the first area and the third area, a third partition between the second area and the third area, at least one bent portion on a first side of the first partition, and extending toward the first sound-generating module or the second sound-generating module, and at least one pad portion on a second side vertical to the first side of the first partition or on the second side of the first partition and at least one side of the second partition and the third partition.

For example, a display apparatus according to an embodiment of the present disclosure may further include at least one member on at least one side of the second partition and the third partition and in the third area. For example, a display apparatus according to an embodiment of the present disclosure may further include: a first partition at a periphery of the rear surface of the display panel, a second partition between the first area and the third area, a third partition between the second area and the third area, and at least one pad portion on a second side vertical to a first side of the first partition or on the second side of the first partition and at least one side of the second partition and the third partition. For example, a display apparatus according to an embodiment of the present disclosure may further include at least one member on at least one side of the second partition and the third partition and in the third area.

As described above, the display apparatus according to an example embodiment of the present disclosure has at least the following advantages.

When the display apparatus according to an example embodiment of the present disclosure includes the sound generator for generating a sound by vibrating the display panel, the sound may be generated, such that the progressing direction of the sound may travel toward the front surface of the display panel. Therefore, an immersion experience of a viewer who may view the image of the display apparatus may be improved.

When the display apparatus according to an example embodiment of the present disclosure includes the sound generator for generating a sound by vibrating the display panel, the speaker may not be required. As such, design of the set apparatus and freedom of degree in arrangement of the speaker may be improved. When the display apparatus according to an example embodiment of the present disclosure includes the sound generator having a small size, the thickness of the display apparatus may be reduced.

When the display apparatus according to an example embodiment of the present disclosure includes the sound generator and the vibration member, sound quality of the sound may be improved. As such, a display apparatus, in which sound of the low-pitched sound band is improved, may be provided to output the sound of the low-pitched sound band to the high-pitched sound band.

When the display apparatus according to an example embodiment of the present disclosure includes the vibration adjustment member capable of performing an alignment function, assembly of the display panel and the supporting member may be improved. When the display apparatus according to an example embodiment of the present disclosure includes the sound generator and at least one vibration transfer member, unnecessary vibration or motion of the sound generator may be avoided, and planarization of the sound may be improved.

When the display apparatus according to an example embodiment of the present disclosure includes the sound generator or the vibration transfer member or the vibration adjustment member, a display apparatus, in which sound of the low-pitched sound band is improved, may be provided to output the sound of the low-pitched sound band to the high-pitched sound band. When the display apparatus according to an example embodiment of the present disclosure includes the partition between at least one or more sound-generating modules on the display panel, the sounds may be split by the partition, and stereo sound may be realized. As such, a display apparatus may be provided in which a sound output property is improved.

When the display apparatus according to an example embodiment of the present disclosure includes the partition between at least one or more sound-generating modules on the display panel, at least one or more pad portions may be on at least one side of the partition. As such, a display apparatus may be provided in which a sound output property is improved.

When the display apparatus according to an example embodiment of the present disclosure includes the partition between at least one or more sound-generating modules on the display panel, at least one or more bent portions may be on at least one side of the partition. As such, a display apparatus may be provided in which a sound output property is improved.

When the display apparatus according to an example embodiment of the present disclosure includes the partition between at least one or more sound-generating modules on the display panel, at least one or more pad portions and bent portions may be on at least one side of the partition. As such, a display apparatus may be provided in which a sound output property is improved.

When the display apparatus according to an example embodiment of the present disclosure includes the partition between at least one or more sound-generating modules on the display panel, at least one or more pad portions may be on at least one side of the partition, and at least one or more members may be on at least one side of the partition. As such, a display apparatus may be provided in which a sound output property is improved.

When the display apparatus according to an example embodiment of the present disclosure includes the partition between at least one or more sound-generating modules on the display panel, at least one or more pad portions and bent portions may be on at least one side of the partition, and at least one or more members may be on at least one side of the partition. As such, a display apparatus may be provided in which a sound output property is improved.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display apparatus, comprising:

a display panel configured to display an image having a first area, a second area, and a third area, comprising:

a first partition between the display panel and the supporting member;

a second partition between the first area and the third area;

a third partition between the second area and the third area; and at least one bent portion on at least one side of the first partition;

a supporting member on a rear surface of the display panel; and at least one of a first sound-generating module and a second sound-generating module in a rear surface of the display panel, wherein the first sound-generating module is in each of the first area and the second area and the second sound-generating module is in the third area, and wherein the first sound-generating module comprises:

a first sound generator, a vibration member between the first sound generator and the supporting member, a vibration transfer member between the display panel and the first sound generator, and at least one vibration adjustment member between the vibration member and the supporting member, and wherein the second sound-generating module comprises:

a second sound generator, a vibration member between the second sound generator and the supporting member, at least one vibration adjustment member between the vibration member and the supporting member, and at least one second vibration adjustment member between the display panel and the vibration member.

2. The display apparatus of claim 1, wherein one of the first sound-generating module or the second sound-generating module is in each of the first area and the second area.

3. The display apparatus of claim 1, further comprising:

a first partition between the display panel and the supporting member; and a second partition between the first area and the third area; and a third partition between the second area and the third area.

4. The display apparatus of claim 1, further comprising:

a first partition between the display panel and the supporting member;

a second partition between the first area and the third area;

a third partition between the second area and the third area;

at least one bent portion on a first side of the first partition; and at least one pad portion on a second side vertical to the first side of the first partition, or on the second side of the first partition and at least one side of the second partition and the third partition.

5. The display apparatus of claim 1, further comprising:

a first partition between the display panel and the supporting member;

a second partition between the first area and the third area;

a third partition between the second area and the third area; and at least one pad portion on a side of the first partition or on at least one side of the second partition and the third partition.

6. The display apparatus of claim 1, further comprising:

a first partition between the display panel and the supporting member;

a second partition between the first area and the third area;

a third partition between the second area and the third area;

at least one first pad portion at the second area and on a first side of the first partition;

at least one second pad portion at the first area and on the first side of the first partition;

at least one third pad portion on a side of the third partition; and at least one fourth pad portion on a side of the second partition.

7. The display apparatus of claim 1, further comprising:

a first partition between the display panel and the supporting member;

a second partition between the first area and the third area;

a third partition between the second area and the third area;

at least one first pad portion at the second area and on a first side of the first partition;

at least one second pad portion at the first area and on the first side of the first partition;

at least one third pad portion on a side of the third partition;

at least one fourth pad portion on a side of the second partition;

at least one first member on a side of the second partition; and at least one second member on a side of the third partition.

8. The display apparatus of claim 1, further comprising:

a first partition between the display panel and the supporting member; and a second partition between the first area and the second area.

9. The display apparatus of claim 1, further comprising:

a first partition between the display panel and the supporting member;

a second partition between the first area and the second area; and at least one bent portion on at least one side of the first partition.

10. The display apparatus of claim 1, further comprising:

a first partition between the display panel and the supporting member;

a second partition between the first area and the second area;

at least one bent portion on a first side of the first partition; and at least one pad portion on a second side vertical to a first side of the first partition or on the second side of the first partition and at least one side of the second partition.

11. The display apparatus of claim 1, further comprising:

a first partition between the display panel and the supporting member;

a second partition between the first area and the second area; and at least one pad portion on a second side vertical to a first side of the first partition or on the second side of the first partition and at least one side of the second partition.

12. The display apparatus of claim 1, wherein:

the vibration member is configured to transfer a sound of a high-pitched sound band of the sound generator to the display panel; and at least one or more of the at least one vibration adjustment member and the at least second vibration adjustment member is configured to transfer a sound of a low-pitched sound band of the sound generator to the display panel.

* * * * *